US008564531B2

(12) United States Patent
Ozawa

(10) Patent No.: US 8,564,531 B2
(45) Date of Patent: Oct. 22, 2013

(54) ELECTRONIC APPARATUS AND METHOD OF DRIVING THE SAME

(75) Inventor: Tokuro Ozawa, Suwa (JP)

(73) Assignee: Seiko Epson Corporation (JP)

( * ) Notice: Subject to any disclaimer, the term of this patent is extended or adjusted under 35 U.S.C. 154(b) by 296 days.

(21) Appl. No.: 13/115,443

(22) Filed: May 25, 2011

(65) Prior Publication Data

US 2011/0291708 A1 Dec. 1, 2011

(30) Foreign Application Priority Data

May 26, 2010 (JP) ..... 2010-120195

(51) Int. Cl.
*G09G 3/34* (2006.01)

(52) U.S. Cl.
USPC ..... 345/107; 345/78

(58) Field of Classification Search
None
See application file for complete search history.

(56) References Cited

U.S. PATENT DOCUMENTS

| | | | | |
|---|---|---|---|---|
| 6,229,506 | B1 * | 5/2001 | Dawson et al. | 345/82 |
| 6,876,345 | B2 | 4/2005 | Akimoto et al. | |
| 7,649,515 | B2 | 1/2010 | Ozawa et al. | |
| 2004/0252089 | A1 * | 12/2004 | Ono et al. | 345/82 |

FOREIGN PATENT DOCUMENTS

| | | |
|---|---|---|
| JP | 2005-309150 | 11/2005 |
| JP | 2008-033347 | 2/2008 |
| JP | 2009-048202 | 3/2009 |

OTHER PUBLICATIONS

Hwang, Young-In et al., "New Simple Pixel Circuits for Threshold Voltage and IR-Drop Compensation for Amoled Displays", OLED R&D Center, Samsung Mobile Display Co., Ltd., pp. 635-638 (2010).

* cited by examiner

*Primary Examiner* — Adam R Giesy
(74) *Attorney, Agent, or Firm* — Harness, Dickey & Pierce, P.L.C.

(57) ABSTRACT

An electronic apparatus includes an electronic circuit including a driving transistor, an additional capacitive element and a first switch for controlling a connection between a circuit point and a control terminal and a driving circuit which controls the first switch to an off state and changes the potential of the control terminal such that the driving transistor transitions to an on state in a first period, controls the first switch to the on state so as to set the potential of the control terminal to an initial compensation value, in a second period, and controls the first switch to the on state and changes the driving potential from the first potential to the second potential such that the driving transistor transitions to the on state, in a third period.

10 Claims, 32 Drawing Sheets

<INITIALIZATION PERIOD $T_{RST}$ (INITIALIZATION OPERATION)>

<END OF INITIALIZATION PERIOD $T_{RST}$>

<COMPENSATION PREPARATION PERIOD $Q_A$ (WRITING OPERATION)>

⟨COMPENSATION PREPARATION PERIOD $Q_A$ (SETTING OF INITIAL COMPENSATION VALUE $V_{INI}$)⟩

<COMPENSATION EXECUTION PERIOD $Q_B$ (COMPENSATION OPERATION)>

<END OF COMPENSATION EXECUTION PERIOD $Q_B$>

<OPERATION PERIOD $T_{DRV}$ (DRIVING OPERATION)>

<INITIALIZATION PERIOD $T_{RST}$ (INITIALIZATION OPERATION)>

<COMPENSATION PREPARATION PERIOD $Q_A$ (tb–tc)>

<COMPENSATION PREPARATION PERIOD $Q_A$ (tc−td)>

<COMPENSATION EXECUTION PERIOD $Q_B$ (COMPENSATION OPERATION)>

<END OF COMPENSATION EXECUTION PERIOD $Q_B$>

<WRITE PERIOD $T_{WRT}$ (SELECTION PERIOD $H_{[m]}$)>

<OPERATION PERIOD $T_{DRV}$ (DRIVING OPERATION)>

ELECTRONIC APPARATUS AND METHOD OF DRIVING THE SAME

CROSS-REFERENCE TO RELATED APPLICATION

This application is based on and claims priority from Japanese Patent Application No. 2010-120195, filed on May 26, 2010, the contents of which are incorporated herein by reference.

BACKGROUND

1. Technical Field

The present invention relates to a technique of compensating for error of characteristics (more particularly, threshold voltage) of a transistor within an electronic circuit.

2. Related Art

In JP-A-2009-48202, a technique of compensating for error of characteristics (threshold voltage or mobility) of a driving transistor used for driving an organic EL element is disclosed. FIG. 43 is a circuit diagram of a pixel circuit 90 disclosed in JP-A-2009-48202 (FIG. 11). In a write period in which a gradation potential according to a designated gradation is supplied to an electrode 93 of a capacitive element 92 through a switch 91, a gate and a drain are connected (diode-connected) to a switch 95 in a state in which a driving transistor 94 is held in an on state. Accordingly, a voltage between the gate and the source of the driving transistor 94 is set to a voltage Vrst for compensating for error of its threshold voltage VTH. A driving potential having a triangular wave shape is supplied to the electrode 93 of the pixel circuit 90 in a driving period after the elapse of the write period so as to variably control a light emission time of a light emitting element 97 connected to a circuit point 96 according to the designated gradation.

However, it is difficult to apply the technique of JP-A-2009-48202 to a configuration in which an electro-optical element having high resistance, such as an electrophoretic element or a liquid crystal element, is connected to the circuit point 96. Since current barely flows in the electro-optical element, the potential of the circuit point 96 is not set. Accordingly, even when the driving transistor 94 and the switch 95 are controlled to the on state in the write period, the voltage between the gate and the source of the driving transistor 94 does not converge to a target voltage Vrst.

SUMMARY

An advantage of some aspects of the invention is that it efficiently compensates for error of characteristics of a driving transistor.

According to an aspect of the invention, there is provided an electronic apparatus including an electronic circuit and a driving circuit, wherein the electronic circuit includes a driving transistor including a first terminal connected to a driving potential line to which a driving potential is supplied, a second terminal connected to a circuit point, and a control terminal for controlling a connection state between both terminals; an additional capacitive element connected to the circuit point; and a first switch (for example, a switch $S_{W1}$) which controls a connection between the circuit point and the control terminal, wherein the driving circuit controls the first switch to an off state and changes the potential of the control terminal such that the driving transistor transitions to an on state, in a first period (for example, an initialization period $T_{RST}$) in which the driving potential is set to a first potential (for example, a high-level potential $V_{DR_H}$), controls the first switch to the on state so as to set the potential of the control terminal to an initial compensation value, in a second period (for example, a compensation preparation period $Q_A$) after the elapse of the first period, and controls the first switch to the on state and changes the driving potential from the first potential to a second potential (for example, a low-level potential $V_{DR_L}$) such that the driving transistor transitions to the on state, in a third period (for example, a compensation execution period $Q_B$) after the elapse of the second period.

In the above configuration, in the first period, the first potential is supplied from the driving potential line to the circuit point through the first terminal and the second terminal of the driving transistor controlled to the on state according to the change in the potential of the control terminal. In the second period, the first switch is controlled to the on state and the additional capacitive element is connected to the control terminal such that the potential of the control terminal is set to the initial compensation value. In the third period, since the driving transistor diode-connected through the first switch is controlled to the on state according to the change in the driving potential (the potential of the first terminal), the charges of the control terminal are moved to the driving potential line through the first switch, the circuit point, the second terminal and the first terminal. Accordingly, the voltage between the control terminal of the driving transistor and the first terminal approaches (ideally, reaches) its threshold voltage. In the above configuration, since the potential of the circuit point is set to the first potential in the first period, if the first potential is appropriately selected, current may reliably flow in the driving transistor in the third period. Accordingly, even in a state in which a driven element with high resistance is connected to the circuit point, it is possible to effectively compensate for the error of the characteristics of the driving transistor by the compensation operation of the third period.

In the second period, the method of setting the potential of the control terminal to the initial compensation value is arbitrary. For example, the driving circuit associated with the aspect of the invention may change the potential of the control terminal in an opposite direction of the change in the first period before the start of the second period and controls the first switch to the on state in the second period so as to set the potential of the control terminal to the initial compensation value. In the aspect of the invention, if the potential of the control terminal is changed in the opposite direction of the change in the first period before the start of the second period and the additional capacitive element and the control terminal are connected through the first switch in the second period, charge is moved between the additional capacitive element and the control terminal such that the initial compensation value is set. Accordingly, it is possible to set the initial compensation value (for example, set the initial compensation value to a high potential if the driving transistor is of an N channel type) such that the driving transistor easily transitions to the on state in the third period.

The driving circuit associated with the aspect of the invention may change the potential of the control terminal in an opposite direction of the change in the first period so as to set the potential of the control terminal to the initial compensation value, after the first switch is controlled to the on state, in the second period. In the aspect of the invention, while the first switch is controlled to the off state in the first period such that the additional capacitive element is insulated from the control terminal in the first period, the first switch is controlled to the on state in the second period such that the additional capacitive element is connected to the control terminal. Accordingly, the amount of change in the potential of the control terminal in the second period is less than the amount of change in the first period. Using the above-described difference, it is possible to set the initial compensation value (for example, set the initial compensation value to a high potential if the driving transistor is of an N channel type) such that the driving transistor easily transitions to the on state in the third period.

According to the configuration in which the initial compensation value is set such that the driving transistor easily transitions to the on state in the third period as in the above-described aspects of the invention, it is possible to reduce the amplitude (a difference between the first potential and the second potential) of the driving potential necessary to change the driving transistor to the on state in the third period.

In the aspect of the invention, the electronic circuit may include a first capacitive element including a first electrode (for example, an electrode $E_1$) and a second electrode (for example, an electrode $E_2$), the second electrode may be connected to the control terminal, and the driving circuit may supply a signal potential (for example, a gradation potential $V_{D[m,n]}$) to the first electrode within the third period or after the elapse of the third period, and variably sets a voltage between the control terminal and the first terminal in a fourth period (for example, an operation period $T_{DRV}$) after the elapse of the third period. In the above aspect, the state (on/off) of the driving transistor is controlled according to the level of the absolute value of the voltage between the control terminal and the first terminal set in the fourth period and the absolute value of the voltage set according to the signal potential supplied to the first electrode and the compensation operation in the third period. That is, the electronic circuit functions as a comparison circuit for generating a voltage signal in the circuit point according to the result of comparing the voltage between the control terminal and the first terminal within the fourth period and before the start of the fourth period.

The driving circuit of a suitable configuration of the aspect of the invention may variably set the potential of the first electrode in the fourth period. In the configuration of the invention, the potential of the control terminal of the driving transistor is in tandem with the potential of the first electrode such that the voltage between the control terminal and the first terminal is variably set. The electronic circuit of another configuration of the aspect of the invention may include a second capacitive element including a third electrode (for example, an electrode $E_3$) and a fourth electrode (for example, an electrode $E_4$), the fourth electrode may be connected to the control terminal, and the driving circuit may variably set the potential of the third electrode in the fourth period. In the configuration of the aspect of the invention, the potential of the control terminal of the driving transistor is in tandem with the potential of the third electrode such that the voltage between the control terminal and the first terminal is variably set. According to the configuration of the aspect of the invention, it is possible to reduce the amplitude of the potential of the first electrode as compared to the configuration of the aspect of the invention. According to the configuration of the aspect of the invention, the second capacitive element of the configuration of the aspect of the invention is unnecessary. The driving circuit of another suitable configuration of the aspect of the invention may variably set the driving potential of the driving potential line in the fourth period. In the configuration of the invention, the voltage between the control terminal and the first terminal may be variably set according to the driving potential.

The configuration of the electronic circuit is appropriately changed. For example, in the electronic circuit associated with an aspect of the invention, the first electrode of the first capacitive element may be directly connected to a signal line to which the signal potential is supplied. The electronic circuit associated with an aspect of the invention may include a second switch (for example, a switch $S_{W2}$) which controls electrical connection between the first electrode of the first capacitive element and a signal line to which the signal potential is supplied. According to the aspect of the invention, it is possible to reduce the number of active elements (switches) as compared to the aspect of the invention. In the aspect of the invention, since the second switch is controlled to the off state such that the first electrode is electrically insulated from the signal line, it is possible to reduce the capacitive component pertaining to the signal line as compared to the aspect of the invention.

A suitable example of an electronic apparatus according to the above aspects is an electro-optical device for driving an electro-optical element. The electro-optical device includes an electro-optical element connected to a circuit point of an electronic circuit of the electronic apparatus associated with the above aspects. The electro-optical element is a driven element for converting one to the other of an electrical operation (electric field application or current supply) and an optical operation (gradation or luminance change). The electro-optical device may be mounted in various electronic apparatus as a display apparatus for displaying an image. The electro-optical device of the invention is suitably employed in an electronic apparatus such as a portable information terminal or an electronic paper.

The invention specifies a method of driving the electronic apparatus associated with the above aspects. More specifically, there is provided a method of driving an electronic apparatus including a driving transistor having a first terminal connected to a driving potential line to which a driving potential is supplied, a second terminal connected to a circuit point and a control terminal for controlling a connection state between both terminals, an additional capacitive element connected to the circuit point, and a first switch which controls a connection between the circuit point and the control terminal, the method including: controlling the first switch to an off state and changing the potential of the control terminal such that the driving transistor transitions to an on state, in a first period in which the driving potential is set to a first potential; controlling the first switch to the on state so as to set the potential of the control terminal to an initial compensation value, in a second period after the elapse of the first period; and controlling the first switch to the on state and changing the driving potential from the first potential to a second potential such that the driving transistor transitions to the on state, in a third period after the elapse of the second period. According to the above driving method, the same operations and effects as the electronic apparatus according to the invention are realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

A: First Embodiment

Figure 1:
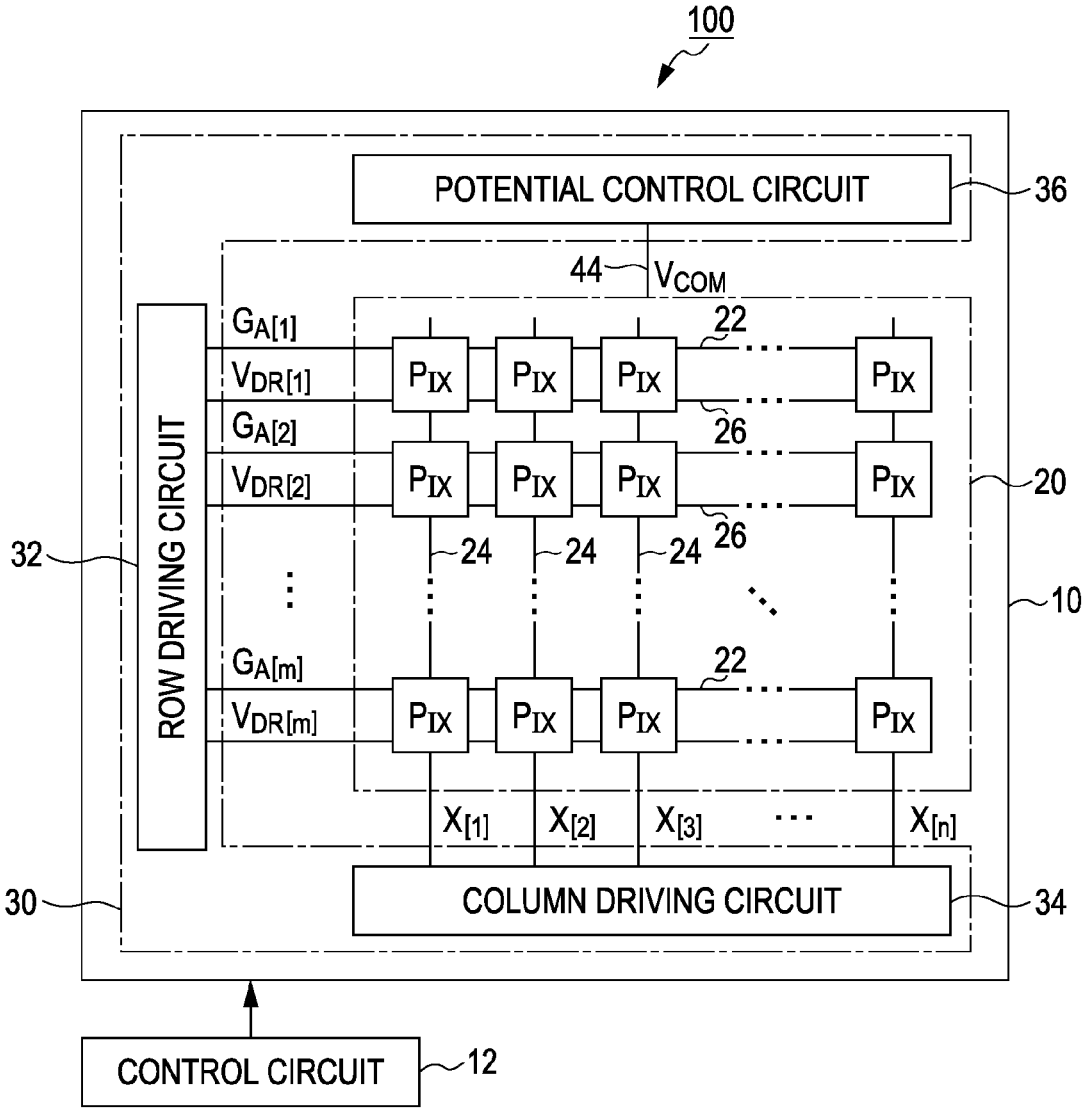
FIG. 1 is a block diagram of an electro-optical device according to a first embodiment.

FIG. 1 is a block diagram of an electro-optical device 100 according to a first embodiment. The electro-optical device 100 is an electrophoretic display device for displaying an image utilizing electrophoresis of charged particles and includes a display panel 10 and a control circuit 12 as shown in FIG. 1. The display panel 10 includes a display unit 20 in which a plurality of pixel circuits $P_{IX}$ is arranged on a plane and a driving circuit 30 for driving each pixel circuit $P_{IX}$. The control circuit 12 controls the display panel 10 (driving circuit 30) so as to display an image on the display unit 20.

In the display unit 20, M control lines 22 and N signal lines 24 are formed so as to intersect each other (M and N are natural integers). The plurality of pixel circuits $P_{IX}$ in the display unit 20 is arranged at positions corresponding to the intersection between the control lines 22 and the signal lines 24 in an M×N matrix. In the display unit 20, M driving potential lines 26 are formed in parallel to the control lines 22.

The driving circuit 30 drives the pixel circuits $P_{IX}$ under the control of the control circuit 12. As shown in FIG. 1, the driving circuit 30 includes a row driving circuit 32, a column driving circuit 34, and a potential control circuit 36. The row driving circuit 32 supplies control signals $G_{A[1]}$ to $G_{A[m]}$ to the control lines 22 and supplies driving potentials $V_{DR[1]}$ to $V_{DR[m]}$ to the driving potential lines 26. Each of the driving potentials $V_{DR[1]}$ to $V_{DR[m]}$ is set to a high-level potential $V_{DR_H}$ or a low-level potential $V_{DR_L}$ ($V_{DR_H}>V_{DR_L}$). In addition, a configuration in which a circuit for generating the control signals $G_{A[1]}$ to $G_{A[m]}$ and a circuit for generating the driving potentials $V_{DR[1]}$ to $V_{DR[m]}$ are separately mounted may be employed. The column driving circuit 34 supplies instruction signals $X_{[1]}$ to $X_{[N]}$ to the signal lines 24.

The potential control circuit 36 generates and outputs a common potential $V_{COM}$ commonly supplied to the pixel circuits $P_{IX}$. The common potential $V_{COM}$ is set to a high-level potential $V_{COM_H}$ or a low-level potential $V_{COM_L}$ ($V_{COM_H}>V_{COM_L}$). The high-level potential $V_{COM_H}$ of the common potential $V_{COM}$ and the high-level potential $V_{DR_H}$ of the driving potentials $V_{DR[1]}$ to $V_{DR[m]}$ are the same potential (for example, 15 V) and the low-level potential $V_{COM_L}$ of the common potential $V_{COM}$ and the low-level potential $V_{DR_L}$ of the driving potentials $V_{DR[1]}$ to $V_{DR[m]}$ are the same potential (for example, 0 V).

Figure 2:
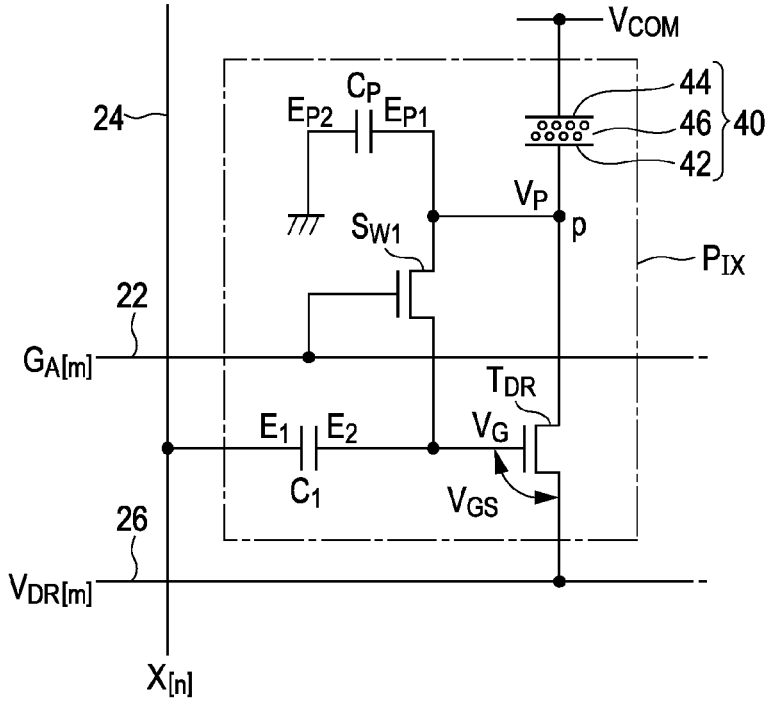
FIG. 2 is a circuit diagram of a pixel circuit of the first embodiment.

FIG. 2 is a circuit diagram of each pixel circuit $P_{IX}$. In FIG. 2, one pixel circuit $P_{IX}$ located on an m-th (m=1 to M) row and an n-th column (n=1 to N) is representatively shown. The pixel circuit $P_{IX}$ is an electronic circuit corresponding to each pixel of a display image and, as shown in FIG. 2, includes an electrophoretic element 40, a driving transistor $T_{DR}$, a switch $S_{W1}$, a capacitive element $C_1$, and an additional capacitive element $C_P$.

Figure 3:
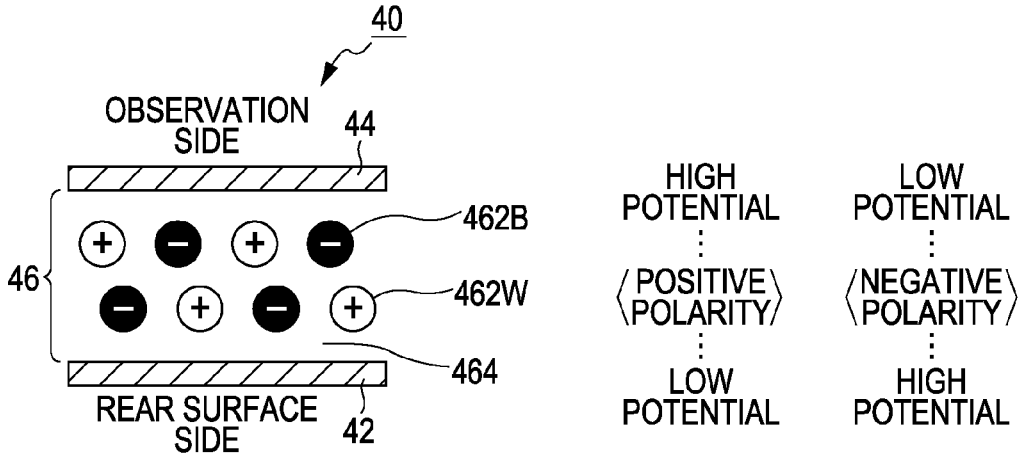
FIG. 3 is a schematic diagram of an electrophoretic element.

The electrophoretic element 40 is an electro-optical element having high resistance, which expresses a gradation using electrophoresis of charged particles, and includes a pixel electrode 42 and a counter electrode 44 facing each other and an electrophoretic layer 46 between both electrodes. As shown in FIG. 3, the electrophoretic layer 46 includes white and black charged particles 462 (462W and 462B) charged with opposite polarities and a dispersion medium 464 in which the charged particles 462 are electrophertically dispersed. For example, a configuration in which the charged particles 462 and the dispersion medium 464 are filled in a microcapsule or a configuration in which the charged particles 462 and the dispersion medium 464 are filled in a space partitioned by a partition wall is suitably employed.

The pixel electrode 42 is individually formed for each pixel circuit $P_{IX}$ and the counter electrode 44 is continuously formed over the plurality of pixel circuits $P_{IX}$. As shown in FIG. 2, the pixel electrode 42 is connected to a circuit point (node) p in the pixel circuit $P_{IX}$. The common potential $V_{COM}$ is supplied from the potential control circuit 36 to the counter electrode 44. In addition, hereinafter, a polarity of the voltage applied to the electrophoretic element 40 when the potential of the counter electrode 44 is higher than that of the pixel electrode 42 is conveniently referred to as a "positive polarity". As shown in FIG. 3, hereinafter, the case where the counter electrode 44 is located on an observation side (an output side of a display image) rather than the pixel electrode 42, the white charged particles 462W are charged with a positive polarity and the black charged particles 462B are charged with a negative polarity is conveniently described. Accordingly, the gradation of the electrophoretic element 40 is black when a voltage having a positive polarity is applied and is white when a voltage having a negative polarity is applied.

The driving transistor $T_{DR}$ of FIG. 2 is an N-channel type thin film transistor for driving the electrophoretic element 40 and is arranged on a path which connects the circuit point p (pixel electrode 42) and the driving potential line 26 of the m-th row. More specifically, the drain of the driving transistor $T_{DR}$ is connected to the circuit point p (pixel electrode 42) and the source of the driving transistor $T_{DR}$ is connected to the driving potential line 26. In addition, in the first embodiment, since the level of the voltages of the drain and the source of the driving transistor $T_{DR}$ may be reversed, if the drain and the source are distinguished in terms of the level of the voltage, the drain and the source of the driving transistor $T_{DR}$ are frequently reversed. However, in the following description, conveniently, the terminal (first terminal) of the driving potential line 26 side of the driving transistor $T_{DR}$ is referred to as the source and the terminal (second terminal) of the pixel electrode 42 side is referred to as the drain.

The switch $S_{W1}$ includes an N-channel type thin film transistor similarly to the driving transistor $T_{DR}$ and controls electrical connection (electrical connection/non-electrical connection) between the gate of the driving transistor $T_{DR}$ and the circuit point p (between the gate and the drain of the driving transistor $T_{DR}$). The gate of the switch $S_{W1}$ is connected to the control line 22 of the m-th row. When the switch $S_{W1}$ transitions to an on state, the gate and the drain of the driving transistor $T_{DR}$ are connected (that is, diode-connected).

The capacitive element $C_1$ is a capacitor including an electrode $E_1$ and an electrode $E_2$. The electrode $E_1$ is connected to the signal line 24 of the n-th column and the electrode $E_2$ is connected to the gate of the driving transistor $T_{DR}$. The additional capacitive element $C_P$ is a capacitor including an electrode $E_{P1}$ and an electrode $E_{P2}$. The electrode $E_{P1}$ is connected to the circuit point p and the electrode $E_{P2}$ is connected to ground GND. In addition, if a sufficient capacitive component pertains to the electrophoretic element 40, the capacitive component of the electrophoretic element 40 may be used as the additional capacitive element $C_P$.

Figure 4:
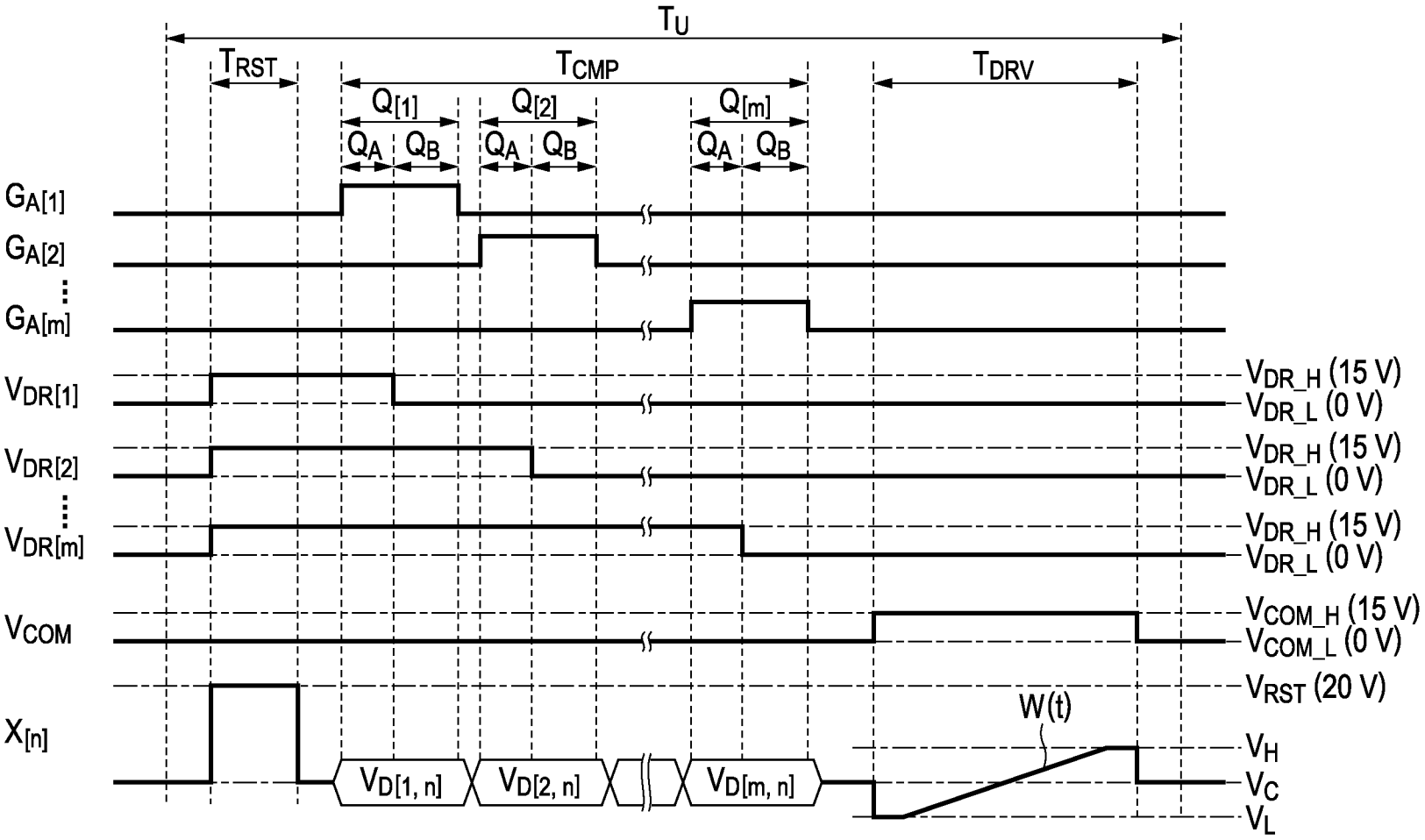
FIG. 4 is an explanatory diagram of an operation of the first embodiment.

FIG. 4 is an explanatory diagram of an operation of the electro-optical device 100. As shown in FIG. 4, the electro-optical device 100 sequentially operates using a unit period (frame) $T_U$ as a period. The unit period $T_U$ of the first embodiment includes an initialization period $T_{RST}$ as a "first period", a compensation period $T_{CMP}$, as a "second period" and a "third period", and an operation period $T_{DRV}$ as a "fourth period". In the initialization period $T_{RST}$, an initialization operation for initializing the potential $V_P$ of the circuit point p (pixel electrode 42) of each pixel circuit $P_{IX}$ is executed. The initialization operation is executed in parallel (concurrently) with respect to all (M×N) pixel circuits $P_{IX}$ in the display unit 20.

In the compensation period $T_{CMP}$, a compensation operation for setting a voltage $V_{GS}$ between the gate and the source of the driving transistor $T_{DR}$ of each pixel circuit $P_{IX}$ to a threshold voltage $V_{TH}$ of the driving transistor $T_{DR}$ and a writing operation for supplying a gradation potential $V_{D[m,n]}$ according to a designated gradation of the pixel circuit $P_{IX}$ to each pixel circuit $P_{IX}$ are executed. The compensation period $T_{CMP}$ is divided into M selection periods $Q_{[1]}$ to $Q_{[m]}$ corresponding to each row of the pixel circuit $P_{IX}$. In an m-th selection period $Q_{[m]}$ in the compensation period $T_{CMP}$, the compensation operation and the writing operation are executed with respect to N pixel circuits $P_{IX}$ of the m-th row.

In the operation period $T_{DRV}$, the gradation of the electrophoretic element 40 is variably controlled according to the gradation potential $V_{D[m,n]}$ supplied to each pixel circuit $P_{IX}$ in the compensation period $T_{CMP}$. More specifically, in a period of a time length according to the gradation potential $V_{D[m,n]}$ of the operation period $T_{DRV}$, the driving transistor $T_{DR}$ is controlled to an on state so as to execute a driving operation (pulse width modulation) for controlling the gradation of the electrophoretic element 40. The driving operation is executed in parallel (concurrently) with respect to all (M×N) pixel circuits $P_{IX}$ in the display unit 20.

Figure 5:
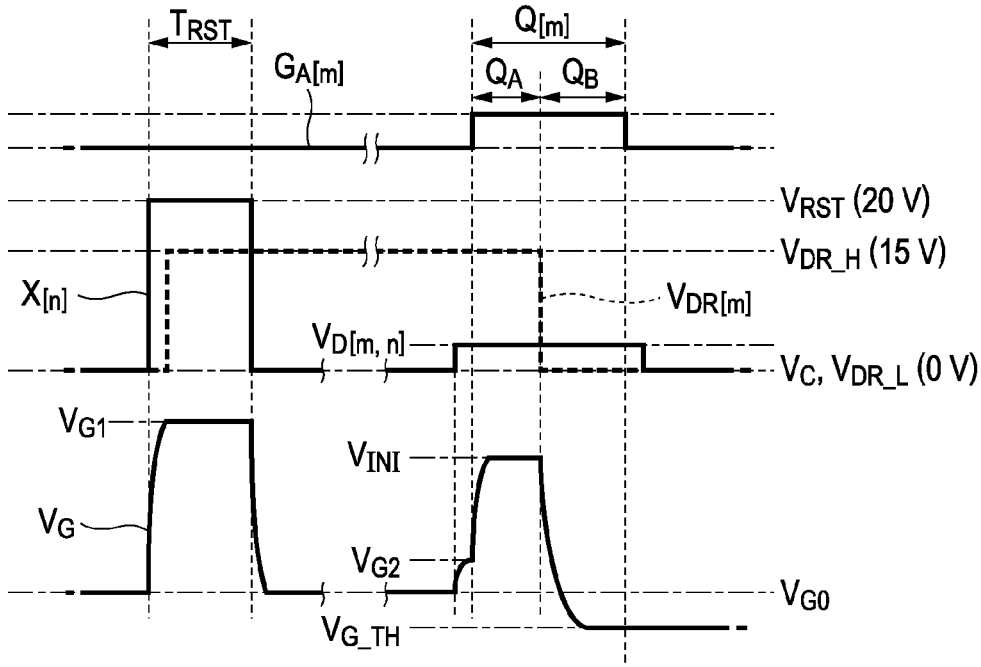
FIG. 5 is an explanatory diagram of an operation of an initialization period and a compensation period of the first embodiment.

FIG. 5 is an explanatory diagram of a potential $V_G$ of the gate of the driving transistor $T_{DR}$ of the pixel circuit $P_{IX}$ located at an m-th row and an n-th column. The operations of the above-described periods ($T_{RST}$, $T_{CMP}$, and $T_{DRV}$) will be described with reference to FIGS. 4 and 5. As shown in FIG. 5, it is assumed that, just before the initialization period $T_{RST}$, an instruction signal $X_{[n]}$ supplied to the electrode $E_1$ of the capacitive element $C_1$ is set to a predetermined potential (hereinafter, referred to as a "reference potential") $V_C$ and the potential $V_G$ of the gate of the driving transistor $T_{DR}$ is set to a potential $V_{G0}$.

1. Initialization Period $T_{RST}$

Figure 6:
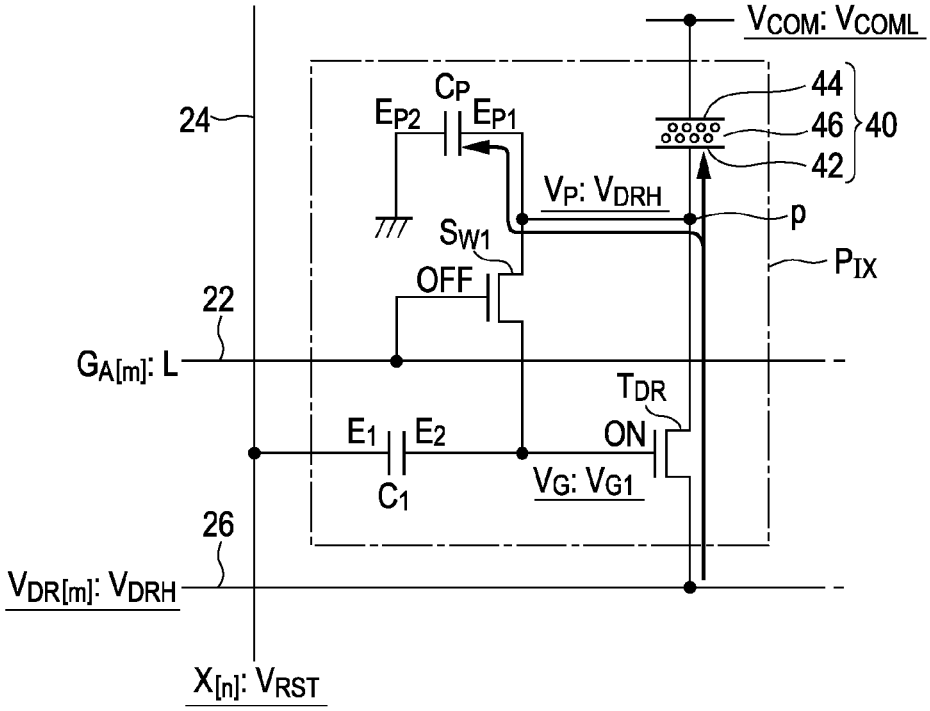
FIG. 6 is an explanatory diagram of a pixel circuit of the initialization period of the first embodiment.

When the initialization period $T_{RST}$ starts, the column driving circuit 34 changes the instruction signals $X_{[1]}$ to $X_{[N]}$ of the signal lines 24 from the reference potential $V_C$ to an initialization potential $V_{RST}$ as shown in FIGS. 4 and 6. Since the capacitive element $C_1$ is interposed between each signal line 24 and the gate of the driving transistor $T_{DR}$, the potential $V_G$ of the gate of the driving transistor $T_{DR}$ is changed in tandem with the potential of the instruction signal $X_{[n]}$ by capacitive coupling of the capacitive element $C_1$. If the capacitance of the gate of the driving transistor $T_{DR}$ is conveniently ignored, the potential $V_G$ is changed from the potential $V_{G0}$ just before the initialization period $T_{RST}$ to a high potential $V_{G1}$ ($V_{G1}=V_{G0}+(V_{RST}-V_C)$) by a change amount ($V_{RST}-V_C$) of the potential of the instruction signal $X_{[n]}$, as shown in FIG. 5. The row driving circuit 32 changes the driving potentials $V_{DR[1]}$ to $V_{DR[m]}$ of the driving potential lines 26 from a low-level potential $V_{DR_L}$ to a high-level potential $V_{DR_H}$. In addition, since the control signal $G_{A[m]}$ is held at a low level, the switch $S_{W1}$ is held at an off state in the initialization period $T_{RST}$.

The initialization potential $V_{RST}$ of the instruction signal $X_{[n]}$ is set such that the driving transistor $T_{DR}$ is held at an on state ($V_{GS}=V_{G1}=V_{DR_H}=V_{G0}+(V_{RST}-V_C)-V_{DR_H}>V_{TH}$) in a state in which the driving potential $V_{DR[m]}$ (the source potential of the driving transistor $T_{DR}$) is set to the high-level potential $V_{DR_H}$. As described above, in the initialization period $T_{RST}$, since the driving transistor $T_{DR}$ transitions to the on state, as denoted by an arrow of FIG. 6, the high-level potential $V_{DR_H}$ of the driving potential $V_{DR[m]}$ is supplied from the driving potential line 26 to the circuit point p (pixel electrode 42) through the source and the drain of the driving transistor $T_{DR}$. That is, the potential $V_P$ of the circuit point p is initialized to the high-level potential $V_{DR_H}$ (initialization operation).

In the initialization period $T_{RST}$, the potential control circuit 36 holds the common potential $V_{COM}$ of the counter electrode 44 at a low-level potential $V_{COM_L}$. Accordingly, a negative voltage (hereinafter, referred to as a "reverse bias") corresponding to a difference ($V_{DR_H}-V_{COM_L}$) between the high-level potential $V_{DR_H}$ of the driving potential $V_{DR[m]}$ supplied from the driving potential line 26 to the pixel electrode 42 and the low-level potential $V_{COM_L}$ of the counter electrode 44 is applied to the electrophoretic element 40. By applying the above-described reverse bias, the gradation of all the electrophoretic elements 40 in the display unit 20 transitions to a white side. In addition, the additional capacitive element $C_P$, of which the electrode $E_{P1}$ is connected to the circuit point p, is charged with charges according to the high-level potential $V_{DR_H}$ of the driving potential $V_{DR[m]}$. That is, the additional capacitive element $C_P$ holds the high-level potential $V_{DR_H}$.

Figure 7:
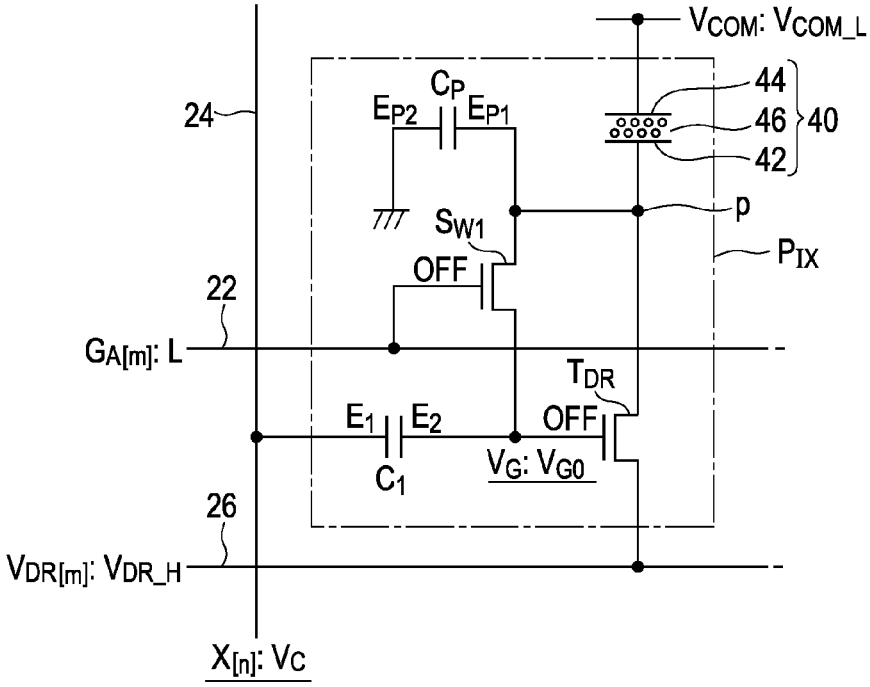
FIG. 7 is an explanatory diagram of the pixel circuit of an end point of the initialization period of the first embodiment.

When the initialization period $T_{RST}$ finishes, the column driving circuit 34 changes the instruction signals $X_{[1]}$ to $X_{[n]}$ of the signal lines 24 from the initialization potential $V_{RST}$ to the reference potential $V_C$, as shown in FIGS. 4 and 7. The potential $V_G$ of the gate of the driving transistor $T_{DR}$ is decreased from the preceding potential $V_{G1}$ ($V_{G1}=V_{G0}+(V_{RST}-V_C)$) by the change amount ($V_{RST}-V_C$) of the potential of the instruction signal $X_{[n]}$ and set to the preceding reference potential $V_{G0}$ in the initialization period $T_{RST}$. Accordingly, when the initialization period $T_{RST}$ finishes, the driving transistor $T_{DR}$ transitions to an off state and the supply of the high-level potential $V_{DR_H}$ to the circuit point p is stopped. The driving potential $V_{DR[m]}$ is continuously held at the high-level potential $V_{DR_H}$ even after the initialization period $T_{RST}$ finishes.

2. Compensation Period $T_{CMP}$

As shown in FIG. 4, each selection period $Q_{[m]}$ in the compensation period $T_{CMP}$ is divided into a compensation preparation period $Q_A$ as the "second period" and a compensation execution period $Q_B$ as the "third period". In the compensation preparation period $Q_A$, the potential $V_G$ of the gate of the driving transistor $T_{DR}$ is set to a predetermined potential (hereinafter, referred to as an "initial compensation value") $V_{INI}$ and, in the compensation execution period $Q_B$, the voltage $V_{GS}$ between the gate and the source of the driving transistor $T_{DR}$ is set to its threshold voltage $V_{TH}$. The common potential $V_{COM}$ of the counter electrode 44 is held at the low-level potential $V_{COM_L}$ even in the compensation period $T_{CMP}$.

Figure 8:
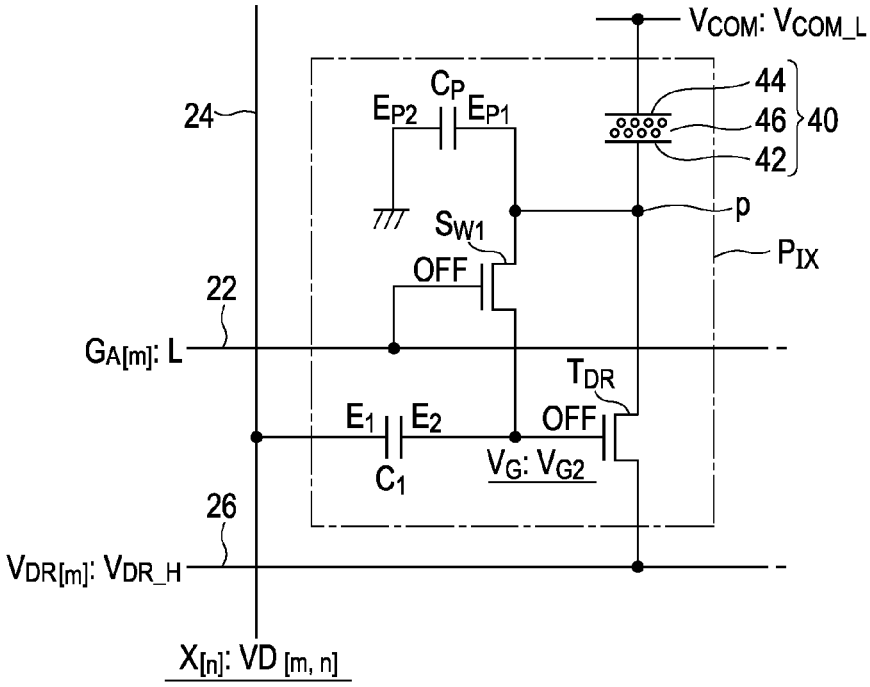
FIG. 8 is an explanatory diagram of the pixel circuit of a compensation preparation period (during a writing operation) of the first embodiment.

In the compensation preparation period $Q_A$ of the selection period $Q_{[m]}$, the column driving circuit 34 sets the instruction signal $X_{[n]}$ to the gradation potential $V_{D[m,n]}$ (writing operation), as shown in FIGS. 4 and 8. The gradation potential $V_{D[m,n]}$ is variably set according to the designated gradation of the pixel circuit $P_{IX}$ located at the m-th row and the n-th column. The potential $V_G$ of the gate of the driving transistor $T_{DR}$ is changed in tandem with the potential of the instruction signal $X_{[n]}$ by capacitive coupling of the capacitive element $C_1$. More specifically, the potential $V_G$ is changed to a high potential $V_{G2}$ ($V_{G2}=V_{G0}+(V_{D[m,n]}=V_C)$) by a change amount ($V_{D[m,n]}-V_C$) of the potential of the instruction signal $X_{[n]}$ as compared with the potential $V_{G0}$ just after the initialization period $T_{RST}$, as shown in FIG. 5.

Figure 9:
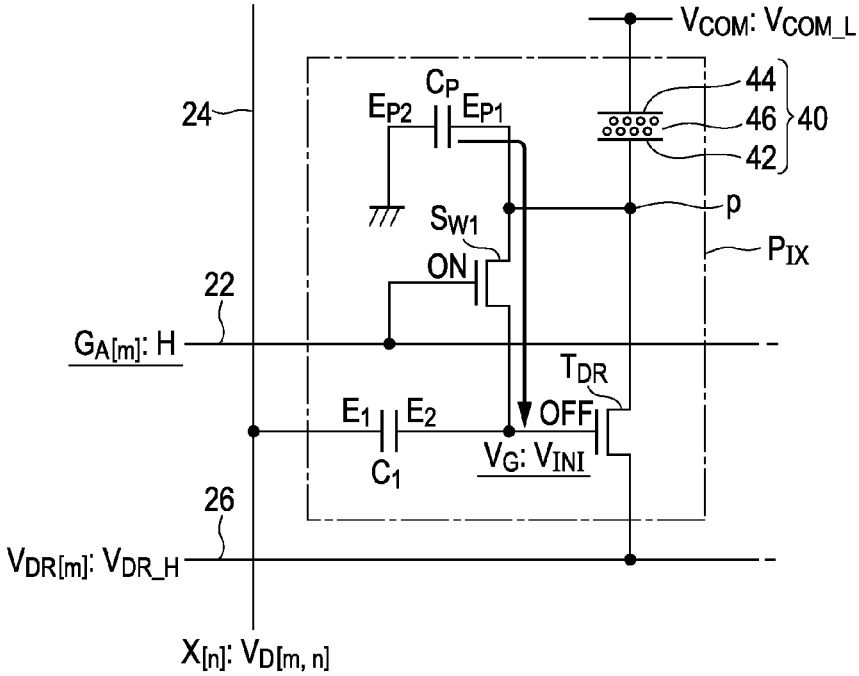
FIG. 9 is an explanatory diagram of the pixel circuit of a compensation preparation period (during setting of an initial compensation value) of the first embodiment.

The row driving circuit 32 sets a control signal $G_{A[m]}$ to a high level in the compensation preparation period $Q_A$ so as to control the switch $S_{W1}$ of the m-th row of each pixel circuit $P_{IX}$ to an on state, as shown in FIGS. 4 and 9. When the switch $S_{W1}$ transitions to the on state, as shown in FIG. 9, the additional capacitive element $C_P$ is connected to the electrode $E_2$ of the capacitive element $C_1$ (the gate of the driving transistor $T_{DR}$) such that the charges accumulated in the capacitive element $C_1$ in the initialization period $T_{RST}$ are moved to the gate (capacitive element $C_1$) of the driving transistor $T_{DR}$. Accordingly, the potential $V_G$ of the gate of the driving transistor $T_{DR}$ is changed to the initial compensation value $V_{INI}$ exceeding the preceding potential $V_{G2}$ (or the reference potential $V_C$), as shown in FIG. 5. More specifically, the initial compensation value $V_{INI}$ is expressed by the following Equation 1 including a capacitance value $c_1$ of the capacitive element $C_1$ and a capacitance value $c_P$ of the additional capacitive element $C_P$.

$$V_{INI}=\alpha p\cdot V_{DR_H}+(1-\alpha p)V_{G2}$$

$$(\alpha p=c_P/(c_P+c_1)) \quad (1)$$

Figure 10:
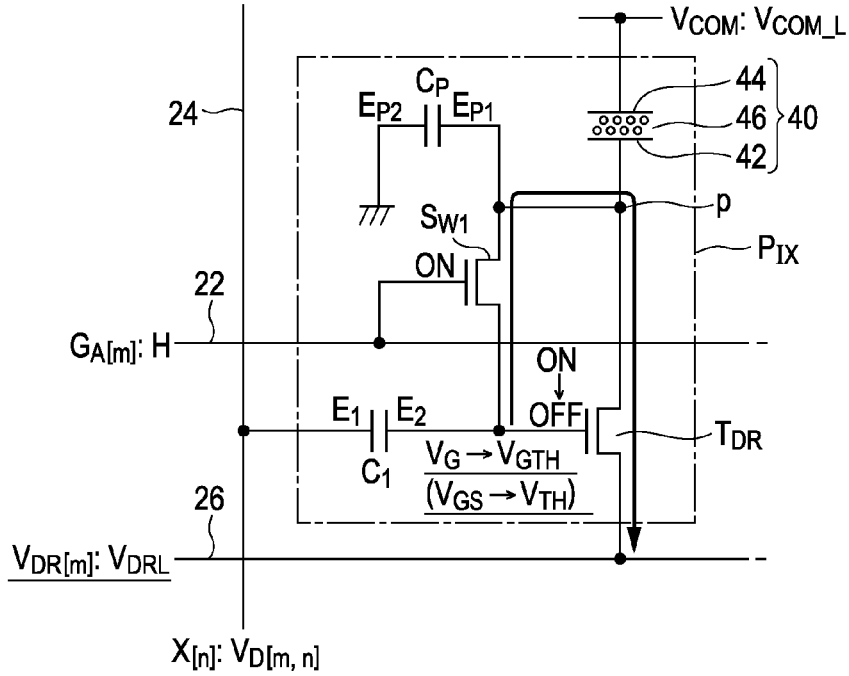
FIG. 10 is an explanatory diagram of the pixel circuit of a compensation execution period of the first embodiment.

In the compensation execution period $Q_B$, of the selection period $Q_{[m]}$, similar to the compensation preparation period $Q_A$, the instruction signal $X_{[n]}$ is held at the gradation potential $V_{D[m,n]}$ and the switch $S_{W1}$ is held in the on state by the control signal $G_{A[m]}$ of the high level. When the compensation execution period $Q_B$ starts, the row driving circuit 32 decreases the driving potential $V_{DR[m]}$ supplied to the source of the driving transistor $T_{DR}$ from the high-level potential $V_{DR_H}$ to the low-level potential $V_{DR_L}$, as shown in FIGS. 4 and 10. The high-level potential $V_{DR_H}$ and the low-level potential $V_{DR_L}$ of the driving potential $V_{DR[m]}$ is set such that a difference between the initial compensation value $V_{INI}$ of Equation 1 and the low-level potential $V_{DR_L}$ (that is, the voltage $V_{GS}$ between the gate and the source of the driving transistor $T_{DR}$) exceeds the threshold voltage $V_{TH}$. Accordingly, when the driving potential $V_{DR[m]}$ of a start point of the compensation execution period $Q_B$ is decreased to the low-level potential $V_{DR_L}$, the driving transistor $T_{DR}$ transitions to the on state. As can be understood from Equation 1, as the capacitance value $c_P$ of the additional capacitive element $C_P$ and the capacitance value $c_1$ of the capacitive element $C_1$ are increased (that is, a coefficient αp is increased) or as the high-level potential $V_{DR_H}$ supplied to the circuit point p in the initialization period $T_{RST}$ is higher than the potential $V_{G2}$, the initial compensation value $V_{INI}$ may be reliably set to a high potential for controlling the driving transistor $T_{DR}$ to the on state in the compensation execution period $Q_B$.

Even in the compensation execution period $Q_B$, since the on state of the switch $S_{W1}$ (diode connection of the driving transistor $T_{DR}$) is held, when the driving transistor $T_{DR}$ transitions to the on state, as denoted by an arrow in FIG. 10, the charges of the gate of the driving transistor $T_{DR}$ are discharged to the driving potential line 26 through the switch $S_{W1}$, the circuit point p and the drain and the source of the driving transistor $T_{DR}$. Accordingly, as shown in FIG. 5, the potential $V_G$ of the gate of the driving transistor $T_{DR}$ is decreased from the initial compensation value $V_{INI}$ with time and the driving transistor $T_{DR}$ transitions to the off state (compensation operation) at a time when the voltage $V_{GS}$ between the gate and the source reaches the threshold voltage $V_{TH}$.

Figure 11:
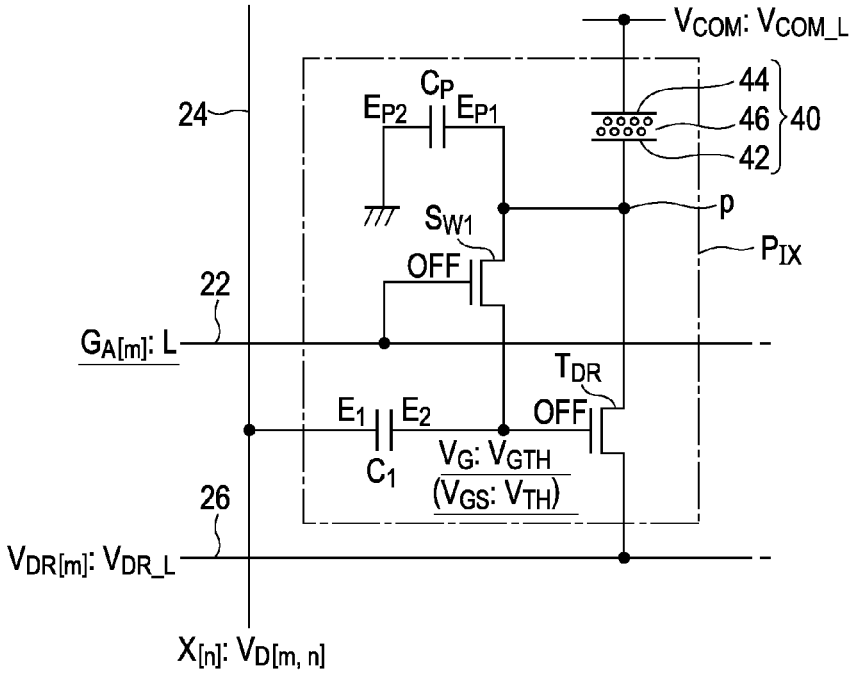
FIG. 11 is an explanatory diagram of the pixel circuit of an end point of the compensation execution period of the first embodiment.

When the compensation execution period $Q_B$ of the selection period $Q_{[m]}$ finishes, the row driving circuit 32 changes the control signal $G_{A[m]}$ to a low level so as to control the switch $S_{W1}$ of each pixel circuit $P_{IX}$ of the m-th row to the off state, as shown in FIGS. 4 and 11. That is, the diode connection of the driving transistor $T_{DR}$ is released. As can be understood from the above description, at an end point of the compensation execution period $Q_B$, in a state of supplying the gradation potential $V_{D[m,n]}$ to the electrode $E_1$ of the capacitive element $C_1$, the potential $V_G$ of the gate of the driving transistor $T_{DR}$ is set to a potential $V_{G_TH}$ (the voltage $V_{GS}$ between the gate and the source of the driving transistor $T_{DR}$ reaches the threshold voltage $V_{TH}$ ($V_{G_TH}-V_{DR_L}=V_{TH}$)).

The above operations are sequentially executed in the selection periods $Q_{[1]}$ to $Q_{[m]}$ of the compensation period $T_{CMP}$. In addition, since the capacitive element $C_1$ of each pixel circuit $P_{IX}$ is directly connected to the signal line 24, the instruction signal $X_{[n]}$ is changed to the gradation potential $V_{D[m,n]}$ in the selection period $Q_{[m]}$, the potential of the electrode $E_1$ of the capacitive element $C_1$ of the pixel circuit $P_{IX}$ of each row other than the m-th row is changed. The potential $V_G$ of the gate of the driving transistor $T_{DR}$ may be changed in tandem with the potential of the electrode $E_1$ and the driving transistor $T_{DR}$ may transition to the on state. However, since the common potential $V_{COM}$ of the counter electrode 44 is held at the low-level potential $V_{COM_L}$ within the compensation period $T_{CMP}$, transitioning the driving transistor $T_{DR}$ to the on state does not influence the gradation of the electrophoretic element 40.

3. Operation Period $T_{DRV}$

Figure 12:
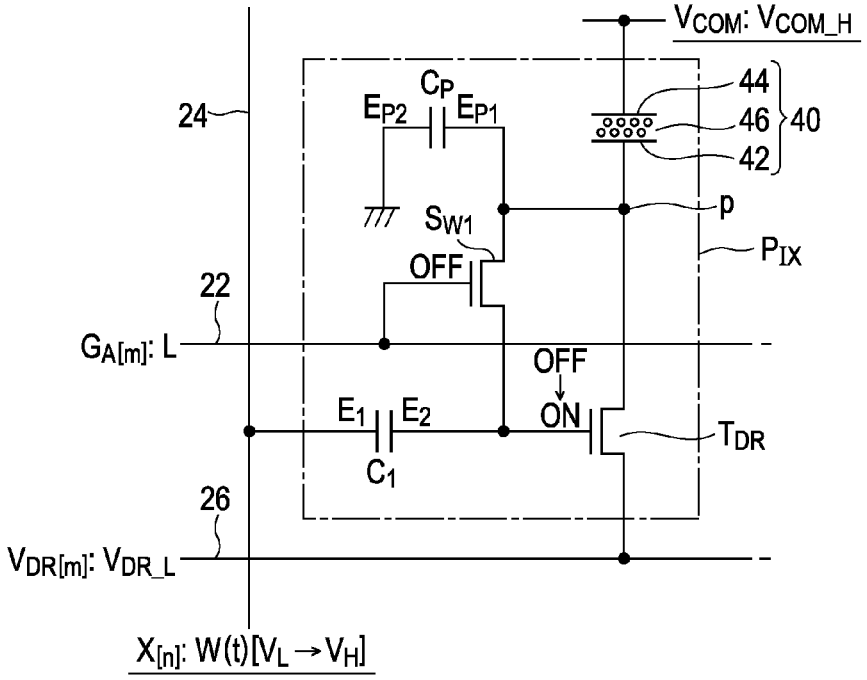
FIG. 12 is an explanatory diagram of the pixel circuit of an operation period of the first embodiment.

When the operation period $T_{DRV}$ after the elapse of the compensation period $T_{CMP}$ starts, the potential control circuit 36 sets the common potential $V_{COM}$ of the counter electrode 44 to the high-level potential $V_{COM_H}$, as shown in FIGS. 4 and 12. The row driving circuit 32 continuously holds the driving potentials $V_{DR[1]}$ to $V_{DR[m]}$ at the low-level potential $V_{DR_L}$ from the compensation execution period $Q_B$ of each selection period $Q_{[m]}$.

The column driving circuit 34 sets the instruction signals $X_{[1]}$ to $X_{[N]}$ to the potential W(t) in the operation period $T_{DRV}$, as shown in FIGS. 4 and 12. As shown in FIG. 4, the potential W(t) is changed with time between a potential $V_L$ and a potential $V_H$ ($V_H>V_L$) such that the reference potential $V_C$ is included in a fluctuation range (for example, using the reference potential $V_C$ as a central value). The potential W(t) of the present embodiment is controlled to a ramp waveform (a saw-like wave) linearly changed from the potential $V_L$ to the potential $V_H$ from the start point to the end point of the operation period $T_{DRV}$. Accordingly, in the driving transistor $T_{DR}$ of each pixel circuit $P_{IX}$, in a state in which the driving potential $V_{DR[m]}$ of the driving potential line 26 (the potential of the source) is held at the low-level potential $V_{DR_L}$, the potential $V_G$ of the gate is changed (increased) in tandem with the potential W(t) of the instruction signal $X_{[n]}$. That is, the voltage $V_{GS}$ between the gate and the source of the driving transistor $T_{DR}$ is increased with time in the operation period $T_{DRV}$.

In the compensation period $T_{CMP}$, in a state in which the gradation potential $V_{D[m,n]}$ is supplied to the electrode $E_1$ of the capacitive element $C_1$, the potential $V_G$ ($V_{G_TH}$) of the gate is set such that the voltage $V_{GS}$ between the gate and the source of the driving transistor $T_{DR}$ reaches the threshold voltage $V_{TH}$. Accordingly, in the operation period $T_{DRV}$, when the potential W(t) of the instruction signal $X_{[n]}$ reaches the gradation potential $V_{D[m,n]}$ of each pixel circuit $P_{IX}$, as shown in FIG. 12, the voltage $V_{GS}$ between the gate and the source of the driving transistor $T_{DR}$ of the pixel circuit $P_{IX}$ reaches its threshold voltage $V_{TH}$ and the driving transistor $T_{DR}$ transitions to the on state. That is, the driving transistor $T_{DR}$ of the pixel circuit $P_{IX}$ located at the m-th row and the n-th column transitions from the off state to the on state at a variable time according to the designated gradation (gradation potential $V_{D[m,n]}$) of the pixel circuit $P_{IX}$ in the operation period $T_{DRV}$. As can be understood from the above description, the pixel circuit $P_{IX}$ functions as a comparison circuit for comparing the gradation potential $V_{D[m,n]}$ with the potential W(t).

Figure 13:
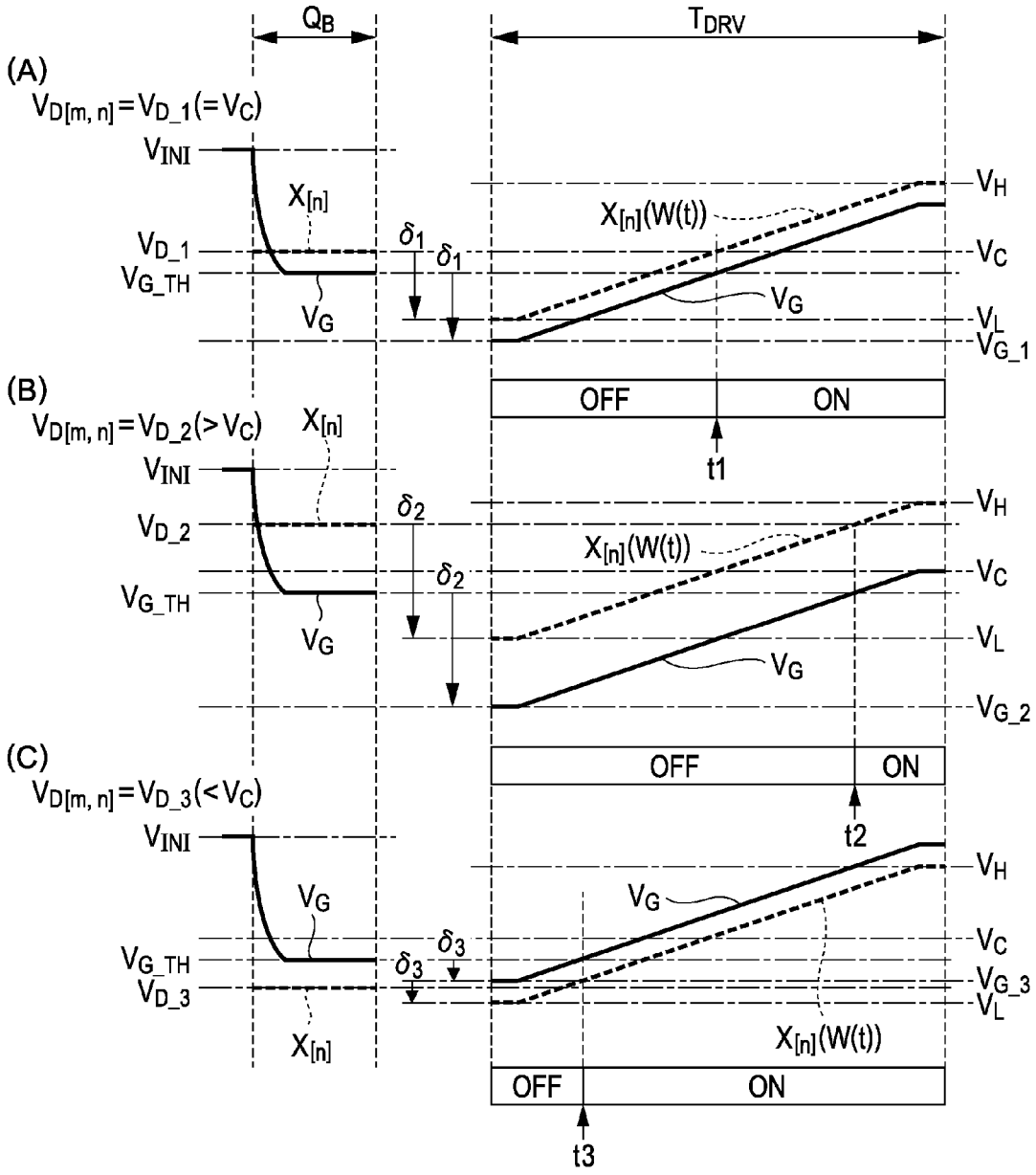
FIG. 13 is an explanatory diagram of a relationship between a driving time of a driving transistor and a gradation potential of the first embodiment.

FIG. 13 is a schematic diagram showing a state in which the times t1, t2 and t3 when the driving transistor $T_{DR}$ transitions from the off state to the on state in the operation period $T_{DRV}$ are changed according to the gradation potential $V_{D[m,n]}$. The change in potential of the instruction signal $X_{[n]}$ is denoted by a dotted line and the change in potential $V_G$ of the gate of the driving transistor $T_{DR}$ is denoted by a solid line.

In a part (A) of FIG. 13, the case where the gradation potential $V_{D[m,n]}$ is set to a potential $V_{D_1}$ in the compensation execution period $Q_B$ of the selection period $Q_{[m]}$ is considered. The potential $V_{D_1}$ is equal to the reference potential $V_C$ corresponding to the center of the amplitude of the potential W(t). If the potential W(t) of the instruction signal $X_{[n]}$ is changed to the potential $V_L$ at the start point of the operation period $T_{DRV}$, the potential $V_G$ of the gate of the driving transistor $T_{DR}$ is changed to the potential $V_{G_1}$ lower than a potential $V_{G_TH}$ set in the compensation period $T_{CMP}$ by a potential difference $\delta_1$ between the gradation potential $V_{D_1}$ and the potential $V_L$. The potential $V_G$ is increased with time in tandem with the potential W(t) from the potential $V_{G1}$ and the driving transistor $T_{DR}$ transitions from the off state to the on state at a time t1 when reaching the potential $V_{G_TH}$ (that is, a time when the potential W(t) reaches the gradation potential $V_{D_1}$).

In a part (B) of FIG. 13, the case where the gradation potential $V_{D[m,n]}$ is set to a potential $V_{D_2}$ higher than the reference potential $V_C$ ($V_{D_1}$) in the compensation execution period $Q_B$ is considered. Since a change amount $\delta_2$ in potential $V_G$ of the gate of the driving transistor $T_{DR}$ at the start point of the operation period $T_{DRV}$ is greater than the change amount $\delta_1$ of the part (A) of FIG. 13 by the gradation potential $V_{D_2}$, the potential $V_{G2}$ of the gate of the driving transistor $T_{DR}$ just after the start of the operation period $T_{DRV}$ is less than the potential $V_{G_1}$ of the part (A) of FIG. 13. Accordingly, the driving transistor $T_{DR}$ transitions to the on state at a time t2 later than the time t1 of the part (A) of FIG. 13.

In a part (C) of FIG. 13, the case where the gradation potential $V_{D[m,n]}$ is set to a potential $V_{D_3}$ lower than the reference potential $V_C$ ($V_{D_1}$) in the compensation execution period $Q_B$ is considered. Since a change amount $\delta_3$ in potential $V_G$ of the gate of the driving transistor $T_{DR}$ at the start point of the operation period $T_{DRV}$ is less than the change amount $\delta_1$ of the part (A) of FIG. 13 by the gradation potential $V_{D_3}$, the potential $V_{G_3}$ of the gate of the driving transistor $T_{DR}$ just after the start of the operation period $T_{DRV}$ exceeds the potential $V_{G_1}$ of the part (A) of FIG. 13. Accordingly, the driving transistor $T_{DR}$ transitions to the on state at a time t3 earlier than the time t1 of part (A) of FIG. 13.

Figure 14:
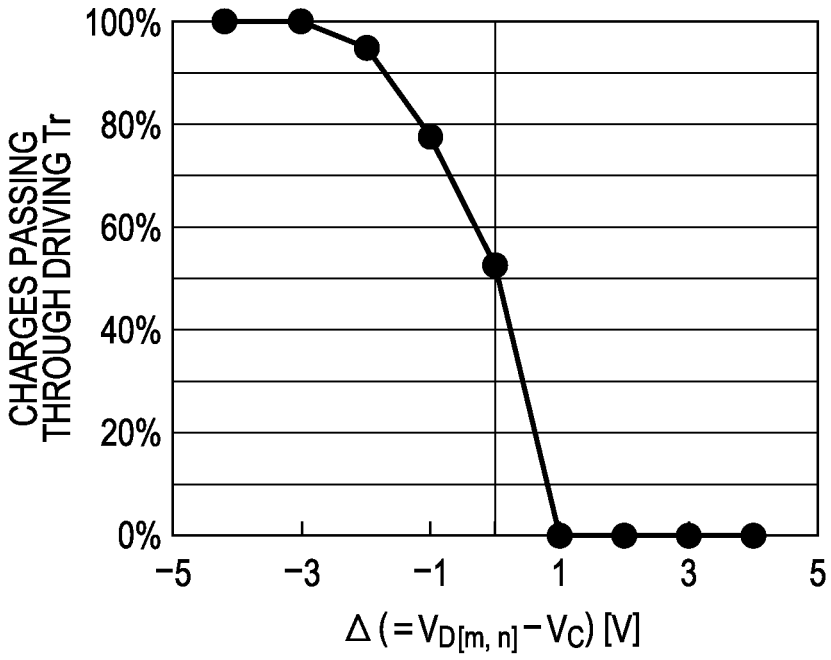
FIG. 14 is a graph of the gradation potential and the amount of charge passing through the driving transistor of the first embodiment.

FIG. 14 is a graph of a relationship (logical value) between a difference Δ ($\Delta=V_{D[m,n]}-V_C$) between the gradation potential $V_{D[m,n]}$ and the reference potential $V_C$ and a total amount of charges passing through the driving transistor $T_{DR}$ within the operation period $T_{DRV}$ (in other words, a ratio of a time when the driving transistor $T_{DR}$ transitions to the on state in the operation period $T_{DRV}$). A numerical value of a vertical axis is normalized by setting a maximum value to 100%. As can be understood from FIGS. 13 and 14, in the first embodiment, as the gradation potential $V_{D[m,n]}$ is increased (as the difference Δ with the reference potential $V_C$ is increased), the time in which the driving transistor $T_{DR}$ comes to be in the on state in the operation period $T_{DRV}$ (the amount of charges passing through the driving transistor $T_{DR}$) is decreased.

When the driving transistor $T_{DR}$ transitions to the on state at a time according to the gradation potential $V_{D[m,n]}$, since the low-level potential $V_{DR_L}$ of the driving potential $V_{DR[m]}$ is supplied from the driving potential line 26 to the pixel electrode 42 through the driving transistor $T_{DR}$, a positive voltage (hereinafter, referred to as a "forward bias") corresponding to a difference between the low-level potential $V_{DR_L}$ of the driving potential $V_{DR[m]}$ and the high-level potential $V_{COM_H}$ of the common potential $V_{COM}$ is applied to the electrophoretic element 40. Accordingly, black charged particles 462B of the electrophoretic element 40 are moved to the observation side and white charged particles 462W are moved to a rear surface side such that a display gradation transitions to a black side. When the operation period $T_{DRV}$ finishes, the potential control circuit 36 changes the common potential $V_{COM}$ to the low-level potential $V_{COM_L}$ ($V_{COM_L}=V_{DR_L}$). Accordingly, the application of the voltage to the electrophoretic element 40 is finished.

As described above, since the forward bias is applied to the electrophoretic element 40 with a variable time length according to the gradation potential $V_{D[m,n]}$ (pulse width modulation), the gradation of the electrophoretic element 40 of each pixel circuit $P_{IX}$ is controlled in multiple stages according to the gradation potential $V_{D[m,n]}$ of the pixel circuit $P_{IX}$. More specifically, as the gradation potential $V_{D[m,n]}$ is decreased (a time length in which the driving transistor $T_{DR}$ transitions to the on state within the operation period $T_{DRV}$ is increased), the gradation of the electrophoretic element 40 is controlled to a low gradation (gradation close to black). Accordingly, a multi-gradation image including a middle gradation is displayed on the display unit 20 in addition to white and black. In addition, a display image is changed by frequently repeating the unit period $T_U$.

In the above-described first embodiment, the driving transistor $T_{DR}$ transitions to the on state in the initialization period $T_{RST}$ such that the potential $V_P$ of the circuit point p is initialized to the high-level potential $V_{DR_H}$. Accordingly, when the driving transistor $T_{DR}$ is diode-connected in the compensation execution period $Q_B$, it is possible to enable current to reliably flow between the drain (gate) and the source (that is, the compensation operation is executed). That is, in spite of the configuration in which the electro-optical element (electrophoretic element 40) with high resistance is employed, it is possible to efficiently compensate for error of characteristics (threshold voltage $V_{TH}$) of the driving transistor $T_{DR}$ (further, it is possible to suppress gradation unevenness of a display image). By controlling the driving transistor $T_{DR}$ to the on state, since the high-level potential $V_{DR_H}$ is supplied to the circuit point p, an element dedicated to initialization (supply of high-level potential $V_{DR_H}$) of the potential $V_P$ of the circuit point p does not need to be mounted in the pixel circuit $P_{IX}$. Accordingly, it is possible to simplify the configuration of the pixel circuit $P_{IX}$.

However, in order to start the compensation operation in the compensation execution period $Q_B$, the potential (driving potential $V_{DR[m]}$) of the source of the driving transistor $T_{DR}$ needs to be lowered as compared to the potential $V_G$ of the gate such that the voltage $V_{GS}$ between the gate and the source of the driving transistor $T_{DR}$ exceeds the threshold voltage $V_{TH}$. In the first embodiment, since the potential $V_G$ ($V_{G2}$) of the gate of the driving transistor $T_{DR}$ is increased to the initial compensation value $V_{INI}$ by connecting the additional capacitive element $C_P$ and the capacitive element $C_1$ in the compensation preparation period $Q_A$, it is possible to relax the conditions necessary for the low-level potential $V_{DR_L}$ of the driving potential $V_{DR[m]}$ as compared to the configuration (hereinafter, referred to as a "comparison example") in which the potential $V_G$ is not increased in the compensation preparation period $Q_A$.

For example, on the assumption that the threshold voltage $V_{TH}$ is 1 V, the comparison example of starting the compensation operation in a state in which the potential $V_G$ of the gate of the driving transistor $T_{DR}$ is set to the potential $V_{G2}$ of FIG. 8 (that is, the configuration in which the compensation preparation period $Q_A$ of FIG. 9 is omitted) is considered. In the case where the potential $V_{G2}$ is −3 V, in order to realize the compensation operation in the comparison example, the low-level potential $V_{DR_L}$ of the driving potential $V_{DR[m]}$ needs to be set to −4 V. In the first embodiment, since the potential $V_G$ is increased to, for example, the initial compensation value $V_{INI}$ of 3 V by connecting the additional capacitive element $C_P$ to the gate of the driving transistor $T_{DR}$ in the compensation preparation period $Q_A$, the low-level potential $V_{DR_L}$ of the driving potential $V_{DR[m]}$ is set to 2 V or less. That is, since the conditions necessary for the low-level potential $V_{DR_L}$ of the driving potential $V_{DR[m]}$ are relaxed, as in the first embodiment, it is possible to set the potentials ($V_{DR_H}$, $V_{DR_L}$) of the driving potential $V_{DR[m]}$ to the same potential as the potentials ($V_{COM_H}$, $V_{COM_L}$) of the common potential $V_{COM}$. As described above, it is possible to simplify the configuration for generating the potentials by commonly using the potentials (reducing the number of kinds of potentials). In addition, for the compensation operation of the compensation execution period $Q_B$, the driving transistor $T_{DR}$ is diode-connected in the compensation preparation period $Q_A$ such that the additional capacitive element $C_P$ and the capacitive element $C_1$ are connected so as to increase the potential $V_G$. That is, the initial compensation value $V_{INI}$ is set along with the diode connection of the driving transistor $T_{DR}$. Accordingly, for example, it is possible to simplify the configuration of the pixel circuit $P_{IX}$ as compared to a configuration in which a dedicated element for increasing the potential $V_G$ before the compensation operation is specially mounted.

However, in the configuration in which a voltage (DC component) of one polarity is continuously applied to the electrophoretic element 40, the characteristics of the electrophoretic element 40 may deteriorate. In the first embodiment, the application and the stoppage of the forward bias to the electrophoretic element 40 are selectively executed in the operation period $T_{DRV}$ (that is, the negative voltage is not applied to the electrophoretic element 40 in the operation period $T_{DRV}$), the reverse bias of the polarity opposite to the polarity of the voltage applied in the operation period $T_{DRV}$ is applied to the electrophoretic element 40 in the initialization period $T_{RST}$. Accordingly, it is possible to suppress deterioration of the electrophoretic element 40 due to the application of the DC component, as compared to the configuration in which the reverse bias is not applied. In addition, in order to realize the compensation operation, since the high-level potential $V_{DR_H}$ supplied to the circuit point p in the initialization period $T_{RST}$ is used for applying the reverse bias to the electrophoretic element 40, it is possible to simplify the configuration of the pixel circuit $P_{IX}$ as compared to the configuration in which the element dedicated to the application of the reverse bias is mounted in the pixel circuit $P_{IX}$.

B: Second Embodiment

Next, a second embodiment of the invention will be described. The elements having the same operations or functions as the first embodiment are denoted by reference numerals used in the above description and the description thereof will be properly omitted.

In the first embodiment, the charges accumulated in the additional capacitive element $C_P$ in the initialization period $T_{RST}$ are supplied to the gate of the driving transistor $T_{DR}$ in the compensation preparation period $Q_A$ such that the potential $V_G$ is set to the initial compensation value $V_{INI}$ (the potential higher than the potential $V_{G0}$). The second embodiment is different from the first embodiment in a method of setting (boosting) the potential $V_G$ of the gate of the driving transistor $T_{DR}$ in the compensation preparation period $Q_A$ to the initial compensation value $V_{INI}$. The configuration of the pixel circuit $P_{IX}$ is equal to that of the first embodiment.

Figure 15:
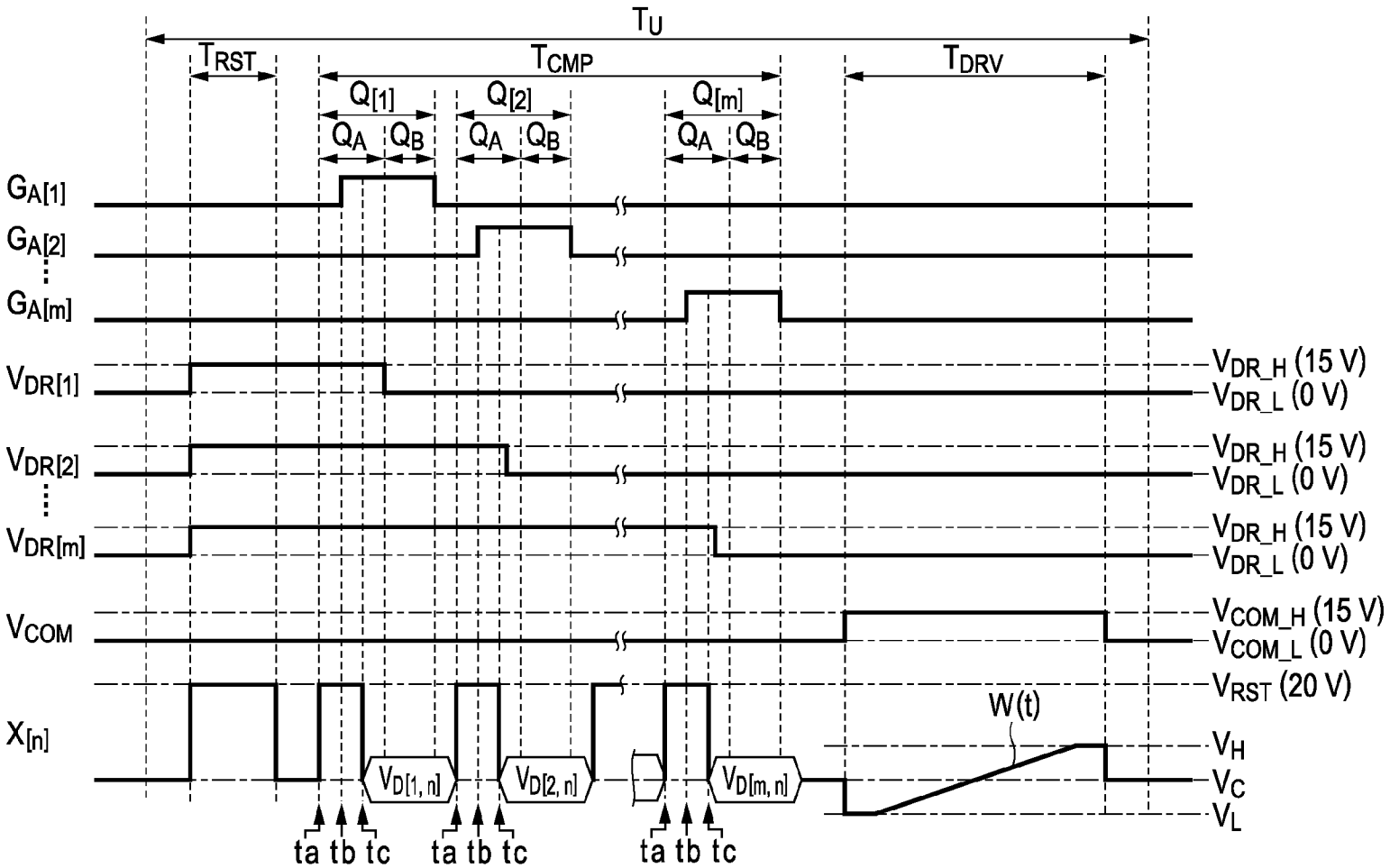
FIG. 15 is an explanatory diagram of an operation of a second embodiment.

FIG. 15 is an explanatory diagram of an operation within a unit period $T_U$ of the second embodiment. As can be understood from FIG. 15, the operations of the periods (the initialization period $T_{RST}$, the compensation execution period $Q_B$, the operation period $T_{DRV}$) other than the compensation preparation period $Q_A$ are equal to those of the first embodiment. Hereinafter, only the operation of the compensation preparation period $Q_A$ within the selection period $Q_{[m]}$ will be described.

Figure 16:
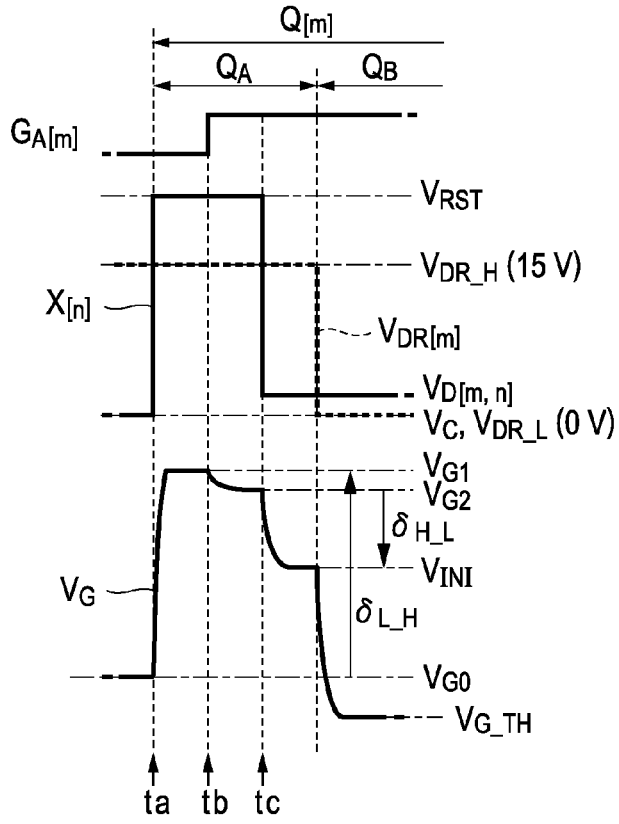
FIG. 16 is an explanatory diagram of a potential of a gate of a driving transistor of the second embodiment.

FIG. 16 is an explanatory diagram of the operation within the selection period $Q_{[m]}$. As shown in FIGS. 15 and 16, the column driving circuit 34 increases the instruction signal $X_{[n]}$ from the reference potential $V_C$ to the initialization potential $V_{RST}$ at a time ta of the compensation preparation period $Q_A$ of the selection period $Q_{[m]}$. The potential $V_G$ of the gate of the driving transistor $T_{DR}$ is increased from the potential $V_{G0}$ to the potential $V_{G1}$ in tandem with the change in the instruction signal $X_{[n]}$ at the time ta. At the time ta, the control signal $G_{A[m]}$ is set to a low level such that the switch $S_{W1}$ is held in the off state. That is, the additional capacitive element $C_P$ is electrically insulated from the gate (capacitive element $C_1$) amount $\delta_{L_H}$ ($V_{G1}=V_{G0}+\delta_{L_H}$) of the potential $V_G$ is equal to the change amount ($V_{RST}-V_C$) of the potential of the instruction signal $X_{[n]}$.

In a time tb within the compensation preparation period $Q_A$, the row driving circuit 32 changes the control signal $G_{A[m]}$ to the high level such that the switch $S_{W1}$ of each pixel circuit $P_{IX}$ of the m-th row transitions to the on state. Accordingly, the driving transistor $T_{DR}$ is diode-connected and the additional capacitive element $C_P$ is connected to the gate of the driving transistor $T_{DR}$. Since the potential $V_G$ of the gate is increased to the potential $V_{G1}$ at a time to such that the driving transistor $T_{DR}$ transitions to the on state, if the potential $V_G$ of the gate of the driving transistor $T_{DR}$ decreases with time after the time tb and reaches the potential $V_{G2}$ ($V_{G2}-V_{DR_H}+V_{TH}$) in which the voltage $V_{GS}$ between the gate and the source of the driving transistor $T_{DR}$ reaches the threshold voltage $V_{TH}$, the driving transistor $T_{DR}$ transitions to the off state.

When a time tc after the elapse of the time tb is reached, the column driving circuit 34 decreases the instruction signal $X_{[n]}$ from the initialization potential $V_{RST}$ to the gradation potential $V_{D[m,n]}$. The potential $V_G$ of the gate of the driving transistor $T_{DR}$ decreases the potential $V_{G2}$ to the initial compensation value $V_{INI}$ in tandem with the change in the potential of the instruction signal $X_{[n]}$. At the time tc, the additional capacitive element $C_P$ is connected to the gate of the driving transistor $T_{DR}$ through the switch $S_{W1}$ of the on state. Accordingly, the decrease amount $\delta_{H_L}$ ($V_{INI}=V_{G2}-\delta_{H_L}$) just after the time tc becomes a voltage ($\delta_{H_L}=\alpha 1$ ($V_{RST}-V_{D[m,n]}$), $\alpha 1=c_1/(c_1+c_P)$) obtained by dividing the change amount ($V_{RST}-V_{D[m,n]}$) of the potential of the instruction signal $X_{[n]}$ according to the capacitance value $c_1$ of the capacitive element $C_1$ and the capacitance value $c_P$ of the additional capacitive element $C_P$. That is, the change amount $\delta_{H_L}$ of the potential $V_G$ at the time tc is less than the change amount $\delta_{L_H}$ of the potential $V_G$ at the time ta. Using the above-described difference between the change amount $\delta_{H_L}$ and the change amount $\delta_{L_H}$, the initial compensation value $V_{INI}$ is set to a potential exceeding the potential $V_{G0}$ of the gate before the start of the initialization period $T_{RST}$, similarly to the first embodiment. In the compensation execution period $Q_B$ after the elapse of the compensation preparation period $Q_A$, similarly to the first embodiment, the driving potential $V_{DR[m]}$ is changed to the low-level potential $V_{DR_L}$ so as to execute the compensation operation.

Even in the second embodiment, the same effects as the first embodiment are realized. In the second embodiment, since the difference between the change amount $\delta_{H_L}$ and the change amount $\delta_{L_H}$ of the potential $V_G$ of the gate of the driving transistor $T_{DR}$ is used to set the initial compensation value $V_{INI}$, it is possible to set the initial compensation value $V_{INI}$ to a high potential even when the charges accumulated in the additional capacitive element $C_P$ are less. Accordingly, as compared to the first embodiment in which the charges of the additional capacitive element $C_P$ are used to set the initial compensation value $V_{INI}$, the high-level potential $V_{DR_H}$ for charging the additional capacitive element $C_P$ in the initialization period $T_{RST}$ may be a low potential. While the instruction signal $X_{[n]}$ needs to be increased to the initialization potential $V_{RST}$ in the compensation preparation period $Q_A$ of each selection period $Q_{[m]}$ in the second embodiment, the instruction signal $X_{[n]}$ does not need to be changed to the initialization potential $V_{RST}$ in the compensation preparation period $Q_A$ in the first embodiment. Accordingly, according to the first embodiment, the number of times of potential change of the instruction signal $X_{[n]}$ is reduced as compared to the first embodiment, power consumed when charging or discharging the signal line 24 is reduced.

C: Third Embodiment

Figure 17:
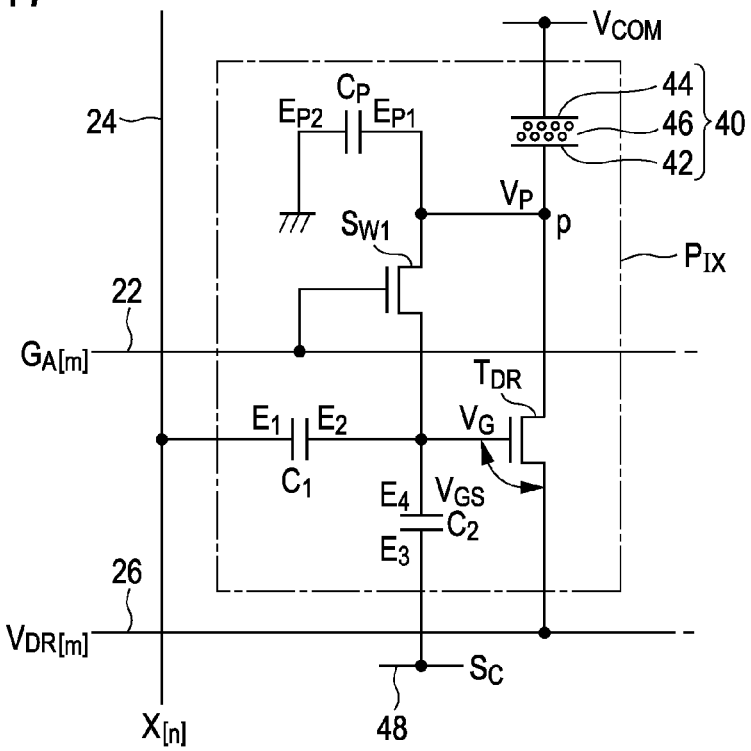
FIG. 17 is a circuit diagram of a pixel circuit of a third embodiment.

FIG. 17 is a circuit diagram of a pixel circuit $P_{IX}$ according to a third embodiment of the invention. As shown in FIG. 17, the pixel circuit $P_{IX}$ of the third embodiment has a configuration in which a capacitive element $C_2$ is added to the pixel circuit $P_{IX}$ of the first embodiment. The capacitive element $C_2$ is a capacitor including an electrode $E_3$ and an electrode $E_4$. The electrode $E_3$ is connected to a capacitive line 48 and the electrode $E_4$ is connected to the gate of the driving transistor $T_{DR}$. The capacitive line 48 is a wire commonly connected to all the pixel circuit $P_{IX}$ in the display unit 20. The potential control circuit 36 generates and supplies a capacitive potential $S_C$ to the capacitive line 48.

In the first embodiment, the instruction signal $X_{[n]}$ is set to the initialization potential $V_{RST}$ in the initialization period $T_{RST}$ so as to execute the initialization operation and the instruction signal $X_{[n]}$ is set to the variable potential W(t) in the operation period $T_{DRV}$ so as to execute the driving operation. In the third embodiment, the initialization operation and the driving operation are realized using the capacitive potential $S_C$, instead of the instruction signal $X_{[n]}$. In addition, the same method of the second embodiment (the method of using the difference between the increase amount $\delta_{L_H}$ and the decrease amount $\delta_{H_L}$ of the potential $V_G$) is employed in the setting of the initial compensation value $V_{INI}$ of the compensation preparation period $Q_A$.

Figure 18:
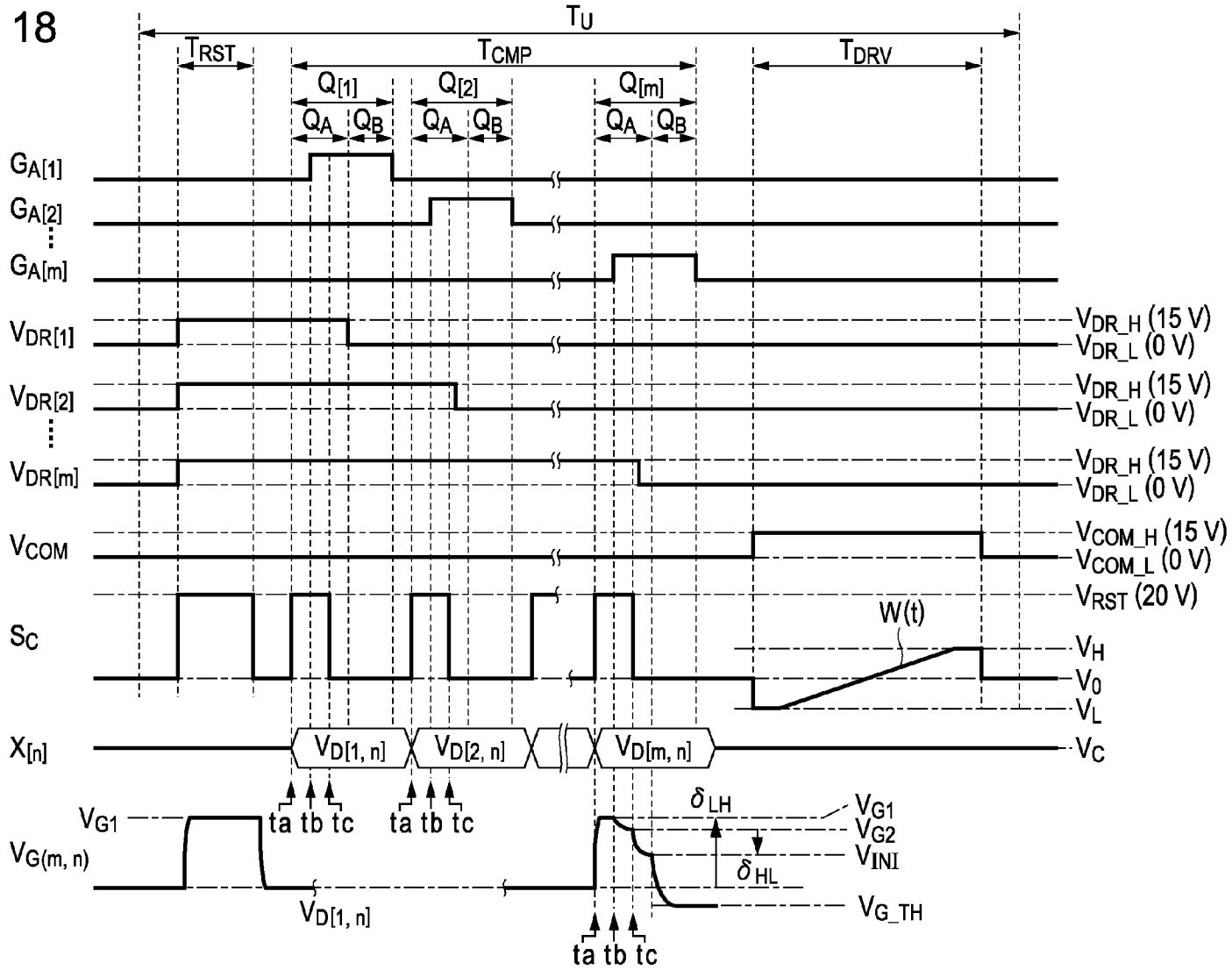
FIG. 18 is an explanatory diagram of an operation of the third embodiment.

FIG. 18 is an explanatory diagram of the operation in the unit period $T_U$ of the third embodiment. Similarly to the first embodiment, the initialization operation is executed in parallel with respect to the pixel circuits $P_{IX}$ in the initialization period $T_{RST}$, the writing operation and the compensation operation are sequentially executed in row units in the compensation period $T_{CMP}$, and the driving operation is executed in parallel with respect to the pixel circuits $P_{IX}$ in the operation period $T_{DRV}$.

1. Initialization Period $T_{RST}$

In the initialization period $T_{RST}$, as shown in FIG. 18, the control signals $G_{A[1]}$ to $G_{A[m]}$ are set to the low level such that the switch $S_{W1}$ of each pixel circuit $P_{IX}$ is held in the off state, and the common potential $V_{COM}$ of the counter electrode 44 is set to the low-level potential $V_{COM_L}$. The column driving signal 34 holds the instruction signal $X_{[n]}$ to the reference potential $V_C$.

When the initialization period $T_{RST}$ starts, the potential control circuit 36 changes the capacitive potential $S_C$ of the capacitive line 48 from the potential $V_0$ to the initialization potential $V_{RST}$. The potential $V_0$ is set to, for example, the same potential (for example, a ground potential (0 V)) as the reference potential $V_C$. Since the capacitive element $C_2$ is interposed between the capacitive line 48 and the gate of the driving transistor $T_{DR}$, the potential $V_G$ of the gate of the driving transistor $T_{DR}$ is changed from the potential $V_{G0}$ to the potential $V_{G2}$ in tandem with the capacitive potential $S_C$ by capacitive coupling of the capacitive element $C_2$. The change amount $\delta_{L_H}$ ($V_{G2}=V_{G0}+\delta_{L_H}$) of the potential $V_G$ in tandem with the capacitive potential $S_C$ becomes a voltage ($\delta_{L_H}=\beta 2(V_{RST}-V_0)$, $\beta 2=c_2/(c_1+c_2)$) obtained by dividing the change amount ($V_{RST}-V_0$) of the capacitive potential $S_C$ according to the capacitance value $c_1$ of the capacitive element $C_1$ and the capacitance value $c_2$ of the capacitive element $C_2$.

The row driving circuit 32 sets the driving potentials $V_{DR[1]}$ to $V_{DR[m]}$ of the driving potential lines 26 to the high-level potential $V_{DR_H}$ in the initialization period $T_{RST}$. The initialization potential $V_{RST}$ of the capacitive potential $S_C$ is set such that the driving transistor $T_{DR}$ is held in an on state ($V_{GS}=V_{G1}=V_{DR_H}>V_{TH}$) in a state in which the driving potential $V_{DR[m]}$ is set to the high-level potential $V_{DR_H}$ (for example, $V_{RST}$=25 V). As described above, in the initialization period $T_{RST}$, since the driving transistor $T_{DR}$ is controlled to the on state, similarly to the first embodiment, the potential $V_P$ of the circuit point p is initialized to the high-level potential $V_{DR_H}$ supplied from the driving potential line 26 through the driving transistor $T_{DR}$ (initialization operation). Accordingly, the reverse bias is applied to the electrophoretic element 40 and the high-level potential $V_{DR_H}$ is held in the additional capacitive element $C_P$. When the initialization period $T_{RST}$ finishes, the capacitive potential $S_C$ is set to the potential $V_0$ just before the initialization period $T_{RST}$ and the driving transistor $T_{DR}$ transitions to the off state. Accordingly, the supply of the high-level potential $V_{DR_H}$ to the circuit point p is stopped.

2. Compensation Period $T_{CMP}$

In the selection period $Q_{[m]}$ ($Q_A$, $Q_B$) of the compensation period $T_{CMP}$, the column driving circuit 34 sets the instruction signal $X_{[n]}$ to the gradation potential $V_{D[m,n]}$. The potential control circuit 36 increases the capacitive potential $S_C$ to the initialization potential $V_{RST}$ at the time ta of the compensation preparation period $Q_A$. Accordingly, the potential $V_G$ of the gate of the driving transistor $T_{DR}$ is increased to the potential $V_{G1}$ in tandem with the change in the capacitive potential $S_C$. At the time ta, since the switch $S_{W1}$ is held in the off state such that the capacitive element $C_P$ is electrically insulated from the gate of the driving transistor $T_{DR}$, the change $\delta_{L_H}$ of the potential $V_G$ at the time ta becomes a voltage ($\delta_{L_H}=\beta 2(V_{RST}-V_0)$) obtained by dividing the change amount ($V_{RST}-V_0$) in the potential of the capacitive potential $S_C$ by the capacitive element $C_1$ and the capacitive element $C_2$, similarly to the change of the initialization period $T_{RST}$.

At the time tb of the compensation preparation period $Q_A$ in the selection period $Q_{[m]}$, the row driving circuit 32 changes the control signal $G_{A[m]}$ to the high level so as to control the switch $S_{W1}$ of each pixel circuit $P_{IX}$ of the m-th row to the on state. Accordingly, similarly to the second embodiment, the potential $V_G$ of the gate of the driving transistor $T_{DR}$ is decreased to a potential $V_{G2}$ ($V_{G2}=V_{DR_H}+V_{TH}$) in which the voltage $V_{GS}$ between the gate and the source becomes the threshold voltage $V_{TH}$.

When a time tc after the elapse of the time tb is reached, the potential control circuit 36 decreases the capacitive potential $S_C$ from the initialization potential $V_{RST}$ to the potential $V_0$. The potential $V_G$ of the gate of the driving transistor $T_{DR}$ is decreased from the potential $V_{G2}$ to the initial compensation value $V_{INI}$ in tandem with the change in the capacitive potential $S_C$. At the time tc, since the additional capacitive element $C_P$ is connected to the gate of the driving transistor $T_{DR}$, the change $\delta_{H_L}$ ($V_{INI}=V_{G2}-\delta_{H_L}$) of the potential $V_G$ at the time tc becomes a voltage ($\delta_{H_L}=\gamma 2\ (V_{RST}-V_0)$, $\gamma 2=c_2/(c_1+c_2+c_P)$) obtained by dividing the change ($V_{RST}-V_0$) of the capacitive potential $S_C$ by the capacitive element $C_1$, the capacitive element $C_2$ and the additional capacitive element $C_P$. That is, the change $\delta_{H_L}$ of the potential $V_G$ at the time tc is less than the change $\delta_{L_H}$ of the potential $V_G$ at the time ta. Using the above-described difference between the change $\delta_{H_L}$ and the change $\delta_{L_H}$, the initial compensation value $V_{INI}$ is set to a potential exceeding the potential $V_{G0}$ of the gate before the start of the initialization period $T_{RST}$, similarly to the first embodiment.

In the compensation execution period $Q_B$ after the elapse of the compensation preparation period $Q_A$ in the selection period $Q_{[m]}$, the driving potential $V_{DR[m]}$ is changed to the low-level potential $V_{DR_L}$ so as to execute the compensation operation. That is, similarly to the first embodiment or the second embodiment, at the end point of the compensation execution period $Q_B$, in a state in which the gradation potential $V_{D[m,n]}$ is supplied to the electrode $E_1$ of the capacitive element $C_1$, the potential $V_G$ of the gate of the driving transistor $T_{DR}$ is set to a potential $V_{G_TH}$ ($V_{G_TH}-V_{DR_L}=V_{TH}$)).

3. Operation Period $T_{DRV}$

In the operation period $T_{DRV}$, in a state in which the instruction signals $X_{[1]}$ to $X_{[N]}$ of the signal lines 24 are held at the reference potential $V_C$ and the driving potentials $V_{DR[1]}$ to $V_{DR[m]}$ of the driving potential line 26 are held at the low-level potential $V_{DR_L}$, the potential control circuit 36 sets the capacitive potential $S_C$ to the potential W(t). The potential W(t) is changed with time from the potential $V_L$ to the potential $V_H$ from the start point to the end point of the operation period $T_{DRV}$, similarly to the first embodiment. Since the capacitive element $C_2$ is interposed between the capacitive line 48 and the gate of the driving transistor $T_{DR}$, the potential $V_G$ of the gate of the driving transistor $T_{DR}$ of each pixel circuit $P_{IX}$ is in tandem with the potential W(t) by capacitive coupling of the capacitive element $C_2$. Accordingly, similarly to the first embodiment, the driving transistor $T_{DR}$ transitions from the off state to the on state at a time according to the gradation potential $V_{D[m,n]}$ of the operation period $T_{DRV}$ and the forward bias begins to be applied to the electrophoretic element 40. In addition, while only the capacitive element $C_1$ pertains to the gate of the driving transistor $T_{DR}$ in the first embodiment, the capacitive element $C_1$ and the capacitive element $C_2$ pertain to the gate of the driving transistor $T_{DR}$ in the present embodiment. Therefore, in the present embodiment, in order to change the potential $V_G$ in the same range as the first embodiment, the potential W(t) of the capacitive potential $S_C$ needs to be changed with a large amplitude as compared to the potential W(t) of the first embodiment.

Even in the above-described third embodiment, the same effects as the first embodiment are realized. In the third embodiment, since the capacitive potential $S_C$ is used in the initialization operation or the driving operation, the operation for changing the instruction signal $X_{[n]}$ to the initialization potential $V_{RST}$ in the initialization period $T_{RST}$ or the operation for changing the instruction signal $X_{[n]}$ from the potential $V_L$ to the potential $V_H$ in the operation period $T_{DRV}$ is not necessary. That is, according to the third embodiment, since the amplitude of the instruction signal $X_{[n]}$ is lower than that of the first embodiment, pressure resistance performance necessary for the column driving circuit 34 is reduced. Since only the capacitive element $C_1$ pertains to the gate of the driving transistor $T_{DR}$ in the first embodiment, as compared to the third embodiment in which the capacitive element $C_1$ and the capacitive element $C_2$ pertain to the gate of the driving transistor $T_{DR}$, the charging/discharging of the charges when the potential $V_G$ of the gate of the driving transistor $T_{DR}$ is changed is reduced (further, power consumption is reduced).

D: Fourth Embodiment

In order to enable the driving transistor $T_{DR}$ from the off state to the on state in the operation period $T_{DRV}$, the voltage $V_{GS}$ between the gate and the source of the driving transistor $T_{DR}$ needs to be changed with time. As the method of changing the voltage $V_{GS}$, there is a method of changing the potential $V_G$ of the gate and a method of changing the potential of the source. The first embodiment of setting the instruction signal $X_{[n]}$ to the potential W(t) or the third embodiment of setting the capacitive potential $S_C$ to the potential W(t) are detailed examples of the former method of changing the voltage $V_G$ of the gate of the driving transistor $T_{DR}$. In contrast, the below-described fourth embodiment employs the latter method of changing the potential (that is, the driving potential $V_{DR[m]}$) of the source of the driving transistor $T_{DR}$ in the operation period $T_{DRV}$ with time. The configuration of the pixel circuit $P_{IX}$ is equal to that of the first embodiment.

Figure 19:
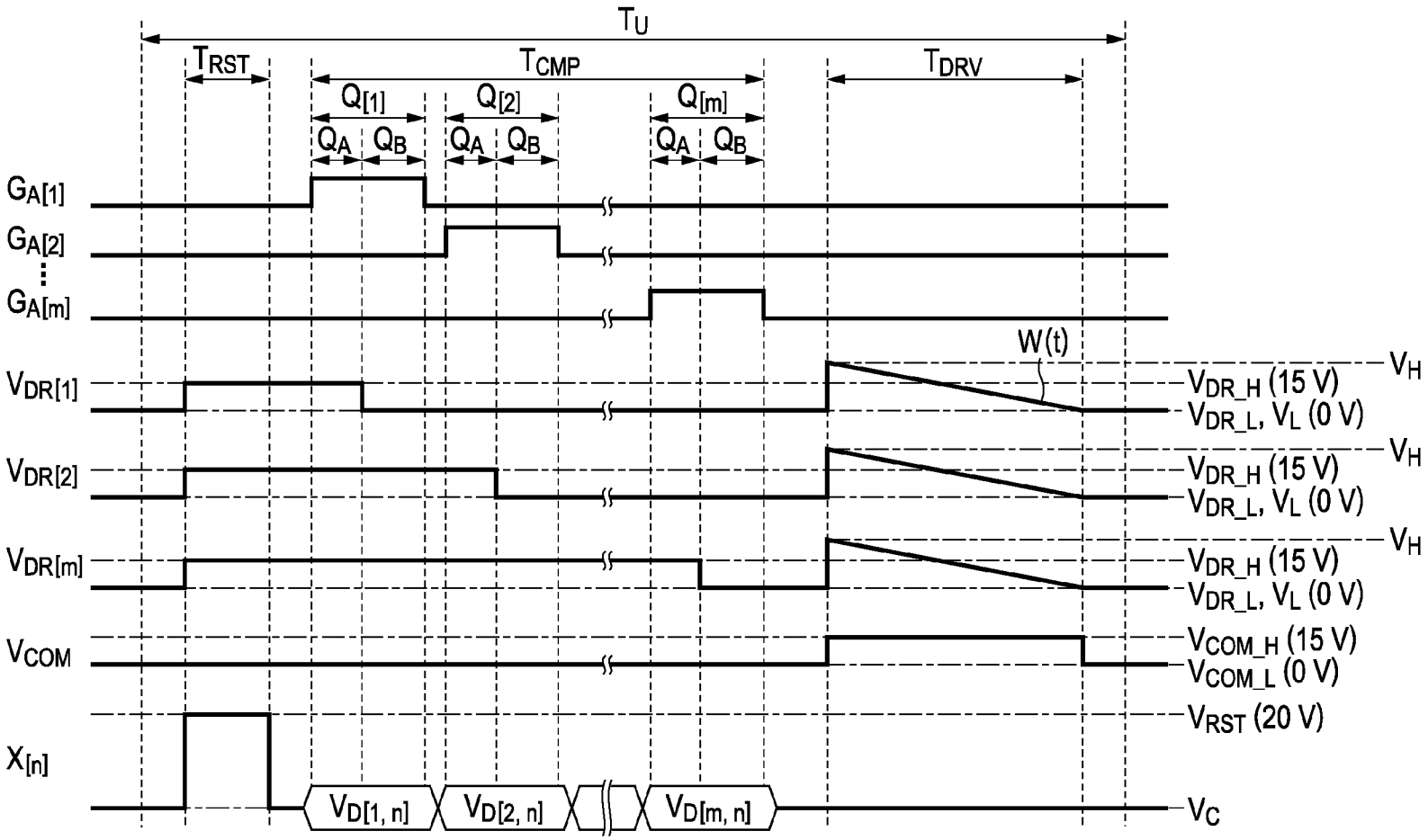
FIG. 19 is an explanatory diagram of an operation of a fourth embodiment.

FIG. 19 is an explanatory diagram of an operation within a unit period $T_U$ of the fourth embodiment. The operation of the initialization period $T_{RST}$ and the compensation period $T_{CMP}$, are equal to those of the first embodiment and the description thereof will be omitted. Hereinafter, the operation of the operation period $T_{DRV}$ will be described.

The column driving circuit 34 holds the instruction signals $X_{[1]}$ to $X_{[n]}$ within the operation period $T_{DRV}$ at the reference potential $V_C$. Accordingly, the potential $V_G$ of the gate of the driving transistor $T_{DR}$ is fixed within the operation period $T_{DRV}$. In contrast, the row driving circuit 32 sets the driving potentials $V_{DR[T]}$ to $V_{DR[m]}$ supplied to the driving potential lines 26 (sources of the driving transistors $T_{DR}$ of the pixel circuits $P_{IX}$) to the potential W(t). As shown in FIG. 19, the potential W(t) decreases with time from the potential $V_H$ to the potential $V_L$ ($V_L=V_{DR_L}=0V$) from the start point to the end point of the driving period $T_{DRV}$. Accordingly, the voltage $V_{GS}$ between the gate and the source of the driving transistor $T_{DR}$ is increased with time within the operation period $T_{DRV}$, similarly to the first embodiment to the third embodiment. When the voltage $V_{GS}$ of each driving transistor $T_{DR}$ reaches its threshold voltage $V_{TH}$, the driving transistor $T_{DR}$ is changed to the on state and the driving potential $V_{DR[m]}$ (potential W(t)) is supplied to the electrophoretic element 40.

Figure 20:
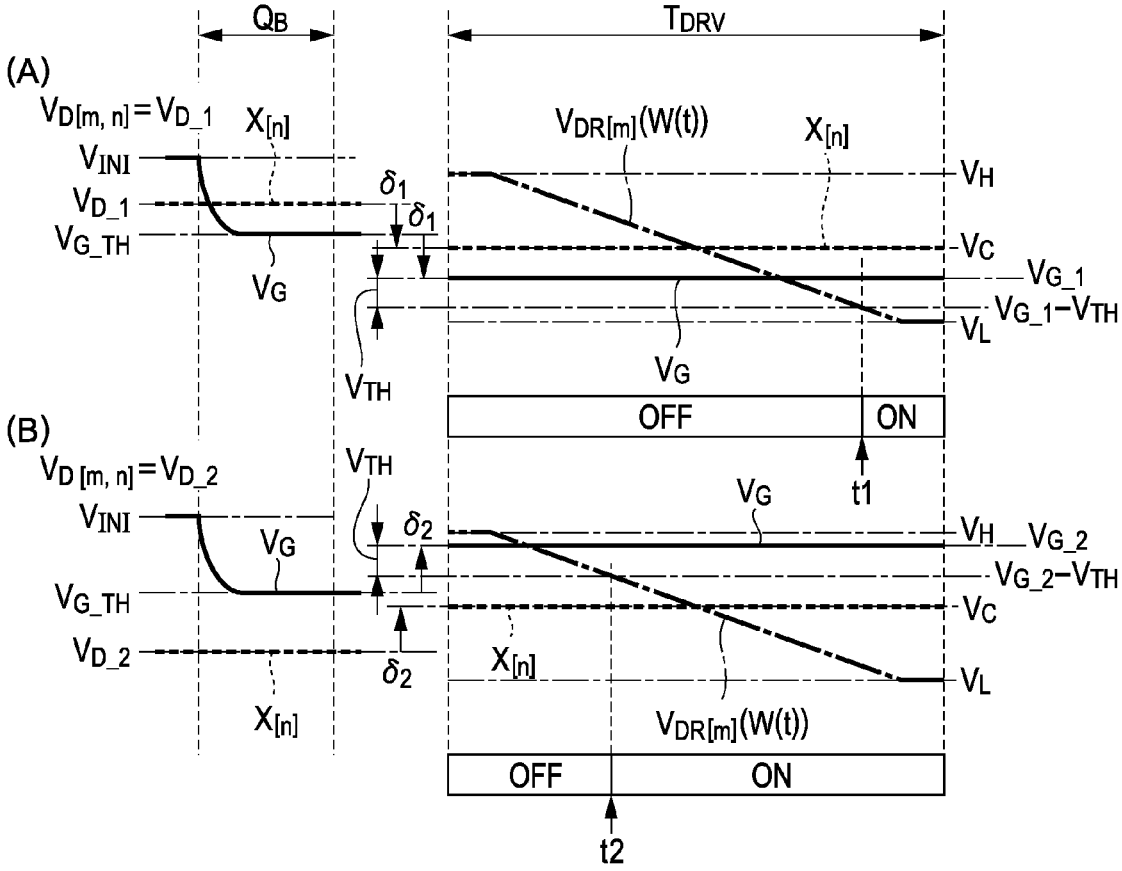
FIG. 20 is an explanatory diagram of a relationship between an operation time of a driving transistor and a gradation potential of the fourth embodiment.

A part (A) and a part (B) of FIG. 20 are schematic diagrams of a change in the potential (dotted line) of the instruction signal $X_{[n]}$, the potential $V_G$ (solid line) of the gate of the driving transistor $T_{DR}$ and the driving potential $V_{DR[m]}$ (chained line) with time. In part (A) of FIG. 20, the case where the gradation potential $V_{D[m,n]}$ is set to the potential $V_{D_1}$ ($V_{D_1}>V_C$) is considered. If the instruction signal $X_{[n]}$ is set to the reference potential $V_C$ at the start point of the operation period $T_{DRV}$, the potential $V_G$ of the gate of the driving transistor $T_{DR}$ is changed to a potential $V_{G1}$ lower than the potential $V_{G_TH}$ after setting in the compensation period $T_{CMP}$, by a difference $\delta_1$ between the gradation potential $V_{D_1}$ and the reference potential $V_C$. At a time t1 when the potential W(t) of the driving potential $V_{DR[m]}$ decreases with time so as to reach a potential ($V_{G_1}-V_{TH}$) which is less than the potential $V_{G\text{-}1}$ by the threshold voltage $V_{TH}$, the voltage $V_{GS}$ between the gate and the source of the driving transistor $T_{DR}$ reaches the threshold voltage $V_{TH}$ and the driving transistor $T_{DR}$ transitions to the on state.

In contrast, in part (B) of FIG. 20, the case where the gradation potential $V_{D[m,n]}$ is set to a potential $V_{D_2}$ ($V_{D_2}<V_C$) lower than the potential $V_{D_2}$ is considered. When the operation period $T_{DRV}$ starts, the potential $V_G$ of the gate of the driving transistor $T_{DR}$ is changed to a potential $V_{G2}$ higher than the potential $V_{G_TH}$ set in the compensation period $T_{CMP}$, by a difference $\delta_2$ between the gradation potential $V_{D_2}$ and the reference potential $V_C$. At a time t2 when the potential W(t) of the driving potential $V_{DR[m]}$ is decreased to a potential ($V_{G_2}-V_{TH}$) which is less than the potential $V_{G\text{-}2}$ by the threshold voltage $V_{TH}$, the driving transistor $T_{DR}$ transitions to the on state.

As described above, the times t1 and t2 when the driving transistor $T_{DR}$ within the operation period $T_{DRV}$ transitions from the off state to the on state are variably controlled according to the gradation potential $V_{D[m,n]}$. Accordingly, similarly to the above-described embodiment, the gradation of the electrophoretic element 40 of each pixel circuit $P_{IX}$ is controlled in multiple stages according to the gradation potential $V_{D[m,n]}$ of the pixel circuit $P_{IX}$. More specifically, as can be understood from the example of FIG. 20, as the gradation potential $V_{D[m,n]}$ is decreased, the length of the time when the driving transistor $T_{DR}$ is in the on state is increased. Accordingly, the gradation of the electrophoretic element 40 is controlled so as to be a low gradation (gradation close to black). Even in the third embodiment, the same effects as the first embodiment are realized.

E: Fifth Embodiment

Figure 21:
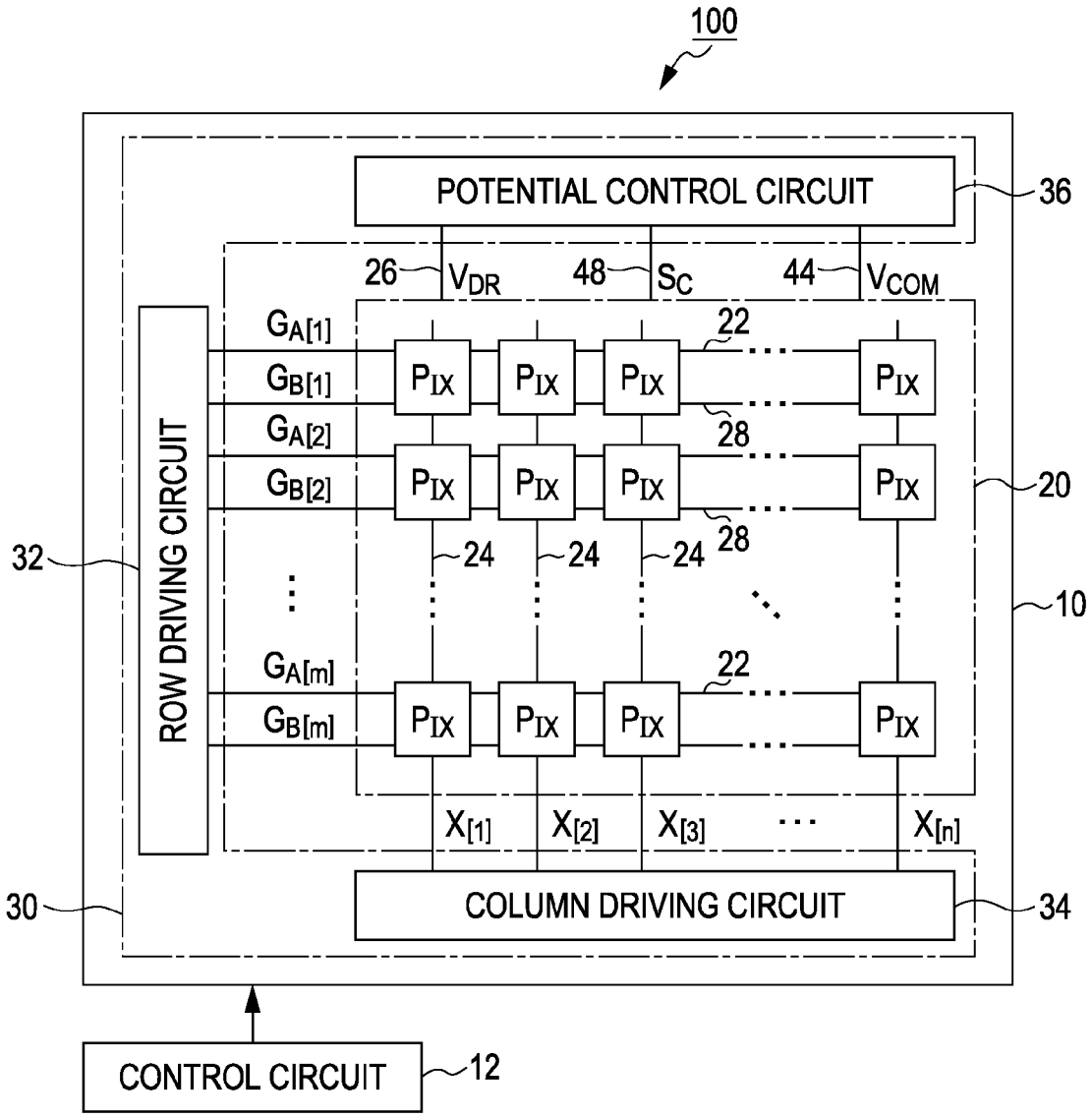
FIG. 21 is a block diagram of an electro-optical device according to a fifth embodiment.

FIG. 21 is a block diagram of an electro-optical device 100 according to a fifth embodiment. As shown in FIG. 21, M control lines 22 and M control lines 28 which are formed in parallel, and N signal lines 24 crossing the control lines 22 and the control lines 28 are formed in a display unit 20 of the electro-optical device 100 of the fifth embodiment. All pixel circuits $P_{IX}$ in the display unit 20 are commonly connected to a driving potential line 26 and a capacitive line 48. A potential control circuit 36 supplies a driving potential $V_{DR}$ to the driving potential line 26 and supplies a capacitive potential $S_C$ to the capacitive line 48. That is, the capacitive potential $S_C$ and the driving potential $V_{DR}$ are commonly supplied to all pixel circuits $P_{IX}$.

Figure 22:
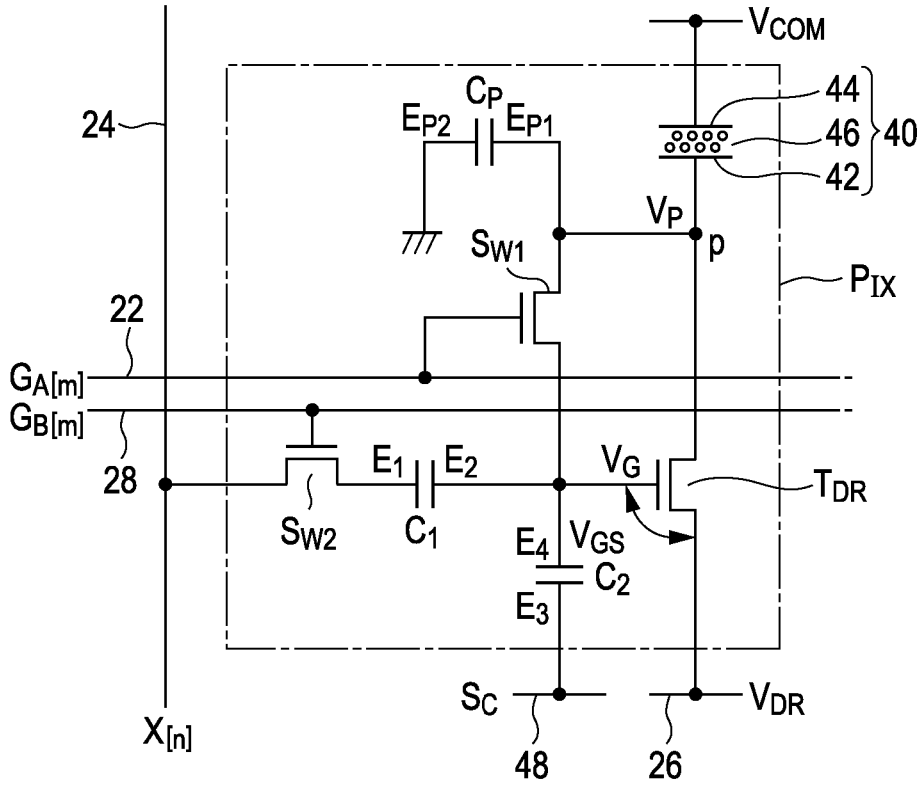
FIG. 22 is a circuit diagram of a pixel circuit of the fifth embodiment.

FIG. 22 is a circuit diagram of the pixel circuit $P_{IX}$ of the fifth embodiment. In FIG. 22, one pixel circuit $P_{IX}$ located at an m-th row and an n-th column is representatively shown. As shown in FIG. 22, the pixel circuit $P_{IX}$ has a configuration in which a switch $S_{W2}$ and a capacitive element $C_2$ are added to the pixel circuit $P_{IX}$ of the first embodiment. The capacitive element $C_2$ is a capacitor including an electrode $E_3$ connected to the capacitive line 48 and an electrode $E_4$ connected to the gate of the driving transistor $T_{DR}$, similarly to the third embodiment.

The switch $S_{W2}$ includes an N channel type thin film transistor similarly to the driving transistor $T_{DR}$ or the switch $S_{W1}$ and controls electrical connection (electrical connection/non-electrical connection) between the signal line 24 of the n-th column and the electrode $E_1$ of the capacitive element $C_1$. The gate of the switch $S_{W2}$ is connected to the control line 22 of the m-th row. As shown in FIGS. 21 and 22, a row driving circuit 32 supplies control signals $G_{A[1]}$ to $G_{A[m]}$ to the control lines 22 and supplies control signals $G_{B[1]}$ to $G_{B[m]}$ to the control lines 28. A configuration in which a circuit for generating the control signals $G_{A[1]}$ to $G_{A[m]}$ and a circuit for generating the control signals $G_{B[1]}$ to $G_{B[m]}$ are separately mounted may be employed. The rest of the configuration of the pixel circuit $P_{IX}$ is the same as that of the first embodiment.

Figure 23:
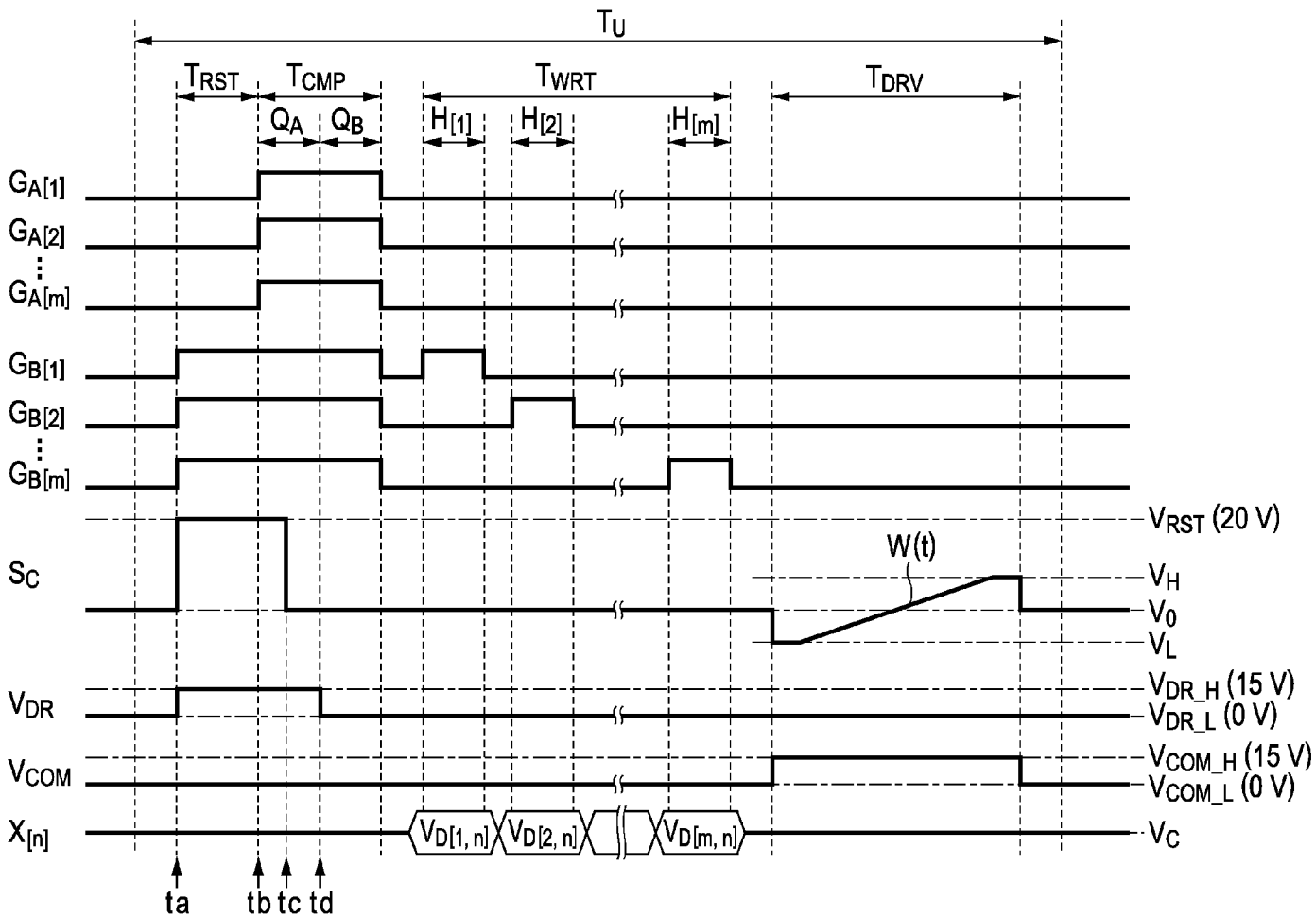
FIG. 23 is an explanatory diagram of an operation of the fifth embodiment.

FIG. 23 is an explanatory diagram of an operation of the electro-optical device 100 of the fifth embodiment. As shown in FIG. 23, the unit period $T_U$ which is the period of the operation of the electro-optical device 100 includes an initialization period $T_{RST}$, a compensation period $T_{CMP}$, a write period $T_{WRT}$ and an operation period $T_{DRV}$. Similarly to the first embodiment, an initialization operation is executed in parallel with respect to all pixel circuits $P_{IX}$ in the initialization period $T_{RST}$ and a driving operation is executed in parallel with respect to all pixel circuits $P_{IX}$ in the operation period $T_{DRV}$.

Although the compensation operation is sequentially executed in the row units of the pixel circuit $P_{IX}$ in the first embodiment, the compensation operation is executed in parallel (concurrently) with respect to all pixel circuits $P_{IX}$ in the display unit 20 in the compensation period $T_{CMP}$, in the fifth embodiment. As shown in FIG. 23, the compensation period $T_{CMP}$, is divided into a compensation preparation period $Q_A$ for setting a potential $V_G$ of the gate of the driving transistor $T_{DR}$ to an initial compensation value $V_{INI}$ and a compensation execution period $Q_B$ for executing the compensation operation. The write period $T_{WRT}$ is divided into M selection periods (horizontal scanning periods) $H_{[1]}$ to $H_{[m]}$ corresponding to rows of the pixel circuit $P_{IX}$. In a selection period $H_{[m]}$, a writing operation (supply of the gradation potential $V_{D[m,n]}$) is executed with respect to N pixel circuits $P_{IX}$ of the m-th row.

Figure 24:
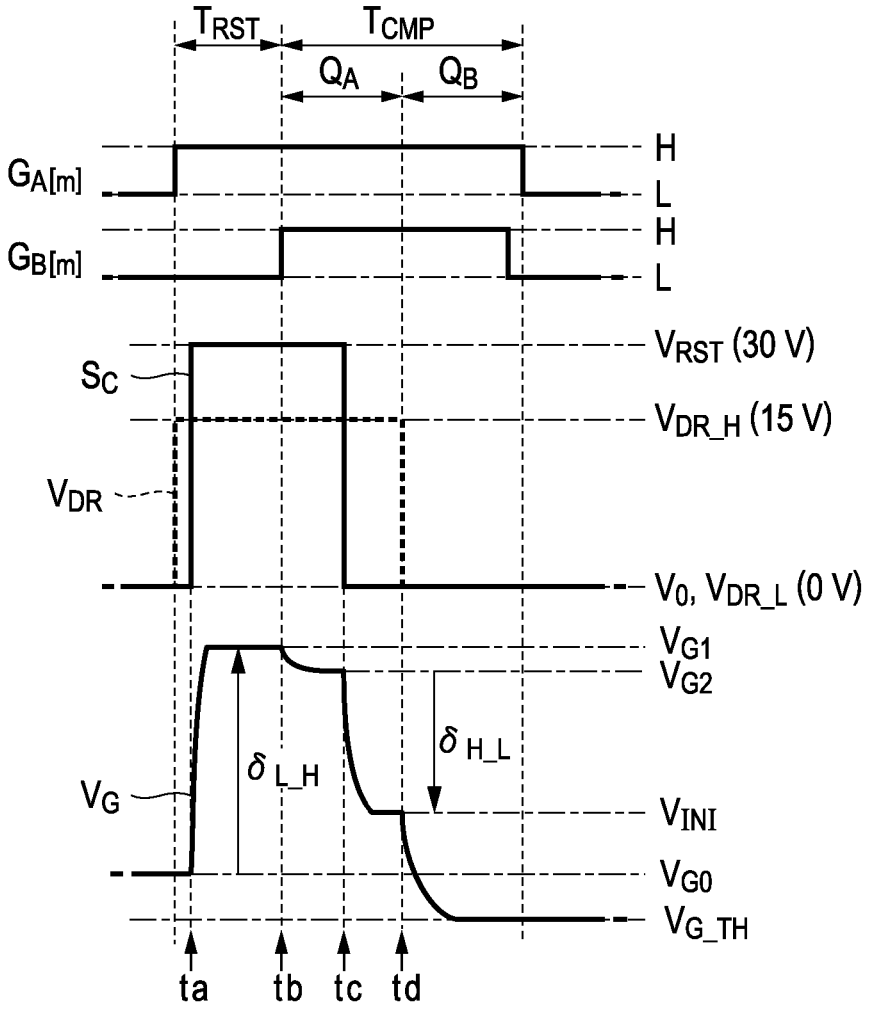
FIG. 24 is an explanatory diagram of an initialization period and a compensation period of the fifth embodiment.
Figure 25:
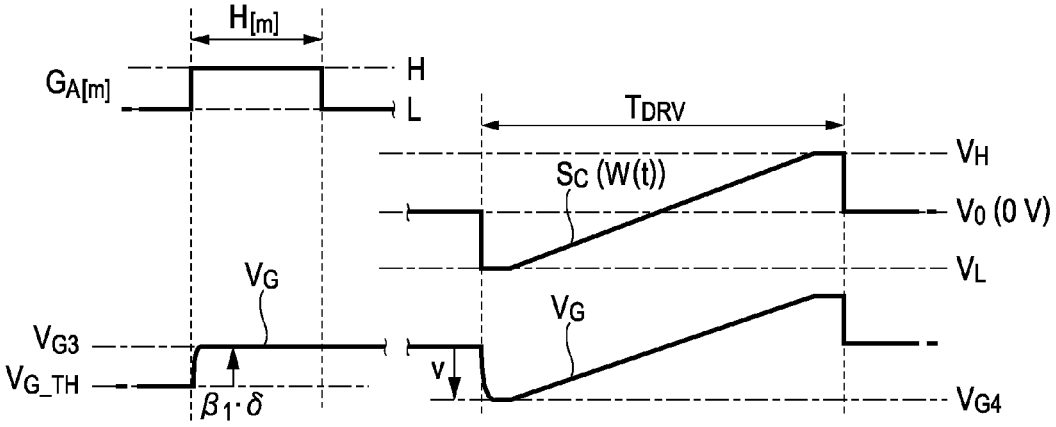
FIG. 25 is an explanatory diagram of a write period and an operation period of the fifth embodiment.

FIG. 24 is an explanatory diagram of the potential $V_G$ of the gate of the driving transistor $T_{DR}$ in the initialization period $T_{RST}$ and the compensation period $T_{CMP}$. FIG. 25 is an explanatory diagram of the potential $V_G$ of the gate of the driving transistor $T_{DR}$ in the selection period $H_{[m]}$ and the operation period $T_{DRV}$. The operations of the above-described periods ($T_{RST}$, $T_{CMP}$, $T_{WRT}$ and $T_{DRV}$) will be described with reference to FIGS. 23 to 25. As shown in FIG. 24, just before the initialization period $T_{RST}$, the case where the potential $V_G$ of the gate of the driving transistor $T_{DR}$ is set to a potential $V_{G0}$ is considered.

1. Initialization Period $T_{RST}$

Figure 26:
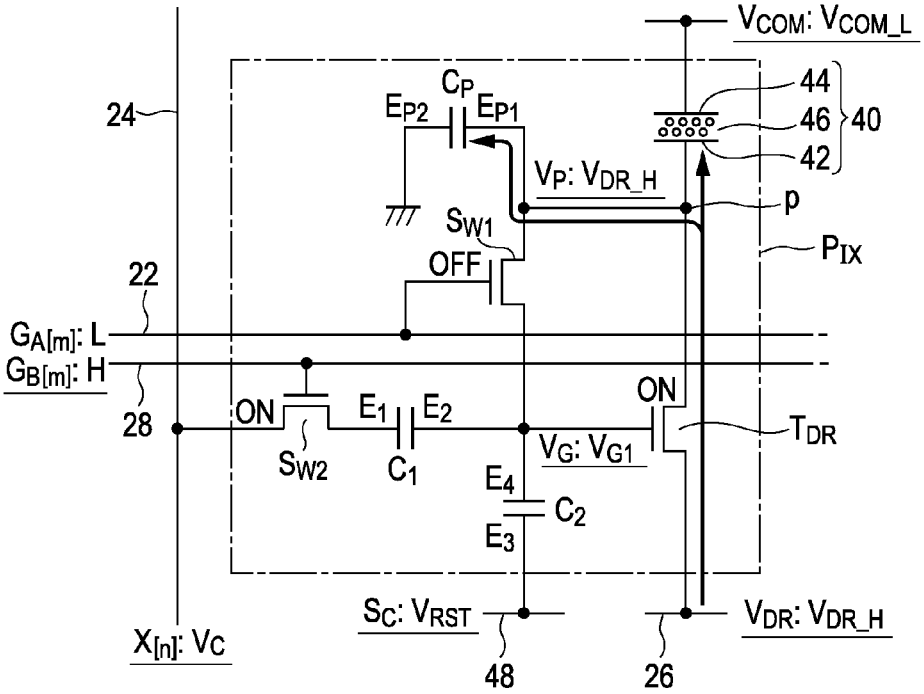
FIG. 26 is an explanatory diagram of the pixel circuit of the initialization period of the fifth embodiment.

As shown in FIGS. 23 and 26, the column driving circuit 34 sets the instruction signals $X_{[1]}$ to $X_{[N]}$ to the reference potential $V_C$ in an initialization period $T_{RST}$. When the initialization period $T_{RST}$ starts, the row driving circuit 32 sets the control signals $G_{B[1]}$ to $G_{B[m]}$ to a high level so as to control the switch $S_{W2}$ of each of all the pixel circuits $P_{IX}$ to an on state. Accordingly, the reference potential $V_C$ of the instruction signal $X_{[n]}$ is supplied from the signal line 24 to the electrode $E_1$ of the capacitive element $C_1$ of each pixel circuit $P_{IX}$. In contrast, the potential control circuit 36 changes the driving potential $V_{DR}$ of the driving potential line 26 from a low-level potential $V_{DR_L}$ to a high-level potential $V_{DR_H}$ and holds a common potential $V_{COM}$ of the counter electrode 44 at a low-level potential $V_{COM_L}$.

As shown in FIG. 24, if a time ta within the initialization period $T_{RST}$ is reached, the potential control circuit 36 changes the capacitive potential $S_C$ of the capacitive line 48 from a potential $V_0$ (0 V) to the initialization potential $V_{RST}$. Accordingly, the potential $V_G$ of the gate of the driving transistor $T_{DR}$ is increased to the potential $V_{G1}$ in tandem with the capacitive potential $S_C$ by capacitive coupling of the capacitive element $C_2$. In the initialization period $T_{RST}$, the control signals $G_{A[1]}$ to $G_{A[m]}$ are set to a low level and the additional capacitive element $C_P$ is electrically insulated from the gate of the driving transistor $T_{DR}$. Accordingly, similarly to the third embodiment, a change $\delta_{L_H}$ ($V_{G1}=V_{G0}+\delta_{L_H}$) in the potential $V_G$ at the time ta of the initialization period $T_{RST}$ becomes a voltage ($\delta_{L_H}=\beta 2(V_{RST}-V_0)$, $\beta 2=c_2/(c_1+c_2)$) obtained by dividing the change ($V_{RST}-V_0$) of the capacitive potential $S_C$ by the capacitive element $C_1$ and the capacitive element $C_2$.

The initialization potential $V_{RST}$ of the capacitive potential $S_C$ is set to a potential (for example 30V) for enabling the driving transistor $T_{DR}$ to transition to an on state in a state in which the driving potential $V_{DR}$ is set to the high-level potential $V_{DR_H}$. In the initialization period $T_{RST}$, the potential $V_P$ of the circuit point p is initialized to the high-level potential $V_{DR_H}$ supplied from the driving potential line 26 through the driving transistor $T_{DR}$ (initialization operation), as denoted by an arrow of FIG. 26. That is, the reverse bias is applied to the electrophoretic element 40 and the high-level potential $V_{DR_H}$ is held in the additional capacitive element $C_P$.

2. Compensation Period $T_{CMP}$

Figure 27:
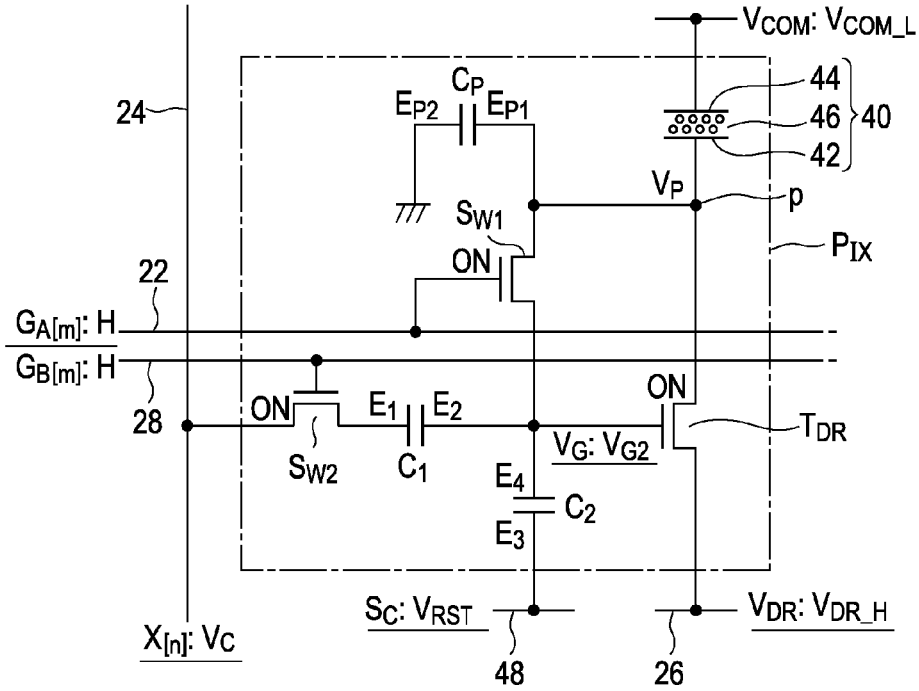
FIG. 27 is an explanatory diagram of the pixel circuit of a compensation preparation period (first half) of the fifth embodiment.

When the compensation preparation period $Q_A$ subsequent to the initialization period $T_{RST}$ in the compensation period $T_{CMP}$, starts (time tb of FIG. 24), the row driving circuit 32 sets the control signals $G_{A[1]}$ to $G_{A[m]}$ to the high level in a state in which the control signals $G_{B[1]}$ to $G_{B[m]}$ are held at the high level so as to control the switch $S_{W1}$ of each pixel circuit $P_{IX}$ to the on state, as shown in FIGS. 23 and 27. That is, the driving transistor $T_{DR}$ of each pixel circuit $P_{IX}$ is diode-connected. Accordingly, as shown in FIG. 24, if the potential $V_G$ of the gate of the driving transistor $T_{DR}$ decreases with time so as to reach a potential $V_{G2}$ ($V_{G2}=V_{DR_R}+V_{TH}$) in which the voltage $V_{GS}$ between the gate and the source of the driving transistor $T_{DR}$ becomes a threshold voltage $V_{TH}$, the driving transistor $T_{DR}$ transitions to the off state.

Figure 28:
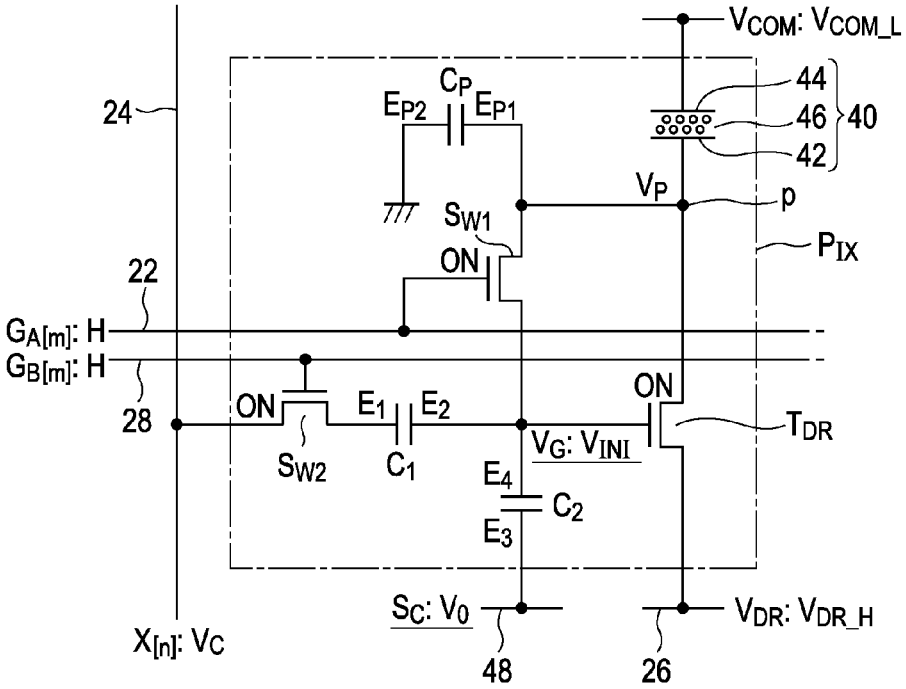
FIG. 28 is an explanatory diagram of the pixel circuit of a compensation preparation period (second half) of the fifth embodiment.

When a time tc of the compensation preparation period $Q_A$ is reached, the potential control circuit 36 decreases the capacitive potential $S_C$ from the initialization potential $V_{RST}$ to the potential $V_0$, as shown in FIGS. 23 and 28. Accordingly, as shown in FIG. 24, the potential $V_G$ of the gate of the driving transistor $T_{DR}$ is decreased from the potential $V_{G2}$ to the initial compensation value $V_{INI}$ in tandem with the change in the capacitive potential $S_C$. At the time tc, since the additional capacitive element $C_P$ is connected to the gate of the driving transistor $T_{DR}$, the change $\delta_{H_L}$ ($V_{INI}=V_{G2}-\delta_{H_L}$) of the potential $V_G$ at the time tc becomes a voltage (δhd $H_{_L}=\gamma 2(V_{RST}-V_0)$, $\gamma 2=c_2/(c_1+c_2+c_P)$) obtained by dividing the change ($V_{RST}-V_0$) of the capacitive potential $S_C$ by the capacitive element $C_1$, the capacitive element $C_2$ and the additional capacitive element $C_P$, similarly to the third embodiment. That is, the change $\delta_{H_L}$ of the potential $V_G$ at the time tc is less than the change $\delta_{L_H}$ of the potential $V_G$ at the time ta. Using the above-described difference between the change $\delta_{H_L}$ and the change $\delta_{L_H}$, the initial compensation value $V_{INI}$ is set to a potential exceeding the potential $V_{G0}$ of the gate before the start of the initialization period $T_{RST}$, similarly to the first embodiment.

Figure 29:
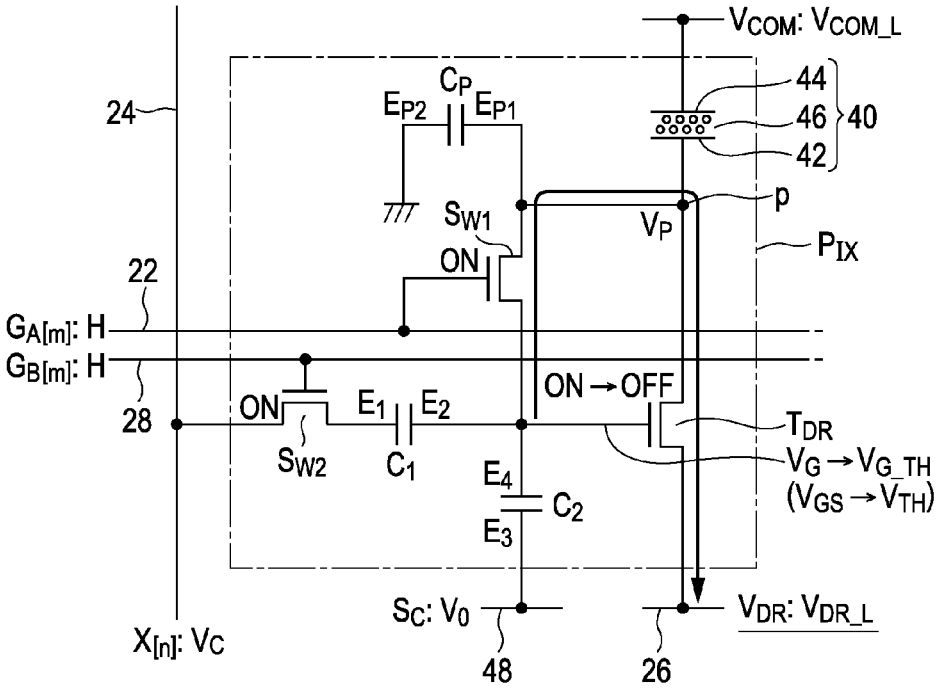
FIG. 29 is an explanatory diagram of the pixel circuit of a compensation execution period of the fifth embodiment.

When the compensation execution period $Q_B$ starts (time td of FIG. 24), the potential control circuit 36 changes the driving potential $V_{DR}$ from the high-level potential $V_{DR_H}$ to the low-level potential $V_{DR_L}$. In the compensation execution period $Q_B$, the on state of the switch $S_{W1}$ (diode connection of the driving transistor $T_{DR}$) is held from the compensation preparation period $Q_A$. Accordingly, when the driving potential $V_{DR}$ (the potential of the source of the driving transistor $T_{DR}$) is decreased to the low-level potential $V_{DR_L}$ such that the driving transistor $T_{DR}$ transitions to the on state, as denoted by an arrow of FIG. 29, the charges of the gate of the driving transistor $T_{DR}$ are discharged to the driving potential line 26 through the switch $S_{W1}$, the circuit point p and the driving transistor $T_{DR}$. Accordingly, the potential $V_G$ of the gate is decreased from the initial compensation value $V_{INI}$ with time and the driving transistor $T_{DR}$ transitions to the off state (compensation operation) at a time when the voltage $V_{GS}$ between the gate and the source reaches the threshold voltage $V_{TH}$.

Figure 30:
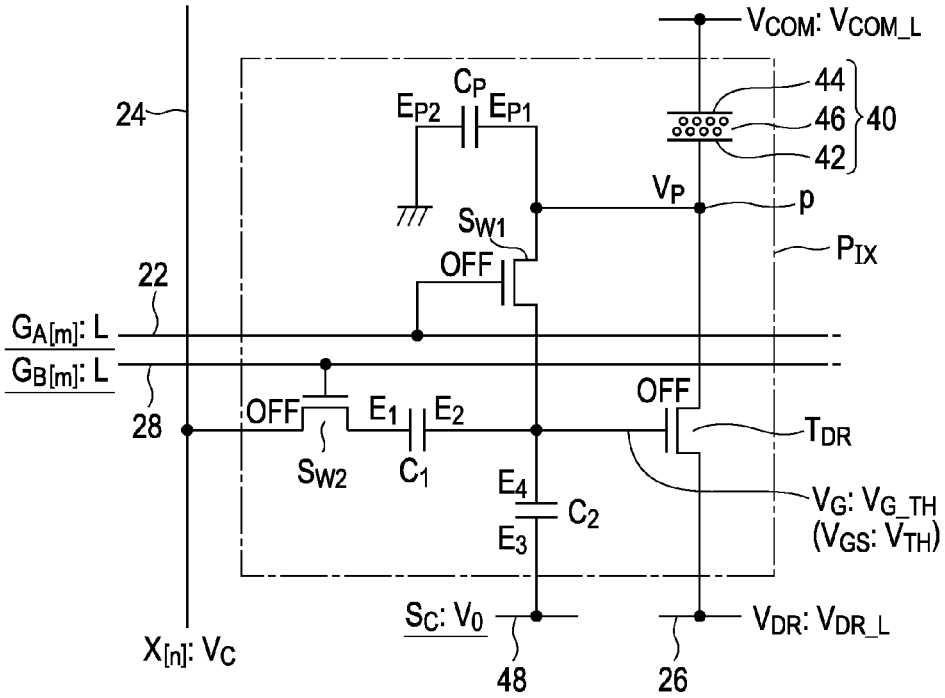
FIG. 30 is an explanatory diagram of the pixel circuit of an end point of the compensation execution period of the fifth embodiment.

When the compensation execution period $Q_B$ finishes, the row driving circuit 32 changes the control signals $G_{A[1]}$ to $G_{A[m]}$ and the control signals $G_{B[1]}$ to $G_{B[m]}$ to a low level so as to control the switch $S_{W1}$ and switch $S_{W2}$ of each pixel circuit $P_{IX}$ to the off state, as shown in FIGS. 23 and 30. Accordingly, at an end point of the compensation period $T_{CMP}$, as shown in FIG. 30, in all the pixel circuits $P_{IX}$ in the display unit 20, in a state in which the electrode $E_1$ of the capacitive element $C_1$ is set to the reference potential $V_C$, the potential $V_G$ of the gate of the driving transistor $T_{DR}$ is set to a potential $V_{G_TH}$ ($V_{G_TH}-V_{DR_L}-V_{TH}$).

3. Write Period $T_{WRT}$

Figure 31:
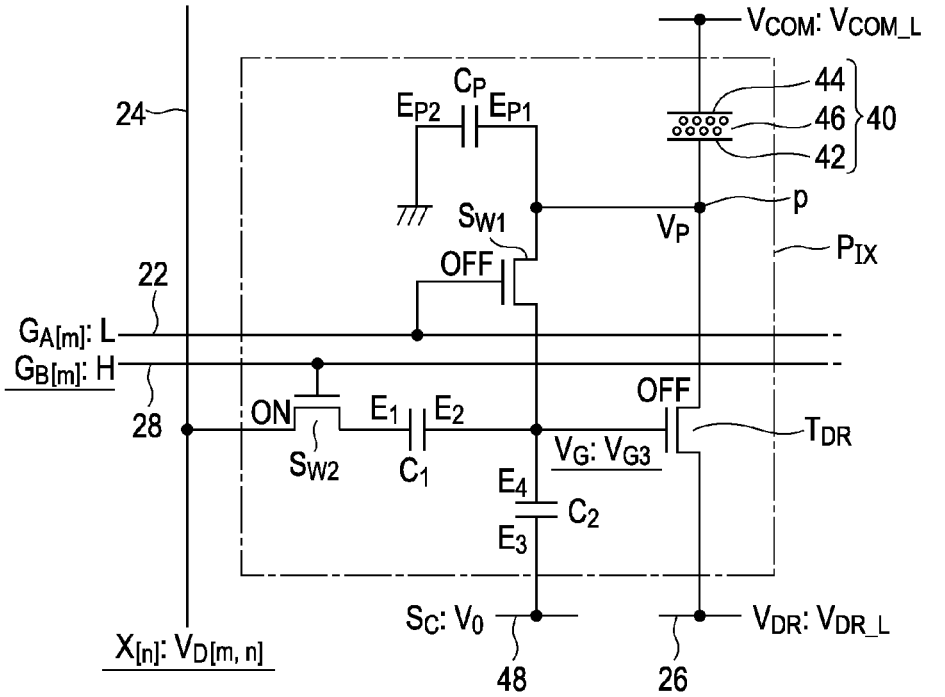
FIG. 31 is an explanatory diagram of the pixel circuit of a write period of the fifth embodiment.

As shown in FIGS. 23 and 31, the row driving circuit 32 sequentially sets the control signals $G_{B[1]}$ to $G_{B[m]}$ to the high level in the selection periods $H_{[1]}$ to $H_{[m]}$ within the write period $T_{WRT}$. The control signals $G_{A[1]}$ to $G_{A[m]}$ are held at the low level. In the selection period $H_{[m]}$ in which the control signal $G_{B[m]}$ is set to the high level, the switch $S_{W2}$ of each of the N pixel circuits $P_{IX}$ of the m-th row transitions to the on state. In contrast, the column driving circuit 34 sets the instruction signals $X_{[n]}$ of each signal line 24 to the gradation potential $V_{D[m,n]}$ in the selection period $H_{[m]}$. Accordingly, as shown in FIG. 31, the potential of the electrode $E_1$ of the capacitive element $C_1$ in each pixel circuit $P_{IX}$ of the m-th row is changed from the reference potential $V_C$ after setting in the compensation period $T_{CMP}$ to the gradation potential $V_{D[m,n]}$.

If the potential of the electrode $E_1$ is changed by the change δ ($\delta=V_{D[m,n]}-V_C$) in the selection period $H_{[m]}$, as shown in FIGS. 25 and 31, the potential $V_G$ of the gate of the driving transistor $T_{DR}$ is changed to a potential $V_{G3}$ by capacitive coupling of the capacitive element $C_1$. The potential $V_{G3}$ is set to a potential ($V_{G3}=V_{G_TH}+\beta 1\cdot\delta$, $\beta 1=c1/(c_1+c_2)$) changed from the potential $V_{G_TH}$ after setting in the compensation period $T_{CMP}$, by a voltage obtained by dividing the change δ in the potential of the electrode $E_1$ by the capacitive element $C_1$ and the capacitive element $C_2$. When the selection period $H_{[m]}$ finishes, the control signal $G_{B[m]}$ is set to the low level such that the switch $S_{W2}$ of each pixel circuit $P_{IX}$ of the m-th row transitions to the off state. The above-described writing operation is sequentially executed in row units in each selection period $H_{[m]}$.

4. Operation Period $T_{DRV}$

Figure 32:
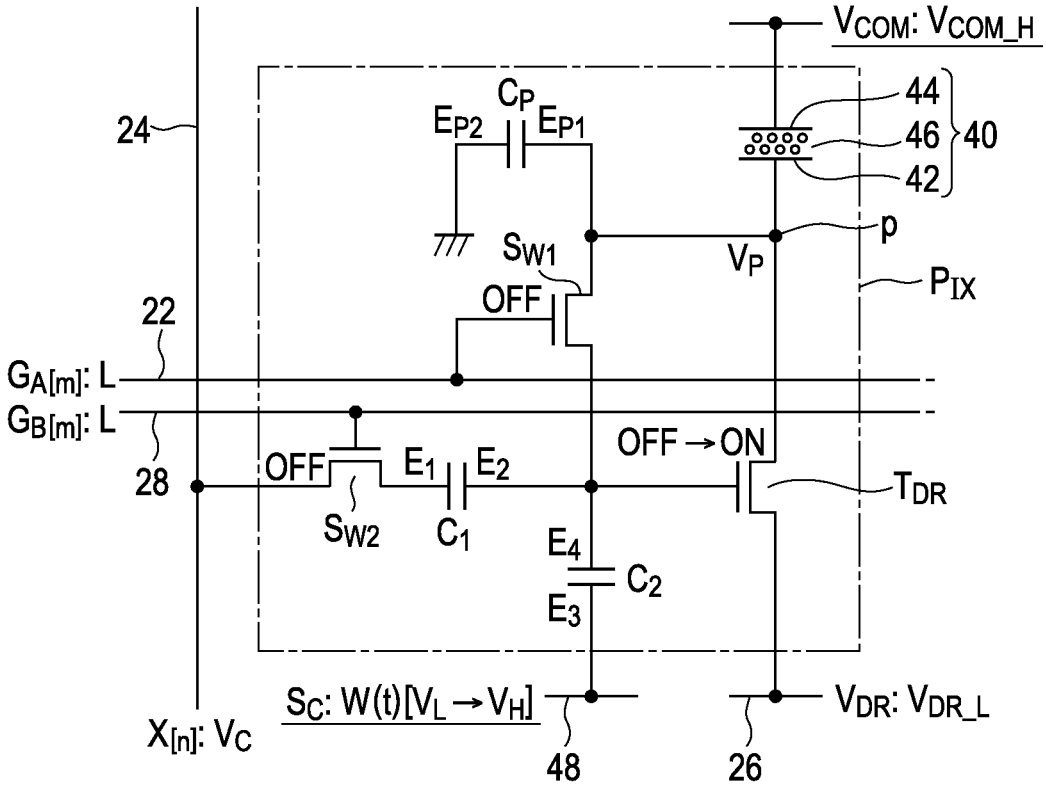
FIG. 32 is an explanatory diagram of the pixel circuit of an operation period of the fifth embodiment.

When the operation period $T_{DRV}$ after the elapse of the write period $T_{WRT}$ starts, the potential control circuit 36 changes the common potential $V_{COM}$ of the counter electrode 44 to the high-level potential $V_{COM_H}$, in a state in which the driving potential $V_{DR}$ of the driving potential line 26 is held at the low-level potential $V_{DR_L}$, as shown in FIGS. 23 and 32. In contrast, in the operation period $T_{DRV}$, the control signals $G_{A[1]}$ to $G_{A[m]}$ and the control signals $G_{B[1]}$ to $G_{B[m]}$ are set to the low level such that the switch $S_{W1}$ and the switch $S_{W2}$ of each pixel circuit $P_{IX}$ are held in the off state, as shown in FIG. 32.

The potential control circuit 36 sets the capacitive potential $S_C$ supplied to the capacitive line 48 to the potential W(t). As shown in FIGS. 23 and 25, the potential W(t) is controlled to a ramp waveform (a saw-like wave) linearly changed from the potential $V_L$ to the potential $V_H$ from the start point to the end point of the operation period $T_{DRV}$. More specifically, the potential control circuit 36 decreases the potential W(t) from the potential $V_0$ to the potential $V_L$ at the start point of the operation period $T_{DRV}$ and changes the potential W(t) such that the potential $V_0$ becomes a central value (amplitude center of the potential W(t)) between the potential $V_L$ and the potential $V_H$.

The potential $V_G$ of the gate of the driving transistor $T_{DR}$ is increased with time in tandem with the capacitive potential $S_C$ (potential W(t)) by capacitive coupling of the capacitive element $C_2$. First, if the potential W(t) is changed from the potential $V_0$ to the potential $V_L$ at the start point of the operation period $T_{DRV}$, the potential $V_G$ of the gate of the driving transistor $T_{DR}$ is changed (decreased) by a change v from the potential $V_{G3}$ after setting in the selection period $H_{[m]}$ to the potential $V_{G4}$, as shown in FIG. 25. The change v is a fixed value ($v=\beta 2(V_0-V_L)$, $\beta 2=c_2/(c_1+c_2)$) obtained by driving the change amount ($V_0-V_L$) of the potential W(t) by the capacitive element $C_1$ and the capacitive element $C_2$.

As shown in FIG. 25, the potential $V_G$ of the gate of the driving transistor $T_{DR}$ is changed with time from the potential $V_{G4}$ in tandem with the change ($V_L\rightarrow V_H$) of the potential W(t) and, at a time when reaching the potential $V_{G_TH}$, the voltage $V_{GS}$ between the gate and the source of the driving transistor $T_{DR}$ reaches its threshold voltage $V_{TH}$ and the driving transistor $T_{DR}$ transitions to the on state. Since the potential $V_{G4}$ at the start point of the operation period $T_{DRV}$ depends on the potential $V_{G3}$ set according to the gradation potential $V_{D[m,n]}$ in the selection period $H_{[m]}$, the driving transistor $T_{DR}$ of the pixel circuit $P_{IX}$ located at the m-th row and the n-th column transitions from the off state to the on state at a variable time according to the designated gradation (gradation potential $V_{D[m,n]}$) of the pixel circuit $P_{IX}$ in the operation period $T_{DRV}$. The behavior of the electrophoretic element 40 when the driving transistor $T_{DR}$ transitions to the on state is equal to that of the first embodiment.

Figure 33:
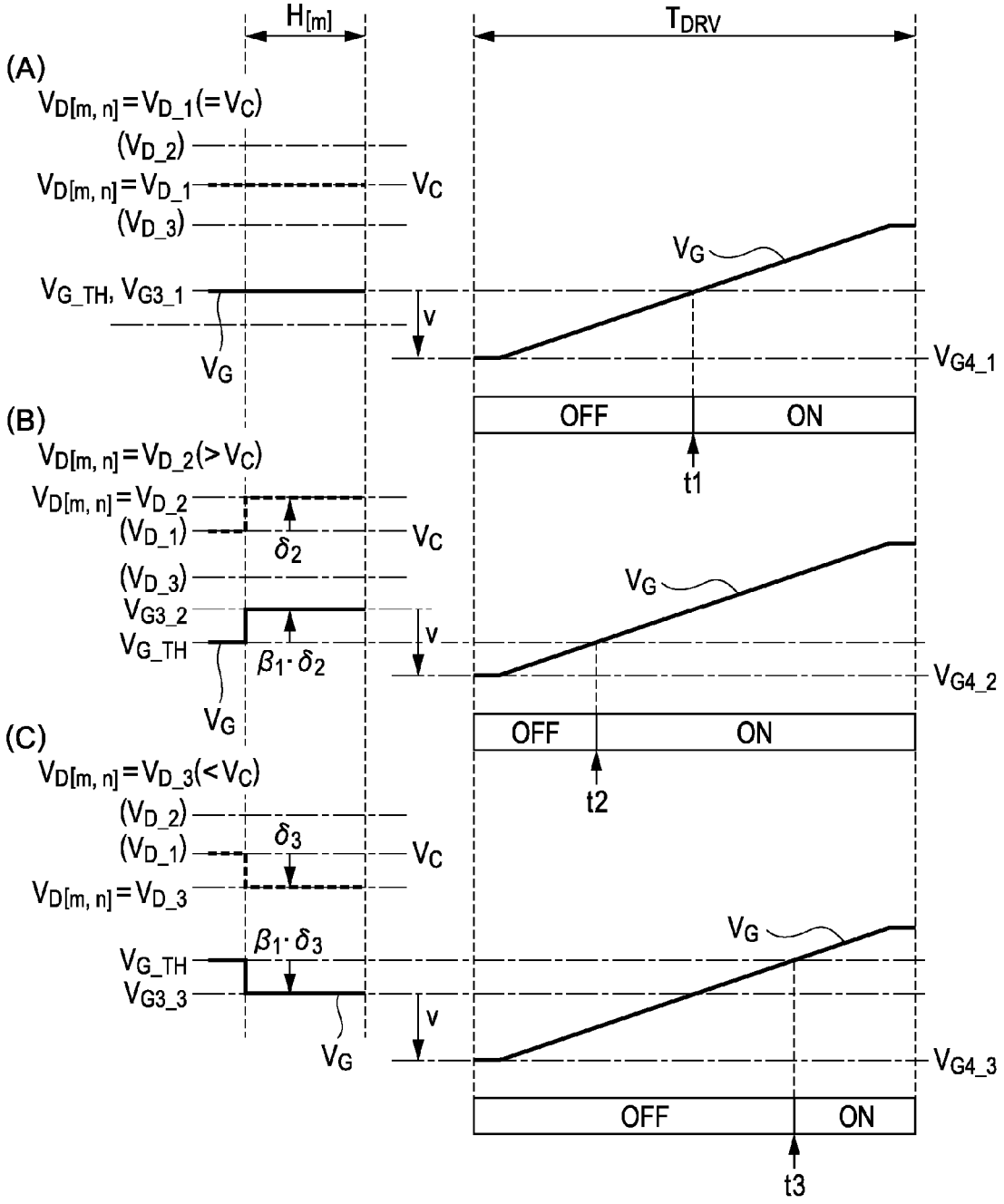
FIG. 33 is an explanatory diagram of a relationship between a driving time of a driving transistor and a gradation potential of the fifth embodiment.

FIG. 33 is a schematic diagram showing a state in which the times t1, t2 and t3 when the driving transistor $T_{DR}$ transitions from the off state to the on state is changed according to the gradation potential $V_{D[m,n]}$. The change in potential of the electrode $E_1$ in the selection period $H_{[m]}$ is denoted by a dotted line and the change in potential $V_G$ of the gate of the driving transistor $T_{DR}$ in the selection period $H_{[m]}$ and the operation period $T_{DRV}$ is denoted by a solid line.

In a part (A) of FIG. 33, the case where the gradation potential $V_{D[m,n]}$ is set to a potential $V_{D_1}$ is considered. The potential $V_{DT}$ is equal to the reference potential $V_C$. Accordingly, the potential $V_G$ of the gate of the driving transistor $T_{DR}$ is not changed in the selection period $H_{[m]}$. That is, the potential $V_{G3_2}$ at the end point of the selection period $H_{[m]}$ is held at the same potential as the potential $V_{G_TH}$ after setting in the compensation period $T_{CMP}$. When the operation period $T_{DRV}$ starts, the potential $V_G$ is increased with time from the potential $V_{G4\text{-}1}$ which is less than the potential $V_{G3_1}$ by the voltage v. At a time t1 when the potential $V_G$ reaches the potential $V_{G_TH}$ ($=V_{G3_1}$), the driving transistor $T_{DR}$ transitions from the off state to the on state.

In a part (B) of FIG. 33, the case where the gradation potential $V_{D[m,n]}$ is set to a potential $V_{D_2}$ higher than the reference potential $V_C$ ($V_{D_1}$) is considered. If the instruction signal $X_{[n]}$ is increased from the reference potential $V_C$ to the gradation potential $V_{D_2}$ in the selection period the potential $V_G$ of the gate of the driving transistor $T_{DR}$ is increased to a potential $V_{G3_2}$ ($V_{G3_2}=V_{G_TH}+\beta 1\cdot\delta 2$) according to the change δ2 ($\delta 2=V_{D_2}-V_C$) in the potential of the instruction signal $X_{[n]}$. The potential $V_{G4_2}$ obtained by decreasing the potential $V_{G3_2}$ by the change v at the start point of the operation period $T_{DRV}$ exceeds the potential $V_{G4_1}$ of the part (A) of FIG. 33. Accordingly, the driving transistor $T_{DR}$ transitions to the on state at a time t2 earlier than the time t1 of the part (A) of FIG. 33.

In a part (C) of FIG. 33, the case where the gradation potential $V_{D[m,n]}$ is set to a potential $V_{D_3}$ lower than the reference potential $V_C$ ($V_{D_1}$) is considered. Since the potential $V_G$ of the gate of the driving transistor $T_{DR}$ is decreased to a potential $V_{G3_3}$ ($V_{G3_3}=V_{G_TH}+\beta 1\cdot\delta 3$) according to the change δ3 ($\delta 3=V_{D_3}-V_C<0$) in the potential of the instruction signal $X_{[n]}$ in the selection period $H_{[m]}$, the potential $V_{G4_3}$ ($V_{G4_3}=V_{G3_3}-v$) at the start point of the operation period $T_{DRV}$ falls short of the potential $V_{G4_1}$ of the part (A) of FIG. 33. Accordingly, the driving transistor $T_{DR}$ transitions to the on state at a time t3 later than the time t1 of the part (A) of FIG. 13.

Figure 34:
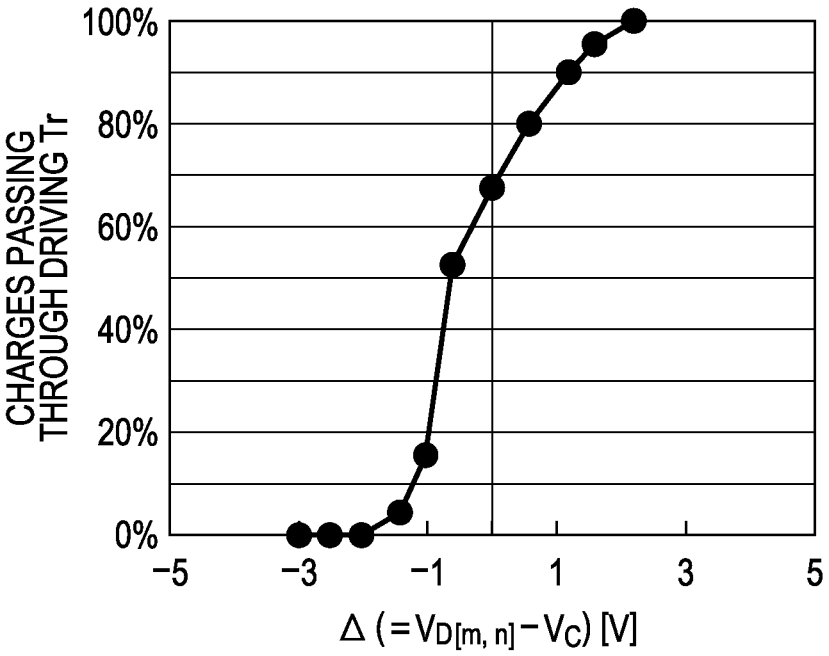
FIG. 34 is a graph of the gradation potential and the amount of charge passing through the driving transistor of the fifth embodiment.

FIG. 34 is a graph of a relationship between a difference Δ ($\Delta=V_{D[m,n]}-V_C$) between the gradation potential $V_{D[m,n]}$ and the reference potential $V_C$ and a total amount of charges passing through the driving transistor $T_{DR}$ within the operation period $T_{DRV}$, similarly to FIG. 14. As can be understood from FIGS. 33 and 34, in the fifth embodiment, contrary to the first embodiment (FIG. 14), as the gradation potential $V_{D[m,n]}$ is increased (as the difference Δ with the reference potential $V_C$ is increased), a time when the driving transistor $T_{DR}$ transitions to the on state in the operation period $T_{DRV}$ is increased. Accordingly, as the gradation potential $V_{D[m,n]}$ is increased (as the length of the time when the driving transistor $T_{DR}$ transitions to the on state within the operation period $T_{DRV}$), the gradation of the electrophoretic element 40 is controlled to a low gradation (gradation close to black).

Even in the above-described fifth embodiment, the same effects as the first embodiment are realized. In the fifth embodiment, since the compensation operation is executed in parallel with respect to all pixel circuits $P_{IX}$ in the display unit 20 in the compensation period $T_{CMP}$, as compared to the first embodiment in which the compensation operation is executed in row units, it is possible to shorten a time required for the compensation operation of each pixel circuit $P_{IX}$. In order to enable the voltage $V_{GS}$ between the gate and the source of the driving transistor $T_{DR}$ to sufficiently approach or coincide with the threshold voltage $V_{TH}$ in the compensation operation, a longer time is necessary as compared to the writing operation. Accordingly, according to the fifth embodiment in which the compensation operation is executed in parallel with respect to all pixel circuits $P_{IX}$, it is possible to shorten the unit period $T_U$ as compared to the first embodiment.

Since the switch $S_{W2}$ is interposed between the capacitive element $C_1$ of each pixel circuit $P_{IX}$ and the signal line 24, as compared to the configuration in which the capacitive element $C_1$ is directly connected to the signal line 24, it is possible to reduce the capacitive component pertaining to the signal line 24. Accordingly, it is possible to reduce power wasted in charging/discharging of the signal line 24. In contrast, according to the first embodiment, since the total number (2) of transistors of each pixel circuit $P_{IX}$ is reduced as compared to the number (3) of transistors in the fifth embodiment, the configuration of the pixel circuit $P_{IX}$ is simplified (further, high accuracy is realized). Since the waveforms of the control signals $G_{A[1]}$ to $G_{A[m]}$ of the fifth embodiment are common, a configuration in which a common control signal $G_A$ is supplied to each pixel circuit $P_{IX}$ may be employed.

F: Sixth Embodiment

In the fifth embodiment, similarly to the second embodiment or the third embodiment, the initial compensation value $V_{INI}$ is set in the compensation preparation period $Q_A$ using the difference ($\delta_{L_H}>\delta_{H_L}$) between the increase amount $\delta_{L_H}$ and the decrease amount $\delta_{H_L}$ of the potential $V_G$. In the sixth embodiment, the method of the first embodiment in which the potential $V_G$ is set to the initial compensation value $V_{INI}$ using the charges accumulated in the additional capacitive element $C_P$ in the initialization period $T_{RST}$ is applied to the setting of the initial compensation value $V_{INI}$ of the fifth embodiment. The configuration of the pixel circuit $P_{IX}$ is equal to that of the fifth embodiment.

Figure 35:
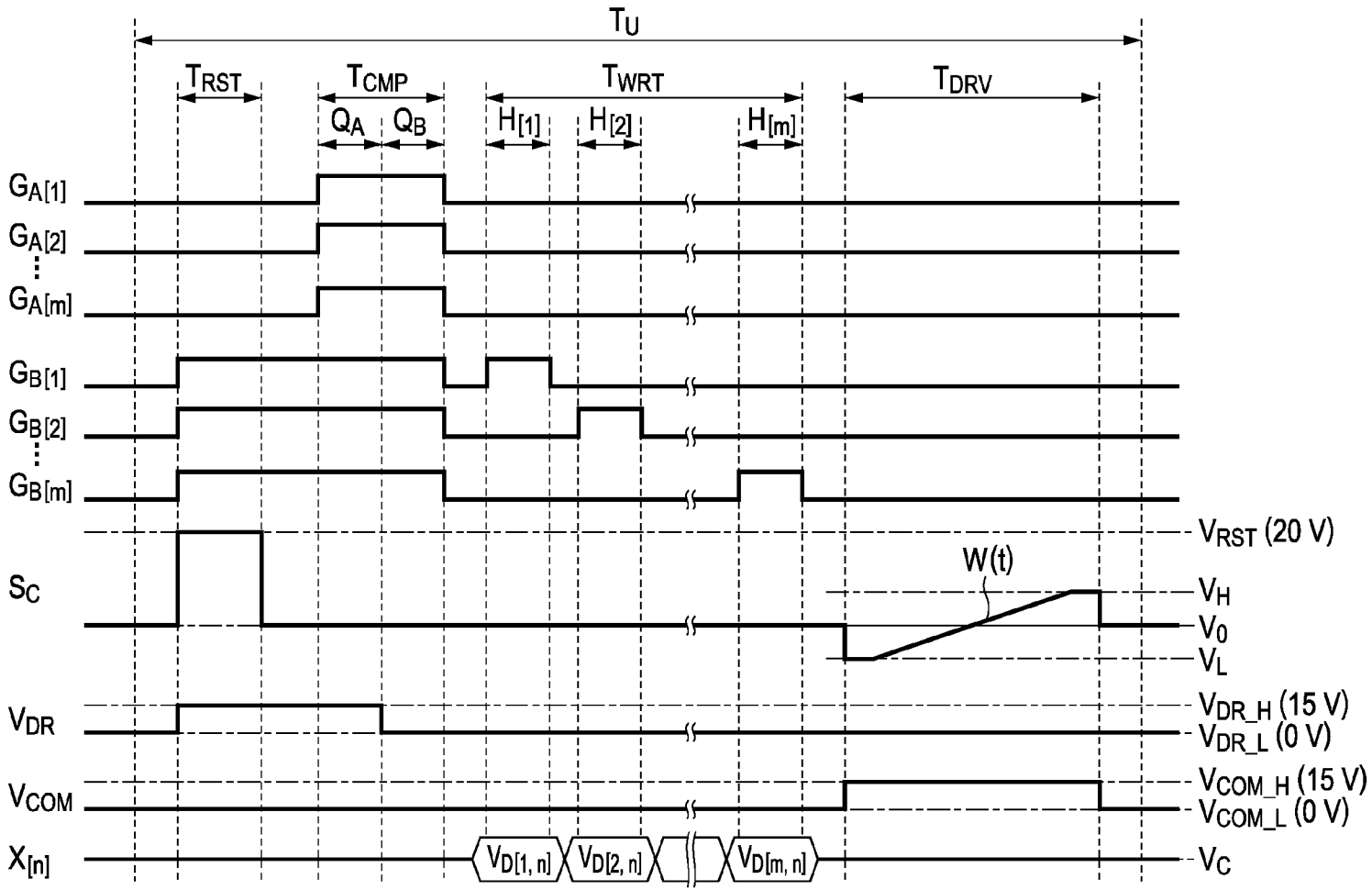
FIG. 35 is an explanatory diagram of an operation of a sixth embodiment.
Figure 36:
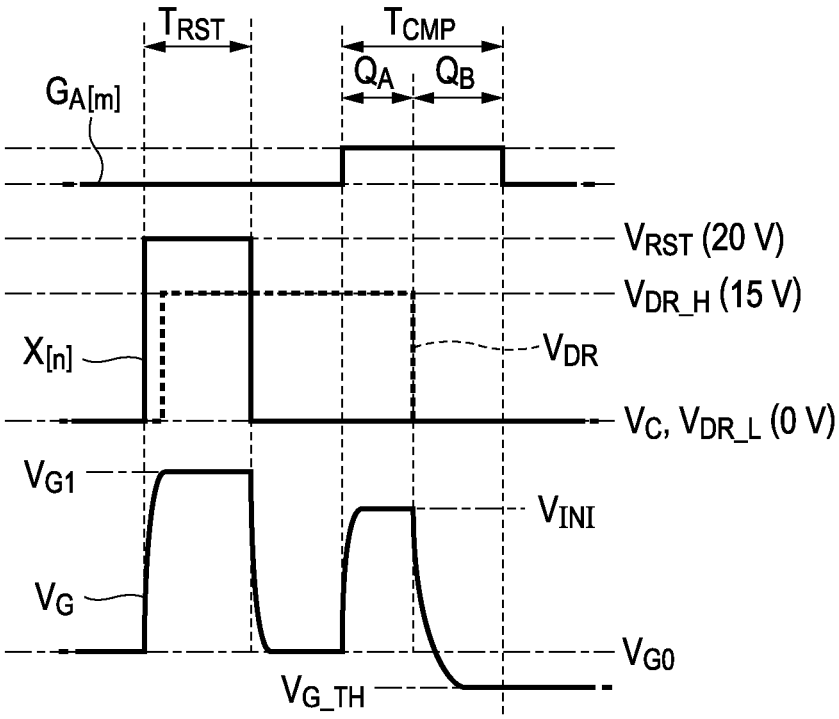
FIG. 36 is an explanatory diagram of an operation of an initialization period and a compensation period of the sixth embodiment.

FIG. 35 is an explanatory diagram of an operation of an electro-optical device 100 according to a sixth embodiment. FIG. 36 is a schematic diagram showing transition of the potential $V_G$ of the gate of the driving transistor $T_{DR}$ in the initialization period $T_{RST}$ and the compensation period $T_{CMP}$. Similarly to the fifth embodiment, the potential control circuit 36 sets the capacitive potential $S_C$ to the initialization potential $V_{RST}$ in the initialization period $T_{RST}$ and sets the driving potential $V_{DR}$ to the high-level potential $V_{DR_H}$ so as to initialize the potential $V_P$ of the circuit point p to the high-level potential $V_{DR_H}$. If the end point of the initialization period $T_{RST}$ is reached, the potential control circuit 36 changes the capacitive potential $S_C$ from the initialization potential $V_{RST}$ to the potential $V_0$, as shown in FIGS. 35 and 36. Accordingly, the potential $V_G$ of the gate of the driving transistor $T_{DR}$ is changed to the potential $V_{G0}$ before the start of the initialization period $T_{RST}$.

When the compensation preparation period $Q_A$ of the compensation period $T_{CMP}$) starts after the initialization period $T_{RST}$ finishes, the row driving circuit 32 sets the control signals $G_{A[1]}$ to $G_{A[m]}$ to the high level so as to control the switch $S_{W1}$ of each of all pixel circuits $P_{IX}$ to the on state, as shown in FIGS. 35 and 36. Accordingly, the charges accumulated in the additional capacitive element $C_P$ are moved to the gate of the driving transistor $T_{DR}$ through the switch $S_{W1}$ in the initialization period $T_{RST}$ and the potential $V_G$ of the gate of the driving transistor $T_{DR}$ is changed to the initial compensation value $V_{INI}$ exceeding the preceding potential $V_{G0}$. More specifically, the initial compensation value $V_{INI}$ is expressed by Equation 2 including a coefficient γp ($\gamma p = c_P/(c_1+c_2+c_P)$) according to the capacitance value $c_1$ of the capacitive element $C_1$, the capacitance value $c_2$ of the capacitive element $C_2$, and the capacitance value $c_P$ of the capacitive element $C_P$.

$$V_{INI} = \gamma p \cdot V_{DR_H} + (1-\gamma p) V_{G2} \quad (2)$$

In the compensation execution period $Q_B$ after the elapse of the compensation preparation period $Q_A$, similarly to the fifth embodiment, the driving potential $V_{DR}$ is changed from the high-level potential $V_{DR_H}$ to the low-level potential $V_{DR_L}$ so as to execute the compensation operation. The operations in the write period $T_{WRT}$ and the operation period $T_{DRV}$ are equal to those of the fifth embodiment. Even in the sixth embodiment, the same effects as the fifth embodiment are realized.

G: Seventh Embodiment

In the above-described embodiments, the forward bias (positive polarity voltage) is applied to the electrophoretic element 40 in the operation period $T_{DRV}$ and the reverse bias (negative polarity voltage) is applied to the electrophoretic element 40 in the initialization period $T_{RST}$. Accordingly, when comparing with a configuration in which the reverse bias is not applied within the unit period $T_U$ (for example, a configuration in which the common potential $V_{COM}$ is held at the high-level potential $V_{COM_H}$) in the initialization period $T_{RST}$, it is possible to suppress the application of the DC component to the electrophoretic element 40. Since the time when the forward bias is applied and the time (initialization period $T_{RST}$) when the reverse bias is applied are different, it is difficult to completely prevent the application of the DC component to the electrophoretic element 40. In the seventh embodiment, the DC component is prevented from being applied by appropriately selecting the gradation potential $V_{D[m,n]}$ with respect to a plurality of unit periods $T_U$ of the case of changing a display image.

Figure 37:
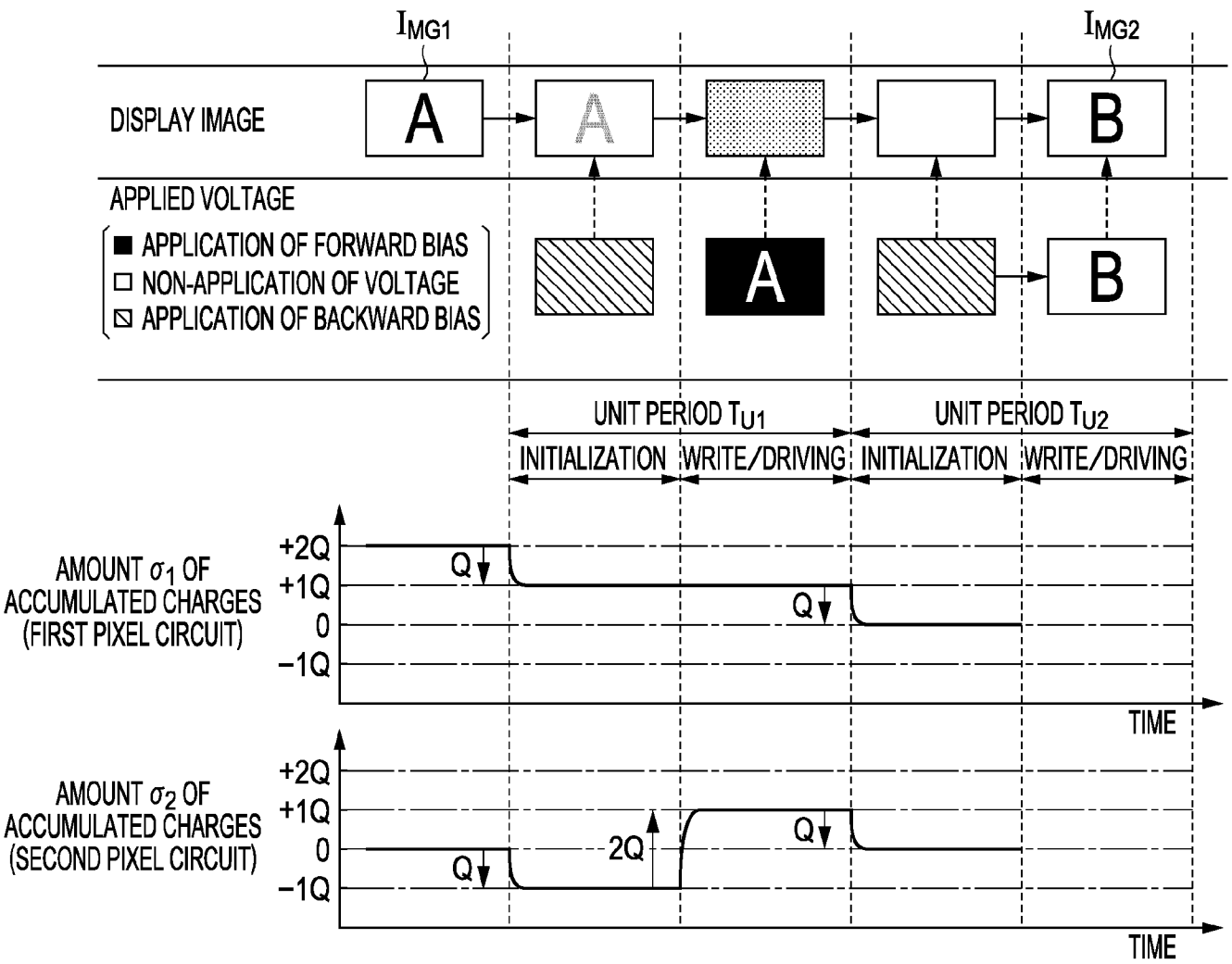
FIG. 37 is an explanatory diagram of an operation of a seventh embodiment.

FIG. 37 is an explanatory diagram of an operation of an electro-optical device 100 of the seventh embodiment. As shown in FIG. 37, the case where the display image of the display unit 20 is changed from an image $I_{MG1}$ to an image $I_{MG2}$ is considered. The image $I_{MG1}$ is a still image in which a black character "A" is arranged in a white background and the image $I_{MG2}$ is a still image in which a black character "B" is arranged in a white background. The image $I_{MG1}$ is changed to the image $I_{MG2}$ through a unit period $T_{U1}$ and a unit period $T_{U2}$ from a state in which the image $I_{MG1}$ is displayed.

In FIG. 37, temporal transition of the amount σ of charges (hereinafter, referred to as the "amount of accumulated charge") accumulated in the electrophoretic element 40 of each pixel circuit $P_{IX}$ is shown. The amount $\sigma_1$ of accumulated charges of FIG. 37 refers to the amount of charges accumulated in the electrophoretic element 40 of each pixel circuit (hereinafter, referred to as a "first pixel circuit") corresponding to a black pixel configuring the character "A" of the image $I_{MG1}$ among the plurality of pixel circuits $P_{IX}$ within the display unit 20. In contrast, the amount $\sigma_2$ of accumulated charges refers to the amount of charges accumulated in the electrophoretic element 40 of each pixel circuit (hereinafter, referred to as a "second pixel circuit") $P_{IX}$ corresponding to a white pixel configuring the background of the image $I_{MG1}$ among the plurality of pixel circuits $P_{IX}$ within the display unit 20. As the amount σ ($\sigma_1$, $\sigma_2$) of accumulated charge is increased to a positive polarity side, the display gradation of the electrophoretic element 40 transitions to a black side.

In FIG. 37, the voltage applied to the electrophoretic element 40 of each pixel circuit $P_{IX}$ is schematically shown. In the operation period $T_{DRV}$, the forward bias is applied to the electrophoretic element 40 of the pixel circuit $P_{IX}$ in which black is designated and the voltage is not applied to the electrophoretic element 40 of the pixel circuit $P_{IX}$ in which white is designated (that is, the driving transistor $T_{DR}$ does not transition to the on state). In contrast, in the initialization period $T_{RST}$, the reverse bias is uniformly applied to the electrophoretic element 40 of each of all pixel circuits $P_{IX}$. When the forward bias is applied, charges of +2Q are supplied to the electrophoretic element 40 and a display gradation transitions to a black side and, when the reverse bias is applied, charges of Q are eliminated from the electrophoretic element 40 and a display gradation transitions to a white side. In the case where the voltage is not applied (non-application of the voltage), charge movement (change in the amount of accumulated charges σ) does not occur. As shown in FIG. 37, in a state in which the image $I_{MG1}$ is displayed (before the start of the unit period $T_{U1}$), the amount $\sigma_1$ of accumulated charges of the electrophoretic element 40 of the first pixel circuit $P_{IX}$ (black) is +2Q and the amount $\sigma_2$ of accumulated charges of the electrophoretic element 40 of the second pixel circuit $P_{IX}$ (white) is zero.

In the initialization operation within the unit period $T_{U1}$, the reverse bias is applied to the electrophoretic element 40 of each of all pixel circuits $P_{IX}$. As shown in FIG. 37, the amount $\sigma_1$ of accumulated charges of the first pixel circuit $P_{IX}$ is reduced from +2Q by Q and is changed to +1Q by applying the reverse bias. Accordingly, the gradation of the electrophoretic element 40 of each first pixel circuit $P_{IX}$ becomes a middle tone (gray) transitioning from black to the white side by the decrease of charges Q. The amount $\sigma_2$ of accumulated charges of the second pixel circuit $P_{IX}$ is reduced from zero by Q and is changed to −1Q by applying the reverse bias, but the gradation of the electrophoretic element 40 already reaches white (maximum gradation). Thus, even when the amount $\sigma_2$ of accumulated charges is reduced, the gradation of the electrophoretic element 40 is barely changed (overwriting).

In the writing operation within the unit period $T_{U1}$, the control circuit 12 designates the white gradation to each first pixel circuit $P_{IX}$ for displaying the black pixel of the image $I_{MG1}$ and designates the black gradation to each second pixel circuit $P_{IX}$ for displaying the white pixel of the image $I_{MG1}$. Accordingly, in the driving operation (operation period $T_{DRV}$) within the unit period $T_{U1}$, as shown in FIG. 37, the voltage is not applied to the electrophoretic element 40 of the first pixel circuit $P_{IX}$ and the forward bias is applied to the electrophoretic element 40 of the second pixel circuit $P_{IX}$. That is, the amount $\sigma_1$ of accumulated charges of the first pixel circuit $P_{IX}$ is held at +1Q after applying the reverse bias and the amount $\sigma_2$ of accumulated charges of the second pixel circuit $P_{IX}$ is increased from −1Q after applying the reverse bias in the initialization period $T_{RST}$ by 2Q and is changed to +1Q by applying the forward bias. As described above, by the application of the reverse bias in the initialization period $T_{RST}$ of the unit period $T_{U1}$ and the application of the voltage in the operation period $T_{DRV}$ (application of the forward bias/non-application of the voltage), the amount $\sigma_1$ of accumulated charges of the first pixel circuit $P_{IX}$ and the amount $\sigma_2$ of accumulated charges of the second pixel circuit $P_{IX}$ coincide with each other ($\sigma_1=\sigma_2=+1Q$). As shown in FIG. 37, the gradation of the electrophoretic element 40 becomes a middle tone (gray) corresponding to the amount +1Q of charges in both the first pixel circuit $P_{IX}$ and the second pixel circuit $P_{IX}$.

Even in the initialization operation (initialization period $T_{RST}$) of the unit period $T_{U2}$, similarly to the unit period $T_{U1}$, since the reverse bias is applied to the electrophoretic element 40 of each of all pixel circuits $P_{IX}$, the charges of Q are eliminated from the electrophoretic element 40 in both the first pixel circuit $P_{IX}$ and the second pixel circuit $P_{IX}$. Accordingly, as shown in FIG. 37, both the amount $\sigma_1$ of accumulated charges and the amount $\sigma_2$ of accumulated charges are changed from +1Q to zero and the gradations of all electrophoretic elements 40 within the display unit 20 are controlled to white. That is, the application of the DC component to the electrophoretic element 40 is solved in both the first pixel circuit $P_{IX}$ and the second pixel circuit $P_{IX}$. In the writing operation of the unit period $T_{U2}$, the control circuit 12 designates the gradation of each pixel of the image $I_{MG2}$ to each pixel circuit $P_{IX}$. Accordingly, the display image of the display unit 20 is changed from the image $I_{MG1}$ to the image $I_{MG2}$.

According to the above-described seventh embodiment, in spite of the configuration in which only the forward bias is applied to the electrophoretic element 40 in the operation period $T_{DRV}$ and the reverse bias is uniformly applied to the electrophoretic elements 40 of all the pixel circuits $P_{IX}$ in the initialization period $T_{RST}$, it is possible to efficiently prevent the DC component from being applied to the electrophoretic element 40. Accordingly, it is possible to efficiently prevent deterioration of the electrophoretic element 40 due to the application of the DC component.

Although the white gradation is designated to each first pixel circuit $P_{IX}$ for displaying the black pixel of the image $I_{MG1}$ and the black gradation is designated to each second pixel circuit $P_{IX}$ for displaying the white pixel of the image $I_{MG1}$ in the writing operation within the unit period $T_{U1}$ in the above description, the image $I_{MG1}$ is not limited to binary images of white and black. For example, even when the image $I_{MG1}$ includes a middle tone, the above embodiments are equally applied. In the case of including a first gradation and a second gradation (irrespective of presence/absence of other gradation) in which the image $I_{MG1}$ before change is different is assumed, the writing operation within the unit period $T_{U1}$ is included as an operation for supplying the gradation potential $V_{D[m,n]}$ according to the first gradation to each first pixel circuit $P_{IX}$ for displaying the pixel of the first gradation of the image $I_{MG1}$ and supplying the gradation potential $V_{D[m,n]}$ according to the second gradation to each second pixel circuit $P_{IX}$ for displaying the pixel of the second gradation of the image $I_{MG1}$. In the above expression, the complementary gradation of the first gradation is suitable as the "gradation according to the first gradation". Similarly, the complementary gradation of the second gradation is suitable as the "gradation according to the second gradation". The "complementary gradation" refers to a gradation in which a luminance difference from a central value (that is, a middle luminance between a maximum luminance and a minimum luminance) between white and black is equal. For example, when focusing upon four kinds of gradations including white, slightly gray (light gray), charcoal (dark gray) and black, a relationship between white and black or a relationship between slightly gray and charcoal corresponds to the complementary gradation. According to the above configuration, even in the case where the image $I_{MG1}$ includes a middle tone, it is possible to suit the gradation of the electrophoretic element 40 of both the first pixel circuit $P_{IX}$ and the second pixel circuit $P_{IX}$ to a middle tone corresponding to the amount +1Q of charges.

H: Modified Example

The above embodiments may be variously modified. Now, the detailed modified examples will be described. Two or more examples which are arbitrarily selected from the following examples may be appropriately combined.

1. Modified Example 1

Although the configuration (hereinafter, referred to as "configuration A") in which the driving transistor $T_{DR}$ is changed from the off state to the on state at a time according to the designated gradation within the operation period $T_{DRV}$ is described in the above embodiments, a configuration (hereinafter, referred to as "configuration B") in which the driving transistor $T_{DR}$ is changed from the on state to the off state at a time according to the designated gradation within the operation period $T_{DRV}$ may be employed. According to configuration A employed in the above-described embodiment, as described in detail below, it is possible to shorten a time when a user actually recognizes the content of the display image from start of the operation period $T_{DRV}$, as compared to configuration B.

Figure 38:
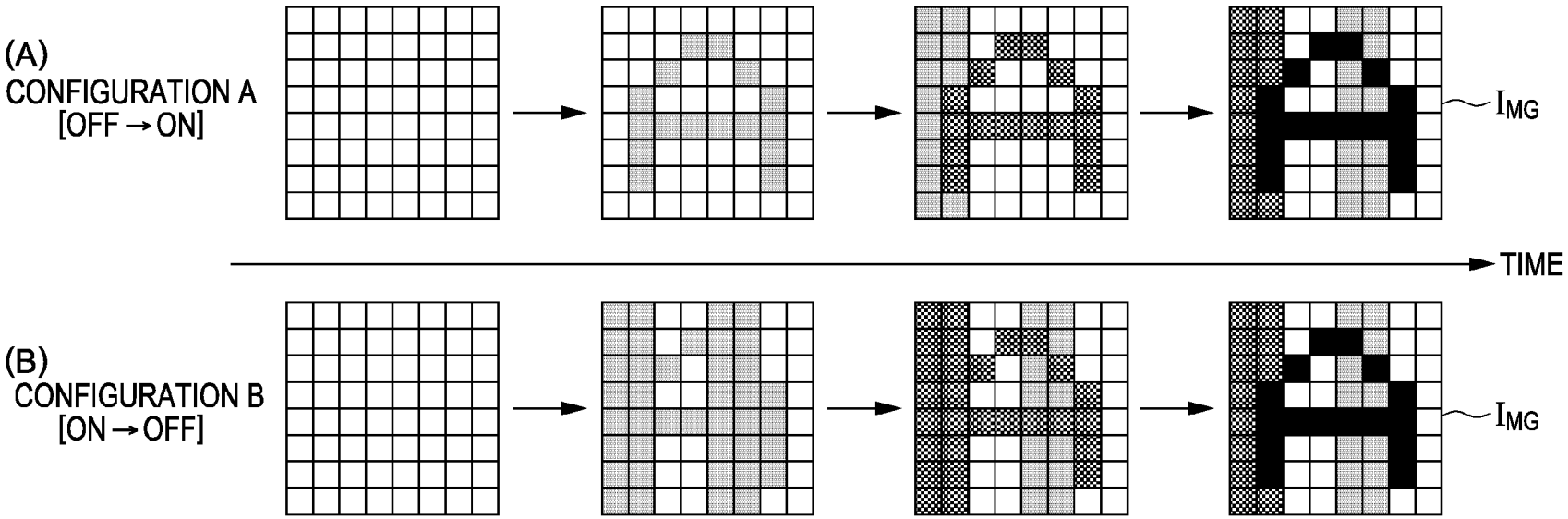
FIG. 38 is an explanatory diagram of a relationship between driving of a driving transistor and visibility of a display image.

FIG. 38 is a schematic diagram of a state in which the display image of the display unit 20 is changed with time from the start point to the end point of the operation period $T_{DRV}$. A part (A) of FIG. 38 corresponds to configuration A and a part (B) of FIG. 38 corresponds to configuration B. In FIG. 38, the case of displaying an image $I_{MG}$ including four kinds of gradations (white, black, and two kinds of middle tones) is considered, the image $I_{MG}$ is an image in which a black character "A" is arranged in a background including white and a middle tone.

As shown in the part (B) of FIG. 38, in configuration B, the driving transistor $T_{DR}$ of each pixel circuit $P_{IX}$ in which gradations (black and a middle tone) other than white are designated is concurrently changed to the on state at the start point of the operation period $T_{DRV}$ such that the gradation of the electrophoretic element 40 begins to transition to the black side and the driving transistor $T_{DR}$ is changed from the on state to the off state at a time according to the designated gradation of each pixel circuit $P_{IX}$ in the operation period $T_{DRV}$ such that the change in the gradation of the electrophoretic element 40 is stopped. Accordingly, the black character "A" of the image $I_{MG}$ is first recognized by the user in a step just before the end point of the operation period $T_{DRV}$.

In contrast, as shown in the part (A) of FIG. 38, in configuration A, the driving transistor $T_{DR}$ of each pixel circuit $P_{IX}$ is set to the off state at the start point of the operation period $T_{DRV}$ and the driving transistor $T_{DR}$ is changed from the off state to the on state at a time according to the designated gradation of each pixel circuit $P_{IX}$ such that the gradation of the electrophoretic element 40 begins to transition to the black side. That is, as the designated gradation of each pixel circuit $P_{IX}$ is close to black, the gradation of the electrophoretic element 40 begins to transition to black from an early time within the operation period $T_{DRV}$. Accordingly, the black character "A" is recognized by the user from the early time of the operation period $T_{DRV}$. That is, according to configuration A, it is possible to shorten a time when the user actually recognizes an image (in particular, a character) from the start point of the operation period $T_{DRV}$, as compared to configuration B.

2. Modified Example 2

Figure 39:
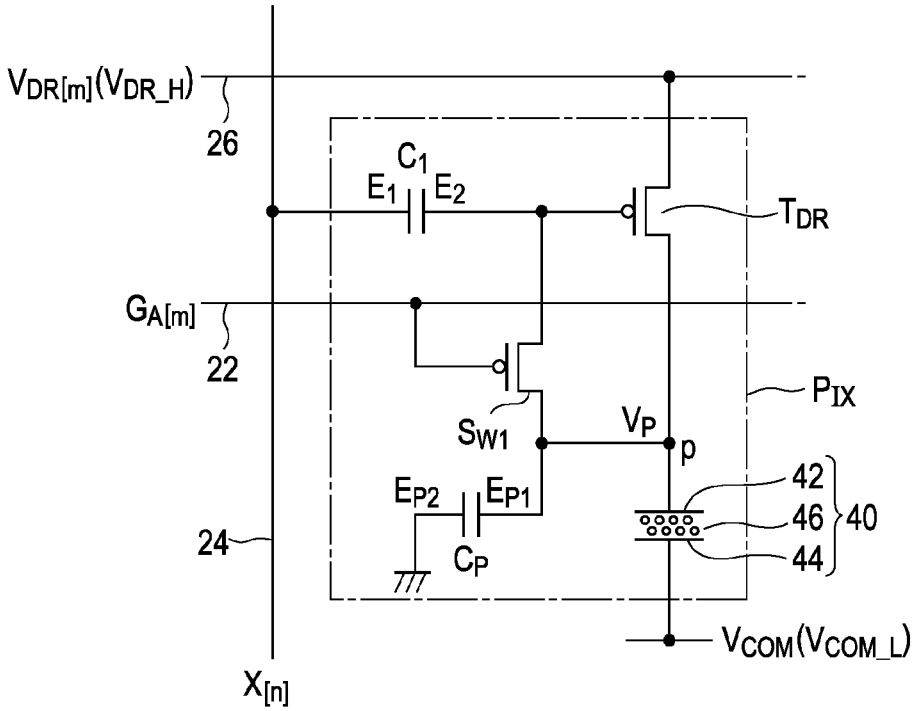
FIG. 39 is a circuit diagram of a pixel circuit according to a modified example.
Figure 40:
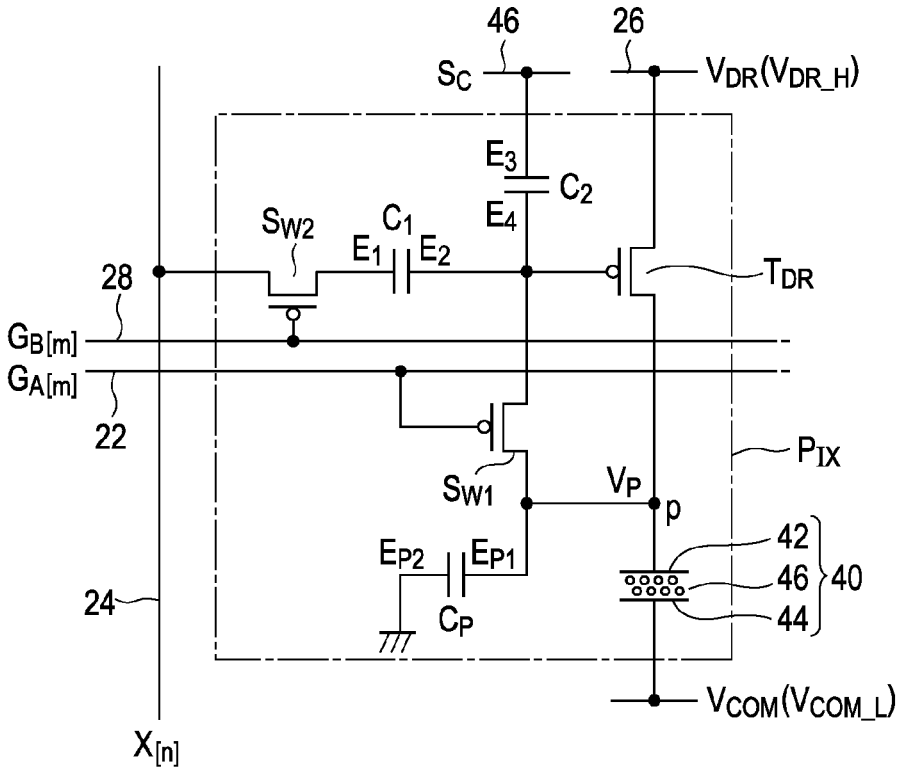
FIG. 40 is a circuit diagram of a pixel circuit according to a modified example.

The conductive type of each transistor configuring the pixel circuit $P_{IX}$ is arbitrarily changed. For example, the configuration of FIG. 39 in which each transistor ($T_{DR}$, $S_{W1}$) of the pixel circuit $P_{IX}$ of the first embodiment (FIG. 2) is changed to a P channel type or the configuration of FIG. 40 in which each transistor ($T_{DR}$. $S_{W1}$, $S_{W2}$) of the pixel circuit $P_{IX}$ of the fifth embodiment (FIG. 22) is changed to a P channel type may be employed. In the configuration of FIG. 39 or 40, the level of the voltage is reversed as compared to the configuration of FIG. 2 or FIG. 22. For example, in the operation period $T_{DRV}$, the common potential $V_{COM}$ of the counter electrode 44 is set to the low-level potential $V_{COM_L}$ and the driving potential $V_{DR[m]}$ ($V_{DR}$) of the driving potential line 26 is set to the high-level potential $V_{DR_H}$. However, since the essential operation is equal to that of the above embodiments, the description of the operation of the case of employing the pixel circuit $P_{IX}$ of FIG. 39 or FIG. 40 will be omitted. Although the pixel circuit $P_{IX}$ in which different conductive types of transistors are mixed may be employed, from the viewpoint that the process of manufacturing the pixel circuit $P_{IX}$ is simplified, the configuration in which the conductive type of each transistor within the pixel circuit $P_{IX}$ is communalized is especially suitable as in the above embodiments.

The material, the structure or the manufacturing method of each transistor ($T_{DR}$, $S_{W2}$, $S_{W2}$) of the pixel circuit $P_{IX}$ is arbitrarily changed. For example, as the material of a semiconductor layer of each transistor, an amorphous semiconductor (amorphous silicon), an oxide semiconductor, an organic semiconductor, or a polycrystalline semiconductor (for example, high-temperature polysilicon or low-temperature polysilicon) is arbitrarily employed.

3. Modified Example 3

In the above-described embodiments, the configuration (the first embodiment, the second embodiment, the third embodiment, and the fourth embodiment) in which the pixel circuit $P_{IX}$ includes two transistors ($T_{DR}$, $S_{W1}$) and the configuration (the fifth embodiment and the sixth embodiment) in which the pixel circuit $P_{IX}$ includes three transistors ($T_{DR}$, $S_{W2}$, $S_{W2}$) are described. As the configuration for setting the potential $V_G$ of the gate of the driving transistor $T_{DR}$ in the compensation preparation period $Q_A$ as the initial compensation value $V_{INI}$, the configuration (the first embodiment, the fourth embodiment and the sixth embodiment) of using the movement of the charges of the additional capacitive element $C_P$ accumulated in the initialization period $T_{RST}$ and the configuration (the second embodiment, the third embodiment and the fifth embodiment) of using the difference between the increase amount $\delta_{L_H}$ and the decrease amount $\delta_{H_L}$ of the potential $V_G$ are described. With respect to the configuration in which the potential $V_G$ of the gate of the driving transistor $T_{DR}$ is increased in the initialization period $T_{RST}$, the configuration (the first embodiment, the second embodiment and the fourth embodiment) of using the instruction signal $X_{[n]}$ and the configuration (the third embodiment, the fifth embodiment and the sixth embodiment) of using the capacitive potential $S_C$ are described. As the configuration in which the voltage $V_{GS}$ between the gate and the source of the driving transistor $T_{DR}$ is changed with time in the operation period $T_{DRV}$, the configuration (the first embodiment and the second embodiment) of setting the instruction signal $X_{[n]}$ to the potential W(t), the configuration (the third embodiment, the fifth embodiment and the sixth embodiment) of setting the capacitive potential $S_C$ to the potential W(t), and the configuration (the fourth embodiment) of setting the driving potential $V_{DR}$ to the potential W(t) are described. A combination of the above-described elements (the configuration of setting the number of transistors of the pixel circuit $P_{IX}$ and the initial compensation value $V_{INI}$, the configuration of increasing the potential $V_G$ in the initialization period $T_{RST}$, and the configuration of changing the voltage $V_{GS}$) is arbitrary and is not limited to the above-described embodiments and modifications may be appropriately made.

4. Modified Example 4

Although the instruction signal $X_{[n]}$ is set to the gradation potential $V_{D[m,n]}$ before the start of the compensation execution period $Q_B$ in the first embodiment to the fourth embodiment, the start point of the writing operation is appropriately changed. For example, a configuration of setting the instruction signal $X_{[n]}$ to the gradation potential $V_{D[m,n]}$ after the end point of the compensation preparation period $Q_A$ may be employed. However, a configuration in which the potential of the electrode $E_1$ of the capacitive element $C_1$ is set to the gradation potential $V_{D[m,n]}$ at the end point of the compensation execution period $Q_B$ in which the potential $V_G$ of the gate of the driving transistor $T_{DR}$ is set to the potential $V_{G_TH}$ according to the threshold voltage $V_{TH}$ is suitable.

5. Modified Example 5

Although the potential W(t) is controlled to a ramp waveform (that is, a linearly monotonically increased or monotonically decreased waveform) in the above embodiments, the waveform of the potential W(t) is arbitrary. For example, although the potential W(t) is linearly changed in the above-described embodiment, a configuration in which the potential W(t) is curvedly changed may be employed. Although the potential W(t) is monotonically increased (in the fourth embodiment, monotonically decreased) within the operation period $T_{DRV}$ in the above-described embodiment, a configuration in which the potential W(t) is increased or decreased within the operation period $T_{DRV}$. More specifically, a triangular wave which is linearly increased (decreased) from the start point of the operation period $T_{DRV}$ and is linearly decreased (increased) from an intermediate point in time or a sine wave which is curvedly changed within the operation period $T_{DRV}$ may be used as the potential W(t).

6. Modified Example 6

Although the invention is applied to the pixel circuit $P_{IX}$ for driving the electro-optical element (electrophoretic element 40) in the above-described embodiments, the use of the electronic circuit according to the invention is not limited to driving of the electro-optical element. The pixel circuit $P_{IX}$ of the above-described embodiment generates a voltage signal according to the level of the gradation potential $V_{D[m,n]}$ and the potential W(t) at the circuit point p. Accordingly, an electronic circuit which employs the configuration of the pixel circuit $P_{IX}$ of the above-described embodiments (which does not include the electrophoretic element 40) may be used as a comparison circuit for comparing a first potential (for example, the gradation potential $V_{D[m,n]}$ and a second potential (for example, the potential W(t)). A load (driving load) driven by the comparison circuit is not limited to the electro-optical element. Although the potential W(t) is changed with time in order to realize an operation (pulse width modulation) for variably controlling a time for applying the forward bias to the electrophoretic element 40 according to the gradation potential $V_{D[m,n]}$ in the above-described embodiment, the potential W(t) does not need to be changed with time under the simple configuration for generating the signal according to the result of comparing a plurality of potential.

The pixel circuit $P_{IX}$ of each of the above embodiments is an example of an electronic circuit for compensating for the threshold voltage $V_{TH}$ of the driving transistor $T_{DR}$ (that is, a circuit for setting the voltage $V_{GS}$ between the gate and the source of the driving transistor $T_{DR}$ according to its threshold voltage $V_{TH}$). As can be understood from the above description, in the invention, the comparison circuit for comparing the plurality of potentials, which is included as an electronic circuit for compensating for the threshold voltage $V_{TH}$ of the driving transistor $T_{DR}$, is described as a suitable embodiment of the electronic circuit of the invention. The pixel circuit $P_{IX}$ of each of the above embodiments is a detailed example in which the electronic circuit (comparison circuit) of the invention is used in driving of the electrophoretic element 40.

7. Modified Example 7

The relationship between the voltage applied to the electrophoretic element 40 and the gradation is not limited to the above embodiments. For example, contrary to the example of FIG. 3, in the case of using the electrophoretic element 40 using white charged particles 462W charged with a negative polarity and black charged particles 462B charged with a positive polarity, the display gradation of the electrophoretic element 40 transitions to the white side by the application of the forward bias in the operation period $T_{DRV}$ and transitions to the black side by the application of the reverse bias in the initialization period $T_{RST}$. The positions of the pixel electrode 42 and the counter electrode 44 (observation side/rear surface side) are also changed. For example, if the counter electrode 44 is mounted on the rear surface side and the pixel electrode 42 is mounted on the front surface side in the example of FIG. 3, a configuration for transitioning the display gradation of the electrophoretic element 40 to the white side by the application of the forward bias is realized.

The configuration of the electrophoretic element 40 is also appropriately changed. For example, a configuration in which the white charged particles 462W are dispersed in the black dispersion medium 464 or a configuration in which black charged particles 462B are dispersed in the white dispersion medium 464 may be employed (1 particle system). The color of the charged particles 462 or the dispersion medium 464 configuring the electrophoretic element 40 is not limited to white and black and is arbitrarily changed. The electrophoretic element 40 in which at least three kinds of particles (for example, one kind of particle is not charged) corresponding to different display colors are dispersed may be employed.

An object driven by the pixel circuit $P_{IX}$ of each of the above embodiments is not limited to the electrophoretic element 40. For example, the invention is applicable to driving of an arbitrary electro-optical element such as a liquid crystal element, a light emitting element (for example, an organic EL element or a Light Emitting Diode (LED)), a field electron emission element (Field-Emission (FE) element), a surface electrical connection electron emission element (Surface electrical connection Electron emitter (SE) element), a ballistic electron emission element (Ballistic electron Emitting (BS) element), or a light receiving element. That is, the electro-optical element is included as a driven element for converting one into the other of an electrical operation (voltage application or current supply) and an optical operation (gradation change or light emission). From the viewpoint that the error of the characteristics of the driving transistor $T_{DR}$ is effectively compensated for, the invention is especially suitable when an electro-optical element with high resistance, such as an electrophoretic element 40 or a liquid crystal element, is driven.

I: Application

An electronic apparatus in which the invention is applied will now be described. The appearance of an electronic apparatus which employs the electro-optical device 100 of each of the above embodiments as a display device is shown in FIGS. 41 and 42.

Figure 41:
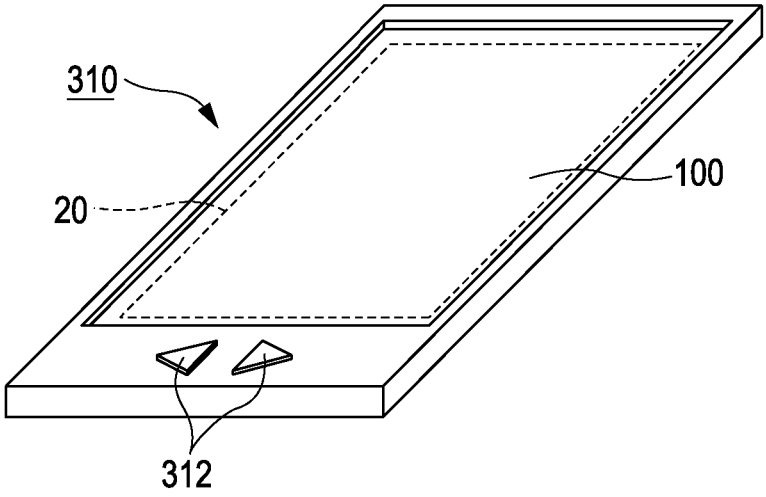
FIG. 41 is a perspective view of an electronic apparatus (information terminal).
Figure 42:
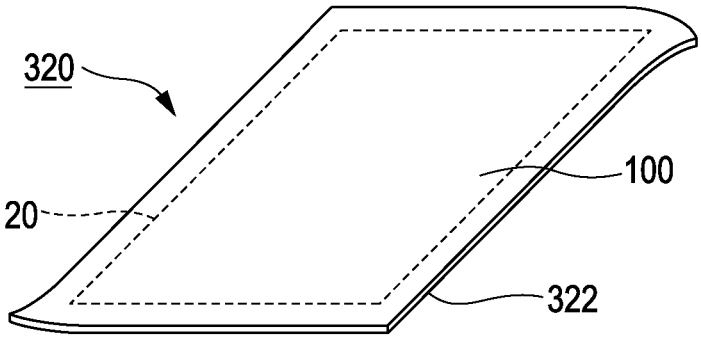
FIG. 42 is a perspective view of an electronic apparatus (electronic paper).
Figure 43:
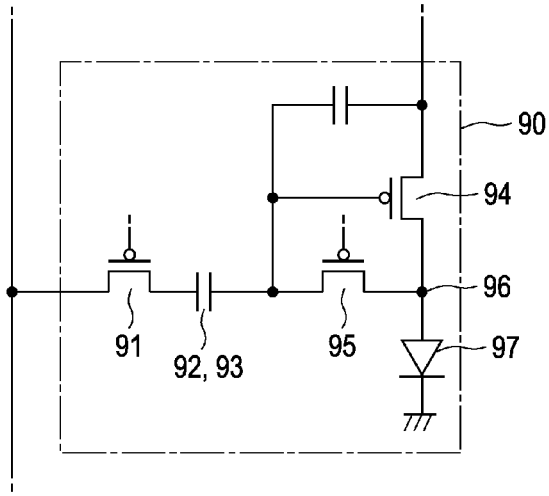
FIG. 43 (Prior Art)
FIG. 43 is a circuit diagram of a pixel circuit of JP-A-2009-48202.

FIG. 41 is a perspective view of a portable information terminal (electronic book) 310 using the electro-optical device 100. As shown in FIG. 41, the information terminal 310 includes an operation unit 312 operated by a user and an electro-optical device 100 for displaying an image on a display unit 20. If the operation unit 312 is operated, a display image of the display unit 20 is changed. FIG. 42 is a perspective view of an electronic paper 320 using an electro-optical device 100. As shown in FIG. 42, the electronic paper 320 includes an electro-optical device 100 formed on a surface of a flexible substrate (sheet) 322.

The electronic apparatus of the invention is not limited to the above embodiments. For example, the electronic apparatus (electro-optical device) of the invention may be employed in various electronic apparatuses, such as a mobile telephone, a watch (wristwatch), a portable sound reproduction device, an electronic organizer, or a display device equipped with a touch panel.

What is claimed is:

1. An electronic apparatus comprising an electronic circuit and a driving circuit, wherein the electronic circuit includes:

a driving transistor including a first terminal connected to a driving potential line to which a driving potential is supplied, a second terminal connected to a circuit point, and a control terminal for controlling a connection state between both terminals;

an additional capacitive element connected to the circuit point; and a first switch which controls a connection between the circuit point and the control terminal, wherein the driving circuit controls the first switch to an off state and changes the potential of the control terminal such that the driving transistor transitions to an on state, in a first period in which the driving potential is set to a first potential, controls the first switch to the on state so as to set the potential of the control terminal to an initial compensation value, in a second period after the elapse of the first period, and controls the first switch to the on state and changes the driving potential from the first potential to a second potential such that the driving transistor transitions to the on state, in a third period after the elapse of the second period.

2. The electronic apparatus according to claim 1, wherein the driving circuit changes the potential of the control terminal in an opposite direction of the change in the first period before the start of the second period and controls the first switch to the on state in the second period so as to set the potential of the control terminal to the initial compensation value.

3. The electronic apparatus according to claim 1, wherein the driving circuit changes the potential of the control terminal in an opposite direction of the change in the first period so as to set the potential of the control terminal to the initial compensation value, after the first switch is controlled to the on state, in the second period.

4. The electronic apparatus according to claim 1, wherein the electronic circuit includes a first capacitive element including a first electrode and a second electrode, the second electrode is connected to the control terminal, and the driving circuit supplies a signal potential to the first electrode within the third period or after the elapse of the third period, and variably sets a voltage between the control terminal and the first terminal in a fourth period after the elapse of the third period.

5. The electronic apparatus according to claim 4, wherein the driving circuit variably sets the potential of the first electrode in the fourth period.

6. The electronic apparatus according to claim 4, wherein the electronic circuit includes a second capacitive element including a third electrode and a fourth electrode, the fourth electrode is connected to the control terminal, and the driving circuit variably sets the potential of the third electrode in the fourth period.

7. The electronic apparatus according to claim 4, wherein the driving circuit variably sets the driving potential of the driving potential line in the fourth period.

8. The electronic apparatus according to claim 4, wherein the first electrode of the first capacitive element is directly connected to a signal line to which the signal potential is supplied.

9. The electronic apparatus according to claim 4, wherein the electronic circuit includes a second switch which controls electrical connection between the first electrode of the first capacitive element and a signal line to which the signal potential is supplied.

10. A method of driving an electronic apparatus including a driving transistor having a first terminal connected to a driving potential line to which a driving potential is supplied, a second terminal connected to a circuit point and a control terminal for controlling a connection state between both terminals, an additional capacitive element connected to the circuit point, and a first switch which controls a connection between the circuit point and the control terminal, the method comprising:

controlling the first switch to an off state and changing the potential of the control terminal such that the driving transistor transitions to an on state, in a first period in which the driving potential is set to a first potential;

controlling the first switch to the on state so as to set the potential of the control terminal to an initial compensation value, in a second period after the elapse of the first period; and controlling the first switch to the on state and changing the driving potential from the first potential to a second potential such that the driving transistor transitions to the on state, in a third period after the elapse of the second period.

* * * * *